US006209495B1

(12) United States Patent
Warren

(10) Patent No.: US 6,209,495 B1
(45) Date of Patent: Apr. 3, 2001

(54) COMPOUND TWO STROKE ENGINE

(76) Inventor: Walter Warren, Apt. 201-302 Hamilton Avenue, Winnipeg Manitoba (CA), R2Y 1W8

( * ) Notice: Subject to any disclaimer, the term of this patent is extended or adjusted under 35 U.S.C. 154(b) by 0 days.

(21) Appl. No.: 09/285,441

(22) Filed: Apr. 2, 1999

(51) Int. Cl.[7] ..... F02B 75/24

(52) U.S. Cl. ..... 123/55.2; 123/55.5; 123/55.7; 123/197.4

(58) Field of Search ..... 123/55.2, 55.6, 123/55.7, 65 R, 197.1, 197.4, 197.3, 55.4, 55.5, 65 BA, 559.1, 196 R, 196 M, 196 V

(56) References Cited

U.S. PATENT DOCUMENTS

| | | | | |
|---|---|---|---|---|
| 2,132,595 | * | 10/1938 | Bancroft | 123/65 BA |
| 2,133,578 | * | 10/1938 | Schjolin | 123/65 BA |
| 2,807,249 | * | 9/1957 | Peras | 123/55.6 |
| 3,119,462 | * | 1/1964 | McMahan | 123/55.7 |
| 3,851,630 | * | 12/1974 | Foster | 123/55.7 |
| 3,886,805 | | 6/1975 | Koderman . | |
| 3,895,620 | * | 7/1975 | Foster | 123/197.1 |
| 4,026,252 | * | 5/1977 | Wrin | 123/54.2 |
| 4,485,768 | * | 12/1984 | Heniges . | |
| 4,608,951 | | 9/1986 | White . | |
| 4,784,093 | * | 11/1988 | Pfeffer et al. | 123/78 B |
| 4,785,790 | * | 11/1988 | Pfeffer et al. | 123/78 B |
| 4,803,964 | | 2/1989 | Kurek et al. . | |
| 4,934,347 | * | 6/1990 | Suga et al. | 123/78 B |
| 5,123,334 | * | 6/1992 | Loo | 92/138 |
| 5,331,926 | * | 7/1994 | Vaux et al. | 123/55.3 |
| 5,476,074 | * | 12/1995 | Boggs et al. | 123/48 B |
| 6,024,067 | * | 2/2000 | Takachi et al. | 123/197.1 |

* cited by examiner

*Primary Examiner*—Willis R. Wolfe
*Assistant Examiner*—Hai Huynh
(74) *Attorney, Agent, or Firm*—Adrian D. Battison

(57) ABSTRACT

A two stroke compound engine has a pair of horizontally opposed piston cylinder assemblies extending along a common axis therein. Each piston cylinder assembly includes a piston, a combustion chamber and respective inlet and exhaust valves. A pair of connecting rods extending along the common axis connect the respective pistons to a crank extending from a rotary housing. The rotary housing is rotatably mounted within the engine and includes an output shaft extending co-axially therefrom. A fixed ring gear is mounted co-axially about the rotary housing along an axis extending perpendicularly to the common axis. A planetary gear mounted on the crank meshes with the ring gear for rotating the rotatable housing in response to reciprocation of the pistons. A pair of combustors are mounted on exhaust ports of the respective piston assemblies for further combusting exhaust from the combustion chambers by mixing exhaust with cooling air and additional fuel. A turbine recovers power from the combustion within the combustors. The turbine is connected to the output shaft by a gearing mechanism and an overrunning clutch mechanism.

37 Claims, 21 Drawing Sheets

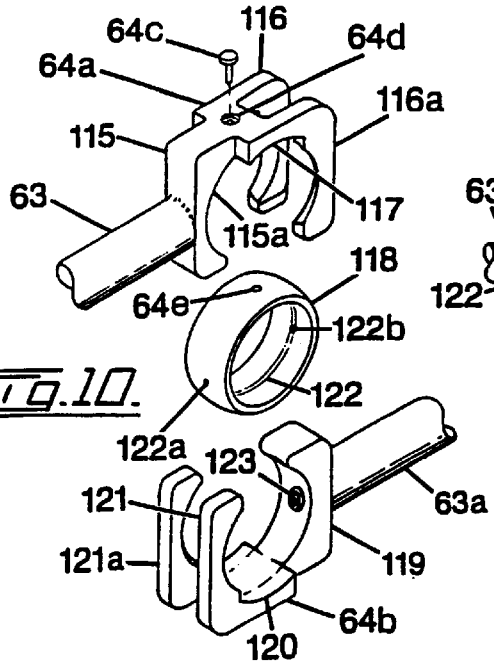
FIG. 10.
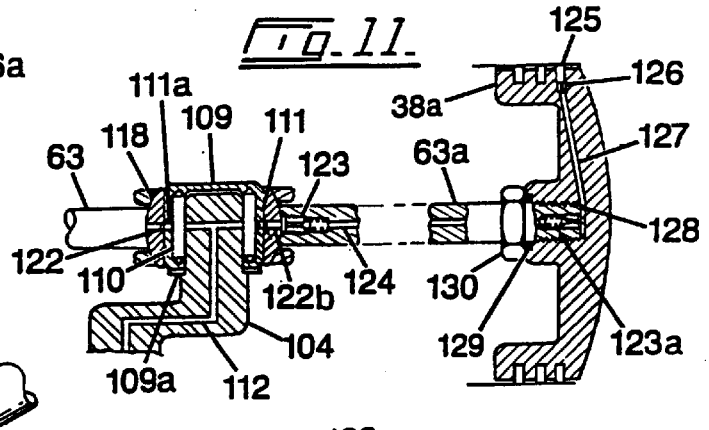
FIG. 11.
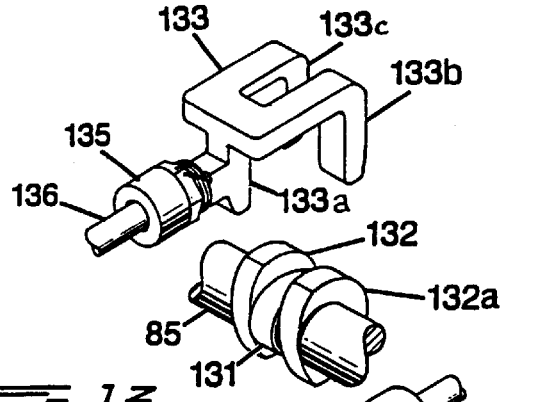
FIG. 12.
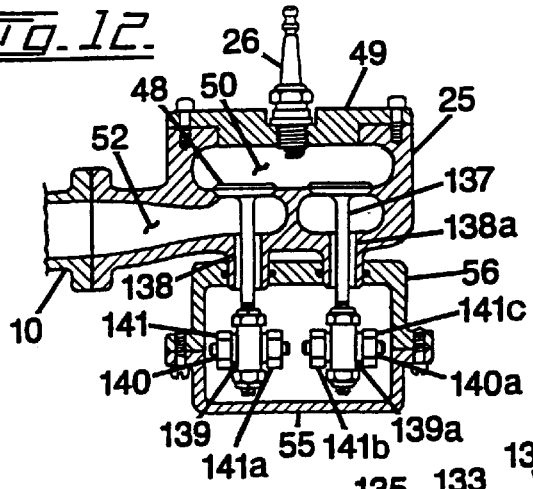
FIG. 13.
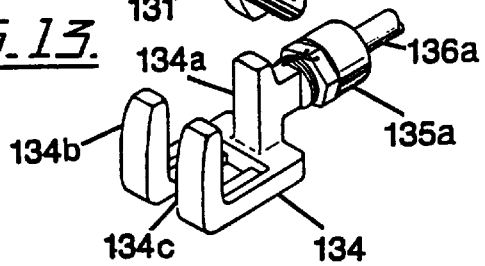
FIG. 14.
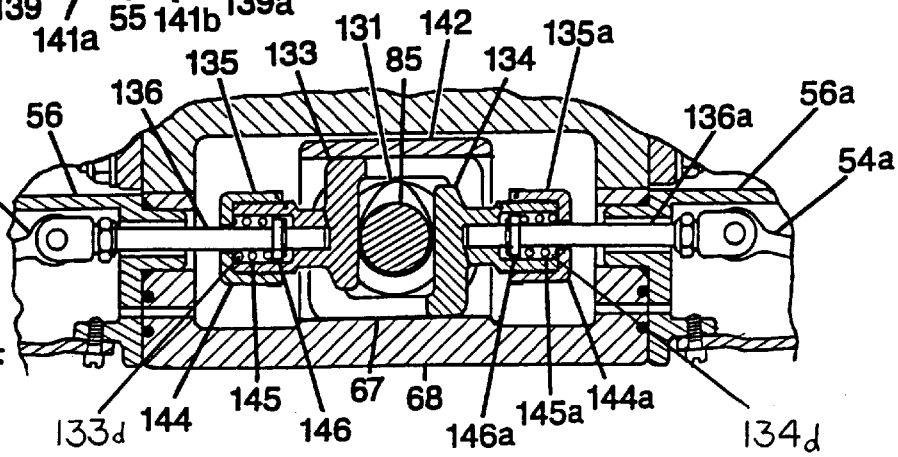

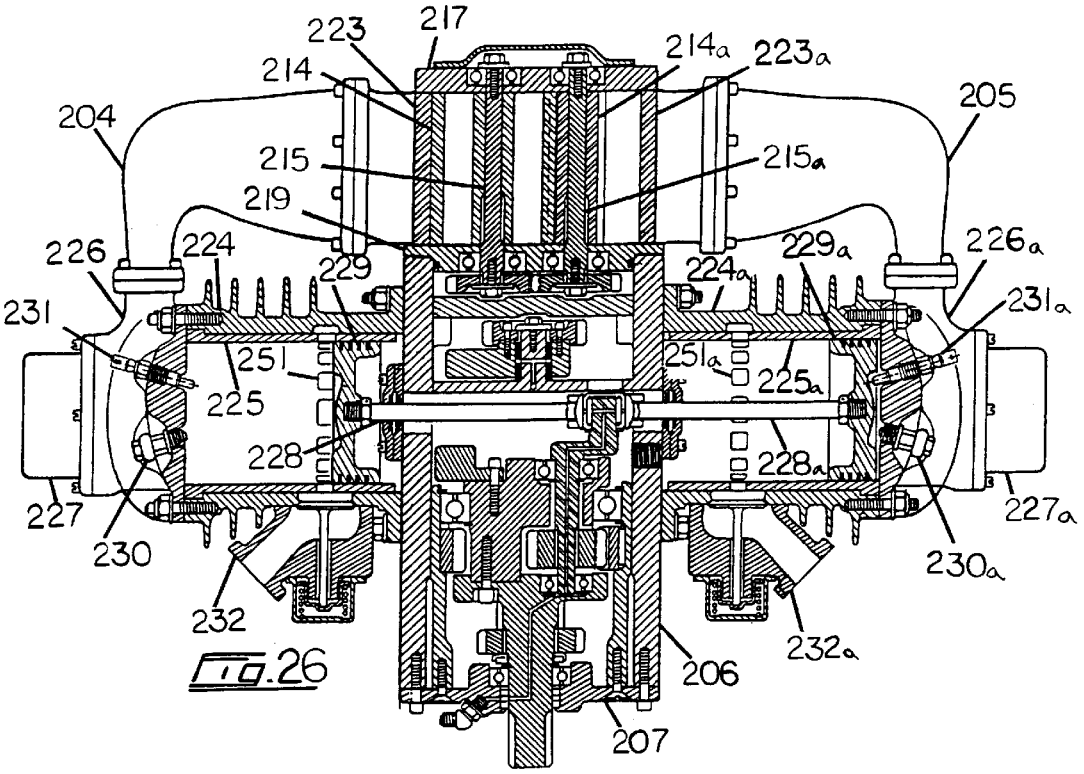
FIG.26
FIG.27
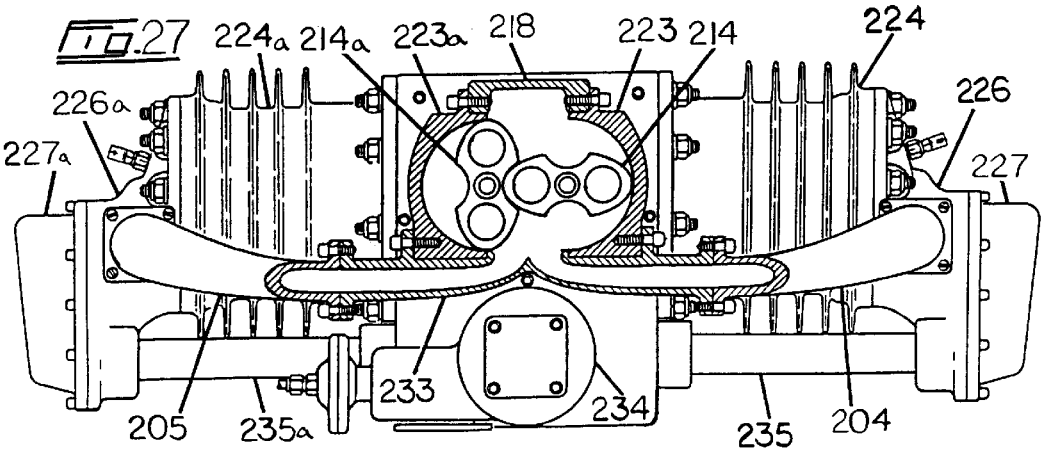

38
252
226
37
225
224
242
224a
225a
226a
252a
322
322a
248a
227
248
249
229
228a
229a
226c
249a
227a
247
250
251
250a
247a
226b
251a
241a
246a
246
258
211a
269
258a
245
243
240
235
236
236a
221
238a
240a
235a
245a
243a
244
241
242
239
237
237a
239a
242a
244a
238
211
238
256
257
258
259
260
259a
33
238a
255a
239a
235a
235
255
256a
240a
240
239
254
237
253
264
236
211a
236a
258a
33
257a
237a
253a
264a 261
261a
211a
260
259a
262a
262
263
237a
270
271
258a
209
269
268
267
266
266b
265a
264a 39
32
213
290
286
287
288
289
221
286a
222
272
272a
212
236
236a
235a
238
238a
211
209
240a
235
240
239
239a
279
292a
279a
273a
275a
292
281
275
273
210
280
35
35
282
282a
277
277a
280a
291
281a
276
274
274a
276a
284
283
283a
284a
285
39
32

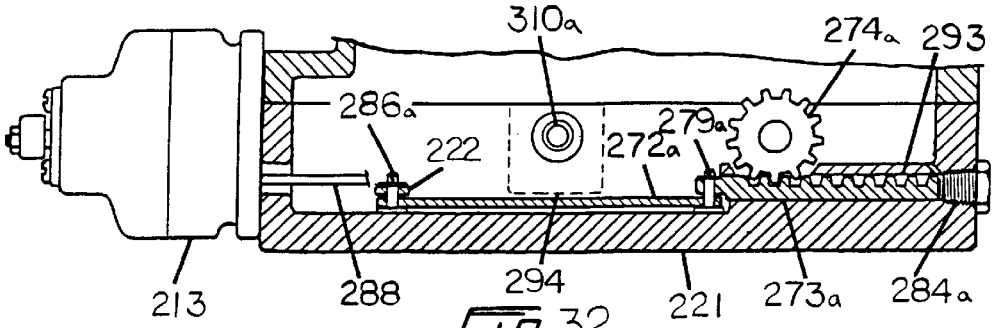
Fig. 32
Fig. 33
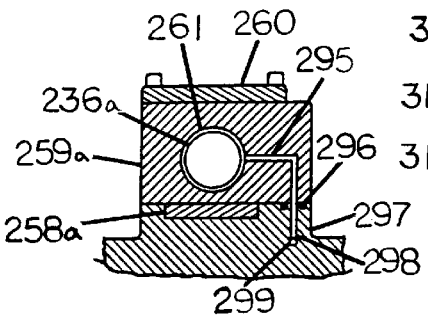
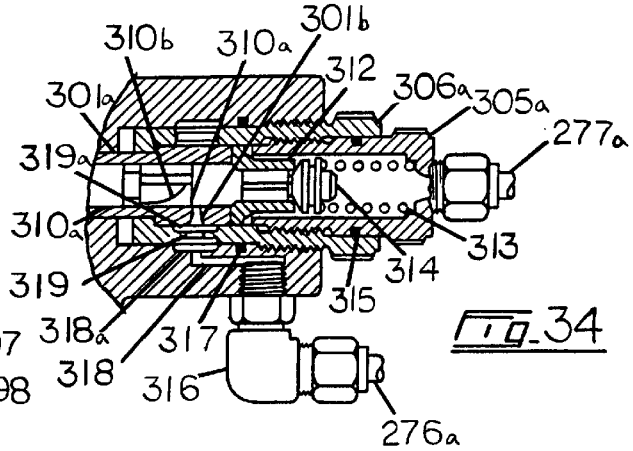
Fig. 34
Fig. 35
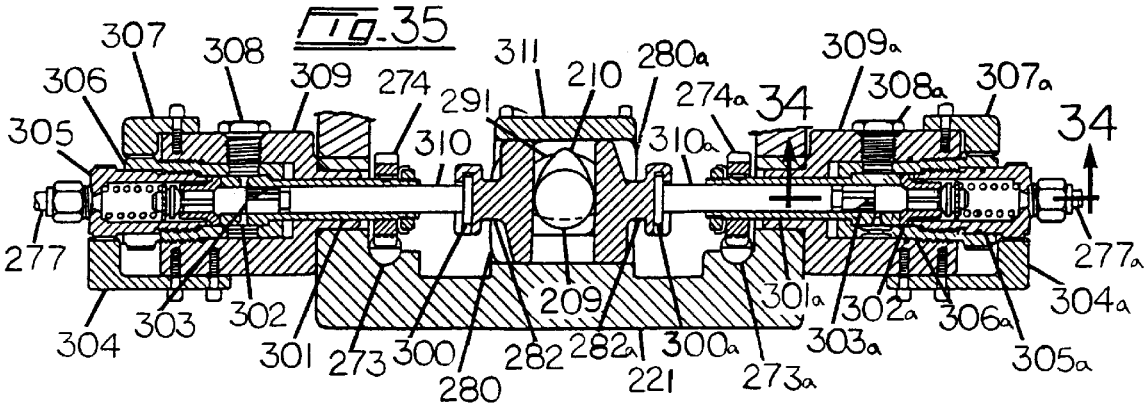

274a
311
275a
274
260
238a
290
276
277
320
275
213
238
221

230
252
231
204
224
321
225
250
235
240

252
230
231
322
204
323
246
321
243
324
244

213
325
326
327
209
328

401
406
406a
408
408a
413a
411a
412
412a
414a
409
413
411
410a
410
414
409a
415
417
417a
415a
424a
424
50
423
407
407a
423a
427
427a
420
431
420a
402
402a
428
429
430
421
433
432
421a
416
416a
434
422
422a
439
419
403
435
419a
438
436
418
437
418a
425
425a 404
50

FIG. 43
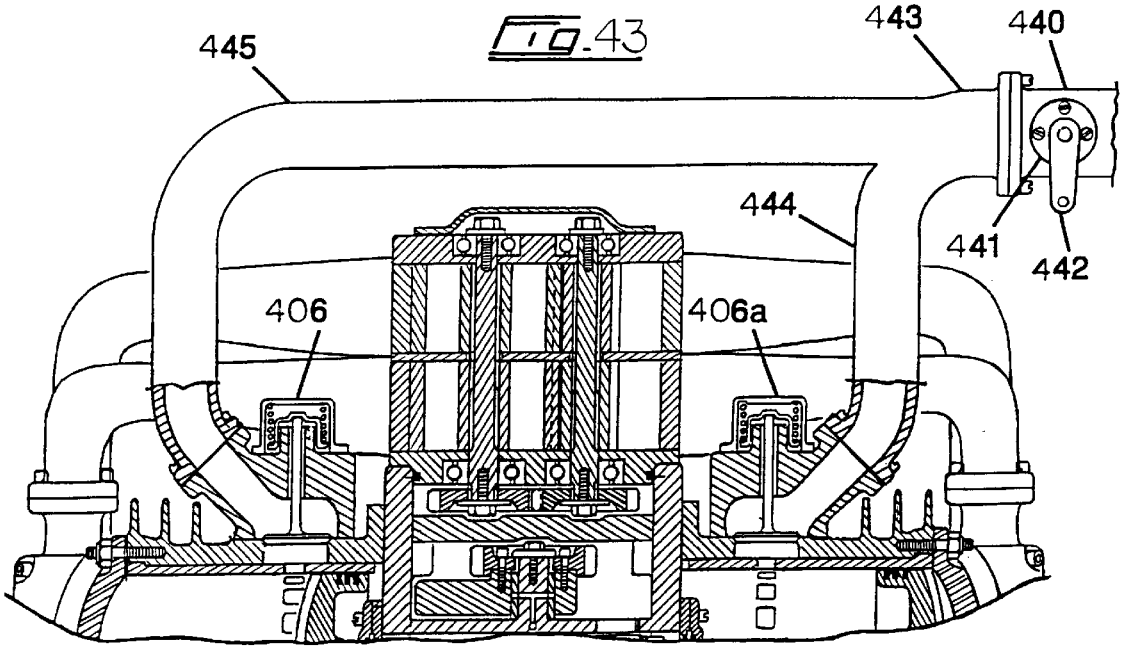
FIG. 44
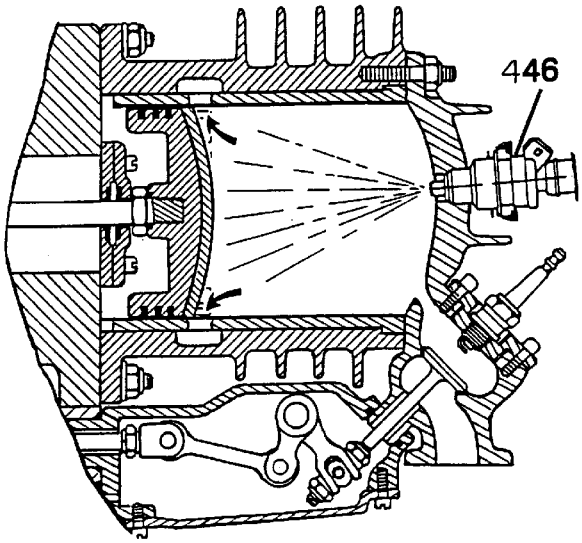
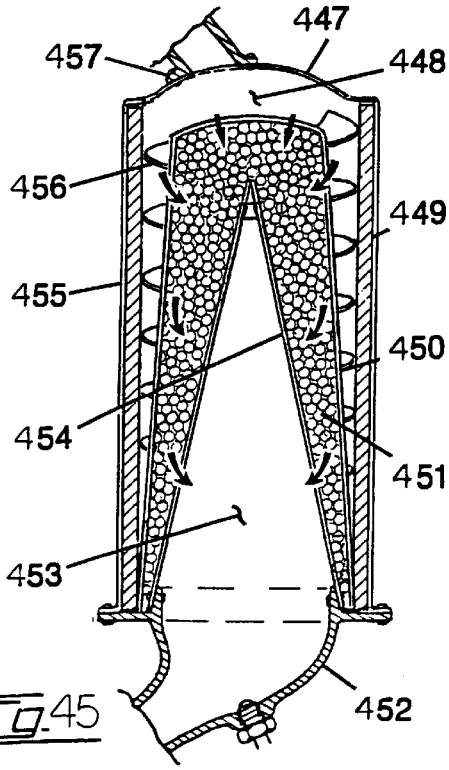
FIG. 45

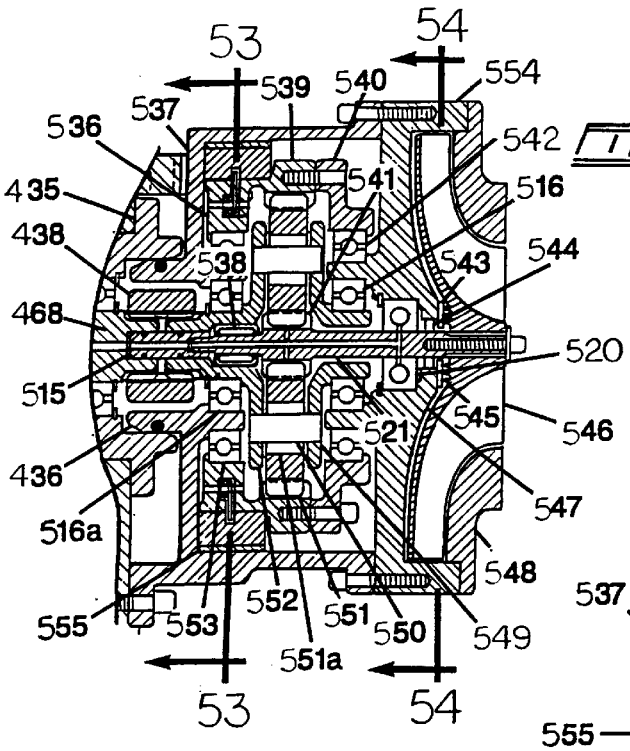
FIG. 52
FIG. 53
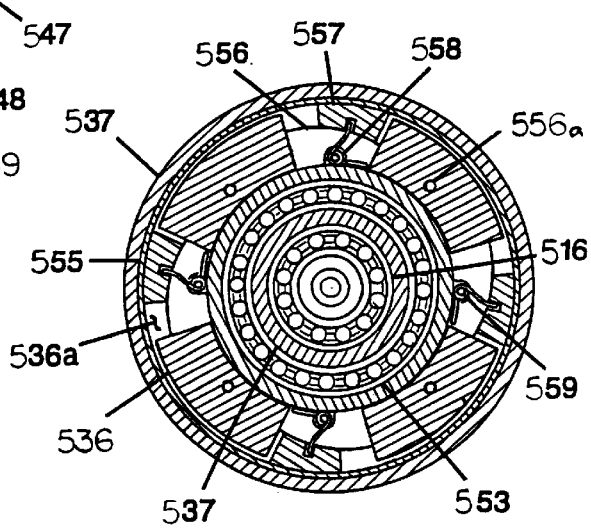
FIG. 54
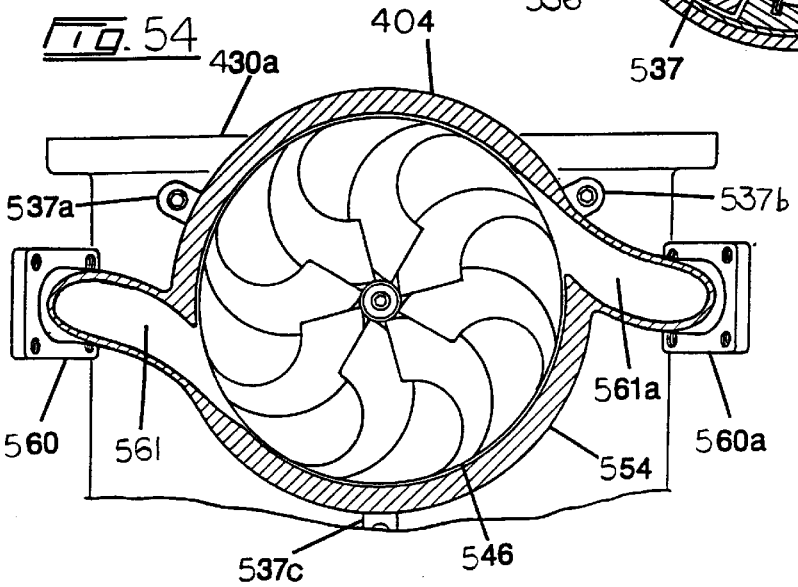

COMPOUND TWO STROKE ENGINE

FIELD OF THE INVENTION

This invention relates to a two stroke engine having a pair of horizontally opposed pistons and more particularly to a compound two stroke engine having a pair of combustors connected to the two stroke engine exhaust for driving a turbine.

BACKGROUND

In a two-cycle engine because each cylinder fires on every cycle instead of on every second cycle, a two-stroke engine should, in theory, be capable of developing twice the horsepower of a conventional four-stroke engine having the same volumetric displacement. In practice, this is not the case, the main reason being that, in any present two-stroke carbureted engines, there is no provision to completely separate the spent exhaust gases from the incoming, fuel-charged, intake air. This means that, to prevent unburnt gas from being lost with the exhaust gas, the valving must be arranged such that some spent exhaust gases remain in the cylinder. This results in a lower power output than would otherwise be expected.

Another major problem with conventional two-stroke engines is that, because the crank case is used as a pre-compression chamber, the lubricating oil must be mixed with the gasoline and is burnt along with the fuel. As well, in order to ensure that sufficient lubrication is available to coat the cylinder walls, an oil/fuel mixture is required wherein the ratio of oil to fuel is much higher than is normally consumed in a comparably-sized four-stroke engine. The result is the well-known smoky, dirty, high-emission, two-stroke engine.

In a multi-cylinder engine, one of the reasons that the crankshaft has to be relatively large is that the high thrust forces exerted on the crankshaft by the piston of the cylinder undergoing combustion must be transmitted as a torque through the crankshaft and thence to the adjacent piston, or pistons which are undergoing intake, compression or exhaust strokes, as the case may be. Any residual torque produced over and above that required by the adjacent cylinders is available as useable power. But because of the necessary requirement to continually transmit power to the adjacent cylinders from the one undergoing combustion, the crankshaft has to be made sufficiently large and durable to handle these large torque loads. Due to the constraints imposed by materials, the bearing surfaces supporting the crankshaft, as well as those journals used to connect the connecting rods to the crankshaft, have to be so large that sliding friction bearing surfaces rather than ball or roller bearings, are generally used at all journal bearing points.

In addition to the complexities caused by having to transmit torque loads to the adjacent cylinders as each cylinder fires in turn, the crankshaft also has to be configured so as to accommodate the selected firing order. Further, the crankshaft usually incorporates integral counterweights for dynamic balancing of the pistons. On top of all this, the crankshaft—at least in 4-stroke engines—usually also incorporates lubrication channels which deliver oil to all of the bearing journals as well as to the lower cylinder walls. In meeting all of the required crankshaft durability and functional requirements, this results in an engine component that requires complicated manufacturing processes and expensive toolage with a high resulting cost of manufacture.

Another inherent deficiency in any crankshaft-based method for converting the reciprocating motion of the pistons into rotary motion of the crankshaft, is that a significant portion of the combustion gas forces acting on the head of the piston end up as high side forces acting between the piston and cylinder walls. This is due to the fact that the connecting rod is at an angle relative to the piston line of travel during the time that the greatest combustion forces are applied to the piston. These high side forces acting principally during combustion, but also during the other strokes, do no useful work and end up as frictional heat - which adds to the problem of cooling. These high side forces can be reduced, to some extent, by making the connecting rod longer, reducing the maximum angle of deflection; however, this approach causes other problems, thus the connecting rod is usually made as short as possible in most automotive engines due to size limitations.

In automotive engines where overall size is a major restriction and wherein the connecting rods are therefore made as short as possible, special provisions must be made in the piston design to accommodate these high side forces. To deal with the problem of high piston-to-cylinder side forces pistons are usually fabricated with an integral skirt at the bottom which serves to provide an extended piston bearing surface against the cylinder. Furthermore, the lower portion of the piston, including the skirt, is usually made slightly elliptical to accommodate wear. But both of these provisions add to the complexity of the piston over what would be required if straight back-and-forth motion, only, was required. Another problem that must be dealt with in crankshaft-based internal combustion engine design is that of piston 'slap'. Piston 'slap', as it is sometimes called, is that additional side force acting on the piston due to the fact that the lower, or crankshaft, portion of the connecting rod is moving in a circular path while the piston end is moving in a straight back-and-forth path. This means that the center of mass of the connecting rod transcribes an elliptical orbit and induces an additional side force on the piston proportional to the engine RPM. These forces also tend to cause a severe bending moment in the connecting rods and, as a result, designers go to great lengths to make the connecting rods as light and as strong as possible. But these necessary provisions also add cost to the overall engine.

Additionally, in a crankshaft-based engine, some provision must be made to deliver lubricant to the piston wrist pin or it would quickly overheat and seize up. In most four-stroke automotive engines, provision is made to direct oil from the crankshaft, through the connecting rod, and thence to the piston wrist pin. But this, too, adds complexity and cost to the conventional automotive engine.

In conventional two-stroke engines, the partially-compressed fuel and oil charged air flows into the cylinder at the same time, or very closely following, the discharge of the spent exhaust gases. Unlike the situation in a four-stroke engine, which has very well defined intake, compression, power and exhaust strokes, a two-stroke engine attempts to achieve all of this in just two strokes. This results in some inevitable mixing of the fuel and oil charged intake gases with the spent exhaust gases. If the valve ports are designed such that the exhaust port is uncovered by the piston on the downstroke well in advance of the intake port being uncovered, then most of the spent exhaust gases will be discharged before the fuel and oil charged air enters the cylinder. But on the subsequent piston up stroke, the exhaust port will remain uncovered too long and some unspent fuel and oil charged air will be lost to exhaust. The converse is that the exhaust valve may be designed to open at the same time as, or slightly after, the exhaust port is uncovered, in which case too much spent exhaust gas will remain in the cylinder and will result in less than optimum power output.

Compression ignition or diesel cycle engines, because of the much higher compression levels required in order to effect combustion, necessarily have to utilize much stronger and heavier pistons, connecting rods, crankshaft and cylinders than are required in comparable spark ignition engines having a similar power output. As well, because of the higher levels of heat generated in a compression ignition engine, a larger and more sophisticated cooling system must be used. The result is that the typical diesel engine is invariably significantly heavier and more costly than a comparably sized spark ignition engine.

White in U.S. Pat. No. 4,608,951 and Kurek et al in U.S. Pat. No. 4,803,964 both employ means for conversion of reciprocating to rotary motion without the use of a crankshaft; however, both of these patents employ a pinion gear which tracks along an elongated ring gear and does not completely remove piston 'slap' and, as well, would not be suitably durable. In addition, the design is not easily adapted to use in a two-cylinder, horizontally- opposed configuration and thus is not really suitable. Rucker in U.S. Pat. No. 5,233,949, Koderman in U.S. Pat. No. 3,886,805 and Wickman in U.S. Pat. No. 3,693,464 all describe a type of epicyclic gear crank method for direct conversion of reciprocating to rotary motion. The above noted Patents however involve complex arrangements of bearings and gears which are time consuming and complex to assemble.

Many current larger-size agricultural and industrial diesel engines utilise a turbine to recover power from the exhaust gases that would otherwise be lost. In some instances the power recovery turbine is directly connected to a rotary compressor which acts as a supercharger to provide a boost in compression level in the diesel engine itself.

In some respects, a diesel engine which utilises a power recovery turbine to direct-drive a rotary compressor or supercharger is somewhat like a gas turbine engine wherein the combustor or combustion chamber is replaced by the diesel engine to generate heat. However, in such a diesel engine, all of the output power is derived from the diesel portion of the engine, with the power recovery turbine providing supplementary power to drive the supercharger only.

SUMMARY

According to a first aspect of the present invention there is provided a two stroke engine comprising;

an external housing having a pair of opposed cylinder bores extending along a common axis therein, each bore having a scavenge valve mounted at an outer end and an exhaust valve mounted towards an inner end;

a pair of piston heads mounted within respective bores defining an inner chamber adjacent an inner face and a main combustion chamber adjacent an outer face of each piston head, each piston head being movable between a top dead centre position adjacent the outer end and a bottom dead centre position adjacent the inner end of the corresponding bore;

a pair of connecting rods extending along the common axis mounted on the respective inner faces of the piston heads at respective first ends of the connecting rods;

a rotary housing rotatably mounted within the external housing and extending from an inner end positioned between the opposing bores along a drive axis perpendicular to the common axis to an outer end spaced from the common axis;

an output shaft mounted axially on the outer end of the rotatable housing;

a ring gear mounted within the external housing about the drive axis such that the rotatable housing extends therethrough;

a planetary gear rotatably mounted within the rotatable housing offset from the drive axis such that the planetary gear meshes with the ring gear; and a crank extending from the planetary gear opposite the output shaft and connecting to respective second ends of the connecting rods such that reciprocation of the piston heads within respective bores rotates the rotatable housing and the output shaft extending therefrom.

Preferably there is provided at least one port connected between the inner chambers of each bore for balancing pressure therebetween when the piston heads reciprocate within the respective bores.

A stuffing box about each connecting rod is preferably provided for sealing the inner chambers from a central chamber which houses the rotary housing such that lubricating oil from the crank and rotary housing cannot leak into the exhaust valve.

It is preferred that there be provided a pair of piston lubricating channels, each channel comprising a first portion extending from the second end of the corresponding connecting rod to the first end and a second portion extending from an inner end adjacent the connecting rod to an outer end adjacent a periphery of the piston head wherein the outer end of the second portion of the channel is spaced towards the inner end of the bore in relation to the inner end of the second portion of the channel.

Preferably there is provided at least one one-way valve within each lubricating channel such that lubricating oil is only permitted to flow from the second end of the connecting rod towards the first end.

Preferably there is provided a camshaft geared to the output shaft having a plurality of cams thereon including valve opening lobes arranged to open the scavenge valves during a portion of cam rotation when the respective piston head is positioned towards the inner end of the bore. A portion of the plurality of cams may include valve closing lobes arranged to close the scavenge valves and secure the scavenge valves in a closed position during a portion of cam rotation.

A counterweight may be mounted about an auxiliary shaft, the auxiliary shaft being geared to the camshaft and arranged to rotate with the camshaft for counterbalancing the reciprocation of the piston heads.

Preferably the second ends of the connecting rods each comprise a claw member arranged to mate with the other claw member such that when the claws are mated an annular bearing is received therein for locking the second ends together while permitting limited pivotal motion therebetween, the annular bearing being arranged to receive an end of the crank therein.

A supercharger may be provided comprising; a secondary housing mounted on the external housing; an inlet permitting air to enter the secondary housing; an outlet connected to the scavenge valves; a pair of rotors rotating therein arranged to urge a measured quantity of air from the inlet to the outlet with each rotation of the rotors; and gearing means for driving rotation of the rotors, the gearing means being connected to the output shaft.

A lower inlet valve may be provided in communication with the inner chamber of each bore such that cooling air enters the inner chamber through the inlet valve when the corresponding piston head is displaced from the bottom dead centre position to the top dead centre position and the cooling air exits the inner chamber through the corresponding exhaust valve when the piston head is displaced from the top dead centre position to the bottom dead centre position.

There may be provided:

a pair of inlet valves positioned adjacent the respective scavenge valves at the outer end of the respective bores, the inlet and scavenge valves being arranged to be open when the corresponding piston head is adjacent the inner end of the bore wherein the scavenge valve is arranged to be opened before the inlet valve;

a manifold connected to the inlet and scavenge valves for delivering a continuous flow of supercharged air to the valves; and fuel injection means for injecting a measured quantity of fuel into a portion of the manifold connected to the inlet valves.

The fuel injection means may comprise:

a sleeve extending across the portion of the manifold connected to the inlet valves, the sleeve having a plurality of apertures therein;

a fuel supply line connected to an end of the sleeve;

a rotary spool mounted within the sleeve and arranged such that rotation of the spool between a closed position and an open position will uncover the apertures successively for releasing a measured quantity of fuel into the portion of the manifold connected to the inlet valves.

There may be provided a pre-combustion chamber adjacent the outer end of each bore connected to the combustion chamber wherein the inlet and scavenge valves are connected to the pre-combustion chamber.

There may be provided a fuel injector mounted on the outer end of each bore for delivering a measured quantity of fuel to the main combustion chamber.

There may also be provided:

a pair of fuel pump housings for delivering fuel to the respective fuel injectors;

a pumping piston arranged to reciprocate within each fuel pump housing for pumping the fuel;

a camshaft geared to rotate with the output shaft;

a pair of first cams mounted on the camshaft having extending lobes thereon arranged to extend the pistons in a first direction; and a pair of second cams mounted on the camshaft having retracting lobes arranged to retract the pumping pistons in a second direction opposite the first direction;

wherein rotation of the camshaft will reciprocate the pumping pistons.

There may be provided:

a camshaft geared to the output shaft for rotation with the output shaft;

a plurality of cams mounted on the camshaft for opening and closing the scavenge valves;

a pair of actuating arms, each connected between one of the scavenge valves and the plurality of cams;

a hydraulic valve lifting piston mounted on a cam end of each actuating arm;

a hydraulic valve lifting sleeve mounted on each hydraulic valve lifting piston having an end arranged to engage one of the cams defining a fluid chamber between the end of the sleeve and the hydraulic valve lifting piston wherein pressurised hydraulic fluid ports are arranged to communicate with the fluid chamber.

There may be provided:

a pair of secondary combustion chambers arranged to further combust exhaust from the main combustion chambers, each secondary combustion chamber being connected at a first end to the exhaust valve of a corresponding one of the bores; and a turbine connected at a second end of the combustion chambers being arranged such that combustion of the exhaust from the main combustion chambers within the secondary combustion chambers drives rotation of the turbine; the turbine being mounted within a turbine housing for rotation about a turbine shaft extending along the drive axis.

When using a turbine there may be provided a clutch connected between the turbine shaft and the output shaft, the clutch comprising:

a clutch housing having a ring gear therein, the clutch housing being mounted within the turbine housing for rotation about the drive axis;

a spur gear mounted on the turbine shaft for rotation therewith;

a planetary gear carrier mounted on the output shaft for rotation therewith;

a plurality of planetary gears mounted on the planetary gear carrier offset from the drive axis such that the planetary gears mesh with the ring gear and the spur gear;

a plurality of caming faces located about a periphery of the clutch housing;

a plurality clutch shoes slidably mounted on the respective caming faces such that the clutch shoes are slidable between an engaged position wherein the clutch shoes engage the external housing and the clutch housing cannot rotate in relation to the external housing and a disengaged position wherein the clutch shoes are released from the external housing and the clutch housing is free to rotate in relation to the external housing.

When using the turbine there is preferably provided a lower inlet valve in communication with the inner chamber of each bore such that cooling air enters the inner chamber through the inlet valve when the corresponding piston head is displaced from the bottom dead centre position to the top dead centre position and the cooling air exits the inner chamber through the corresponding exhaust valve when the piston head is displaced from the top dead centre position to the bottom dead centre position.

Fuel injection means may be connected to the secondary combustion chambers such that fuel is added to the cooling air for combustion of the cooling air in the secondary combustion chambers.

For coupling several units together there may be provided:

a coupling gear mounted on the output shaft being arranged to mesh with the coupling gear of an additional two stroke engine;

a bearing rotatably mounting the coupling gear on the output shaft such that the coupling gear is free to rotate in relation to the output shaft;

a locking member slidably mounted on the output shaft such that the locking member is slidable between an engaged position wherein the locking member engages the coupling gear and the coupling gear cannot rotate in relation to the output shaft and a disengaged position wherein the locking member disengages the coupling gear and the coupling gear is free to rotate in relation to the output shaft.

An insulating liner may be mounted adjacent an inner face of each bore such that the piston head is mounted within the liner for insulating the cylinder to prevent excessive heat loss. Additionally there may be provided an insulating liner mounted on the outer face of each piston head, said liner comprising a circular plate adjacent the outer face of the piston head, a plurality of protrusions extending through respective bores in the piston head and a plurality of clips, each securing an end of one of the protrusions adjacent the inner face of the piston head.

The present invention describes an epicyclic gear crank interconnected with the pistons of two horizontally-opposed cylinders in a two-stroke configuration. In this arrangement, the pistons simply move back and forth in unison, and are tied together by two straight-through connecting rods, wherein the connecting rods do not deflect from a straight line at any time. With this piston, connecting rod, and epicyclic gear crank arrangement the problem of piston-to-cylinder sidewall thrust forces due to crank angle is eliminated, as is the problem of piston 'slap' at high RPM.

According to a further aspect of the present invention there is provided a compound engine comprising;

an external housing having a pair of opposed bores therein, each bore having a scavenge valve at an outer end and an exhaust valve towards an inner end;

a pair of piston heads mounted within the respective bores each defining an inner chamber adjacent an inner face and a main combustion chamber adjacent an outer face of each piston head, each piston head being movable between a top dead centre position adjacent the outer end and a bottom dead centre position adjacent the inner end of the corresponding bore;

an output shaft mounted within the external housing for rotation about a drive axis;

rotary drive means connected between the output shaft and the pair of piston heads for translating the linear motion of the piston heads to rotary motion of the output shaft;

a pair of secondary combustion chambers connected at a first end to the respective exhaust valve of a corresponding one of the bores, the second combustion chambers being arranged to further combust exhaust from the main combustion chambers;

a turbine connected at a second end of the combustion chambers such that combustion of the exhaust from the main combustion chambers within the secondary combustion chambers drives rotation of the turbine; and a gearing mechanism connected between the turbine and the output shaft such that the turbine drives the output shaft.

The gearing mechanism may comprise:

a clutch housing having a ring gear therein, the clutch housing being mounted within the external housing for rotation about the drive axis;

a spur gear mounted on a turbine shaft extending from the turbine being arranged to rotate with the turbine;

a plurality of planetary gears mounted on the output shaft for rotation about the spur gear with the output shaft;

a plurality of caming faces located about a periphery of the clutch housing;

a plurality clutch shoes slidably mounted on the respective caming faces such that the clutch shoes are slidable between an engaged position wherein the clutch shoes engage the external housing and the clutch housing cannot rotate in relation to the external housing and a disengaged position wherein the clutch shoes are released from the external housing and the clutch housing is free to rotate in relation to the external housing.

There may be provided:

a coupling gear mounted on the output shaft being arranged to mesh with the coupling gear of a second two stroke engine;

a bearing rotatably mounting the coupling gear on the output shaft such that the coupling gear is free to rotate in relation to the output shaft;

a locking member slidably mounted on the output shaft such that the locking member is slidable between an engaged position wherein the locking member engages the coupling gear and the coupling gear cannot rotate in relation to the output shaft and a disengaged position wherein the locking member disengages the coupling gear and the coupling gear is free to rotate in relation to the output shaft.

There may be provided a lower inlet valve in communication with the inner chamber of each bore such that cooling air enters the inner chamber through the inlet valve when the corresponding piston head is displaced from the bottom dead centre position to the top dead centre position and the cooling air exits the inner chamber through the corresponding exhaust valve when the piston head is displaced from the top dead centre position to the bottom dead centre position.

There may be provided fuel injection means connected to the secondary combustion chambers such that fuel is added to the cooling air for combustion of the cooling air in the secondary combustion chambers.

There may be provided:

a manifold connected to the lower inlet valves; and a fuel injector connected to the manifold such that fuel is injected into the cooling air before the cooling air enters the secondary combustion chambers.

A fuel injector may be mounted on an outer end of each bore, the fuel injectors being arranged to inject fuel into the bores when the piston head is in the bottom dead centre position such that non combusted fuel is passed through the exhaust valves into the secondary combustion chambers. Alternatively, a fuel injector may be mounted on the first end of each secondary combustion chambers for injecting fuel directly into the secondary combustion chambers.

There may be provided:

a pair of spaced apart perforated members within each secondary combustion chamber, the perforated members being oriented such that air passing through the combustion chamber must pass through each perforated member; and a plurality of catalyst coated steel balls constrained between the perforated members such that the steel balls act as a catalyst for combusting a mixture of fuel and air passing through the secondary combustion chamber.

A plurality of deflectors may be mounted within the secondary combustion chambers for evenly directing a flow of exhaust through the chamber.

There may be provided:

a resilient member connected to each exhaust valve for urging the exhaust valve into a closed position; and an adjustable member mounting the resilient member on the external housing at a variety of spacings therebetween such that a force imposed by the resilient member on the exhaust valve is adjustable.

The adjustable member preferably comprises:

a seat arranged to support the resilient member thereon;

a linkage supporting the seat on the external housing; and a bellows connected to the linkage and the secondary combustion chamber such that a change in pressure in the secondary combustion chamber will change the volume of the bellows and displace the linkage as well as the seat supported thereon.

The present invention is based on the fact that the epicyclic gear crank engine described in the first embodiment exhibits certain characteristics which uniquely lends itself to be compounded with certain functional elements of a typical gas turbine engine. In particular, this engine typically utilizes less than half of the air flowing through the engine for purposes of combustion, the remainder being used to scavenge the exhaust gases from the cylinder and for internal cooling. Provision can further be made to the engine to provide additional lower-cylinder internal cooling, as well as to inhibit heat loss through the cylinder walls and cylinder head so as to capture this otherwise lost heat and convert it into usable power.

BRIEF DESCRIPTION OF THE DRAWINGS

In the accompanying drawings, which illustrate exemplary embodiments of the present invention:

FIG. 10 is an exploded isometric view of the left and right hand connecting rod interconnection details.

FIG. 11 is a partial cross-sectional view showing one of the pistons, with the corresponding connecting rod and crank interconnecting details.

FIG. 12 is a cross-sectional view taken substantially through the cutting plane designated as 12—12 in FIG. 4 and illustrates the scavenge and fuel/air intake valve details.

FIG. 13 is an exploded isometric view of one of the two similar valve cam and cam follower mechanisms for the scavenge and fuel/air intake valves.

FIG. 14 is an enlarged cross-sectional view of one of the two similar valve actuating mechanisms for the scavenge and fuel/air intake valves.

FIG. 26 is a cross-sectional view of the second embodiment of the engine taken along the cutting plane designated as 26—26 in FIG. 24.

FIG. 27 is a partial cross-sectional view of the second embodiment of the engine taken substantially along the cutting plane designated 27—27 in FIG. 24.

FIG. 32 is a cross-sectional view taken substantially through the cutting plane designated as 32—32 in FIG. 31, and illustrates the fuel pump rack and pinion control linkage.

FIG. 33 is a cross-sectional view taken substantially through the cutting plane designated as 33—33 in FIG. 29, and illustrates the lube oil flow channels that supply oil to the hydraulic valve lifters.

FIG. 34 is an enlarged cross-sectional view taken substantially along cutting plane designated as 34—34 in FIG. 35, and illustrates the internal working details of the right-hand fuel injector pump.

FIG. 35 is a cross-sectional view taken substantially along cutting plane designated as 35—35 in FIG. 31, and illustrates the details of the fuel injector pumps, cam operating mechanism, and control rack and pinion mechanisms.

FIG. 43 is a partial cross-sectional view of the lower cylinder air intake portion of the third embodiment of the engine when equipped with a continuous type fuel injection system for the power boost combustors.

FIG. 44 is a partial cross sectional view of the placement of the fuel injector in the cylinder head of the third embodiment of the engine if electronic fuel injectors are used to supply fuel to the combustors by injecting fuel into the scavenge air flow as it sweeps the spent exhaust gases out of the cylinder.

FIG. 45 is a cross sectional view of an alternate combustor design for use when either of the two methods of fuel injection shown in FIG. 43 or 44 are used.

FIG. 52 is an enlarged partial cross sectional view of the power recovery turbine of the third embodiment.

FIG. 53 is a cross sectional view along the line 53—53 of FIG. 52 illustrating the overrunning clutch mechanism connecting the turbine to the output shaft in the third embodiment.

FIG. 54 is a cross sectional view along the line 54—54 of FIG. 52 illustrating the power recovery turbine inlets in the engine of the third embodiment.

DETAILED DESCRIPTION

Figure 1:
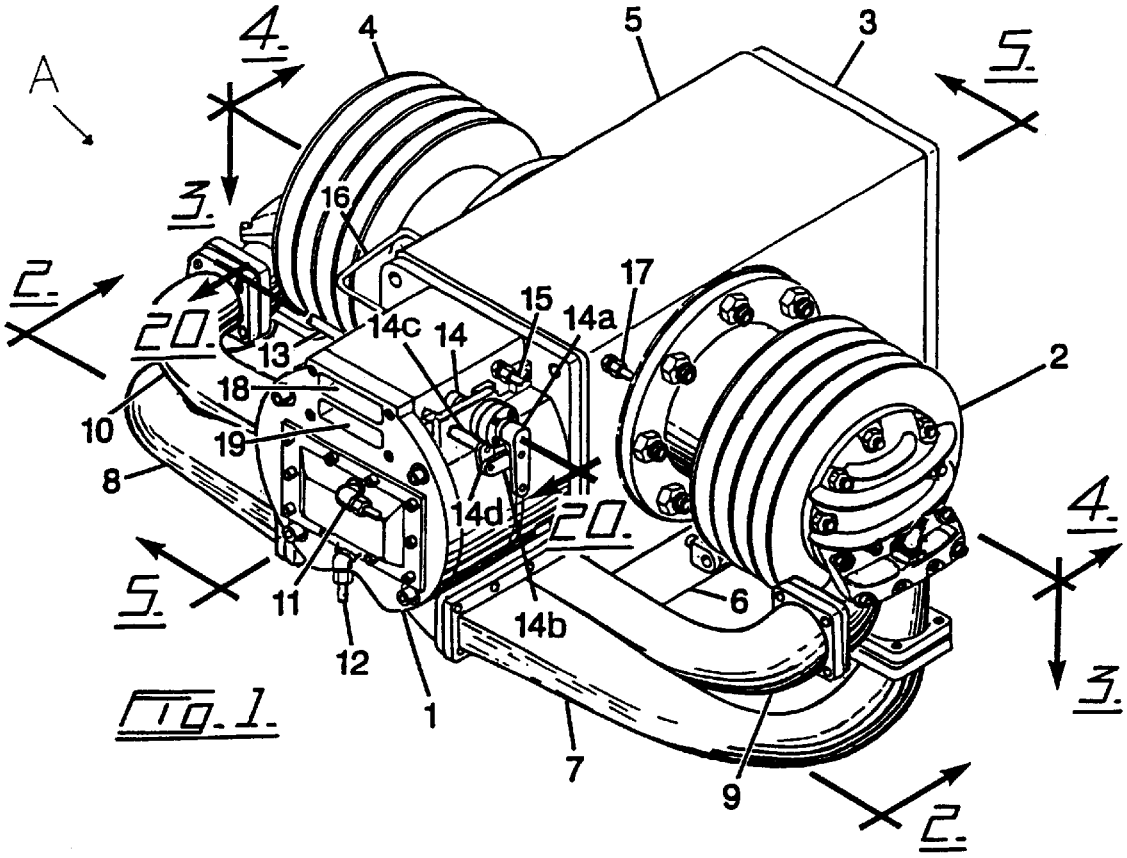
FIG. 1 is an isometric view of a spark ignition variant of the engine showing the top, front and one side of the engine.

Referring to FIGS. 1 through 23 there is illustrated a spark ignition epicyclic gear crank engine generally indicated by reference character 'A'. Referring specifically to FIG. 1 the overall configuration of the epicyclic gear crank engine includes a main housing assembly 5; an epicyclic gear crank assembly 3, which fits into and is bolted to the rear of the main housing assembly; horizontally-opposed left and right cylinder assemblies 4 and 2, which bolt to either side of the main housing assembly; a dual-element supercharger assembly 1, which bolts to the front of the main housing assembly; and a camshaft housing assembly 6, which bolts to the bottom of the main housing assembly.

Figure 2:
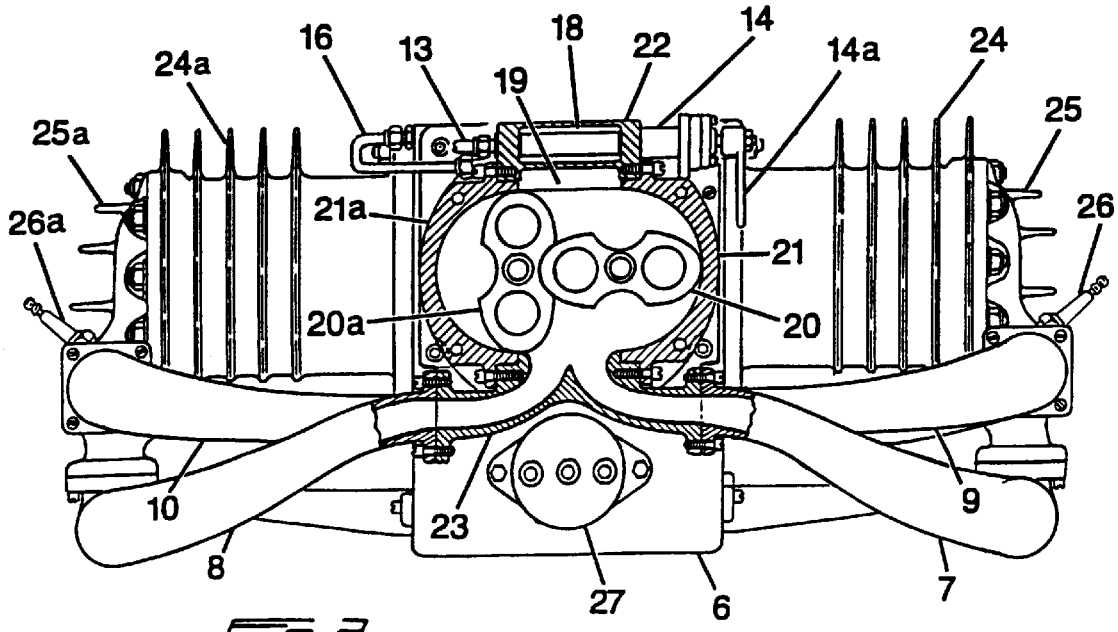
FIG. 2 is a partial cross-sectional view of the supercharger taken along the cutting plane designated as 2—2 in FIG. 1.

The dual element supercharger assembly as shown in FIG. 2 delivers two completely separate air flows. The first or scavenge air flow consists of compressed air only and is split into two flows by splitter 23 to be delivered to the left and right cylinders by respective left and right scavenge air intake manifolds 7 and 8. The second air flow consists of fuel charged air and is similarly split and delivered to the left and right cylinders by respective left and right fuel/air intake manifolds 9 and 10. In FIG. 2, the cutting plane is taken through the scavenge element of the supercharger, which comprises left and right rotors 20 and 20*a*, left and right side plates 21 and 21*a*, splitter 23 and air inlet housing 22. The air inlet to the scavenge supercharger element is via air inlet passage 19 in the air inlet housing 22. Air inlet housing 22 also incorporates a completely separate air inlet passage 18 which leads to the fuel/air element of the supercharger.

Figure 20:
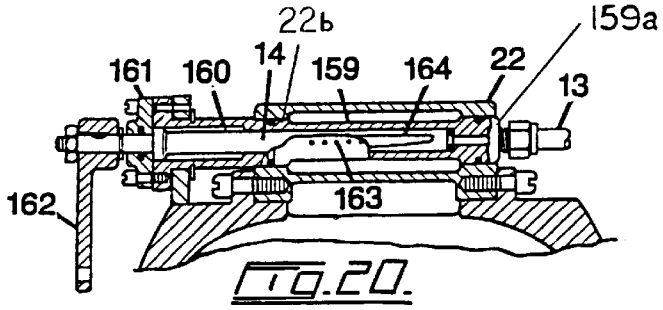
FIG. 20 is an enlarged cross-sectional view of the fuel injector mechanism taken substantially along the cutting plane designated as 20—20 in FIG. 1.
Figure 22:
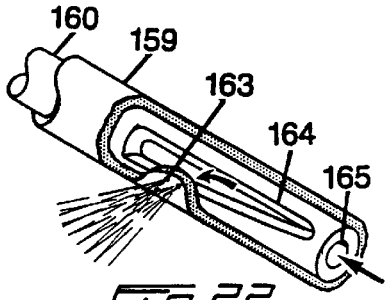
FIG. 22 is an isometric cutaway of the fuel metering details of the fuel injector mechanism shown in FIG. 20.
Figure 23:
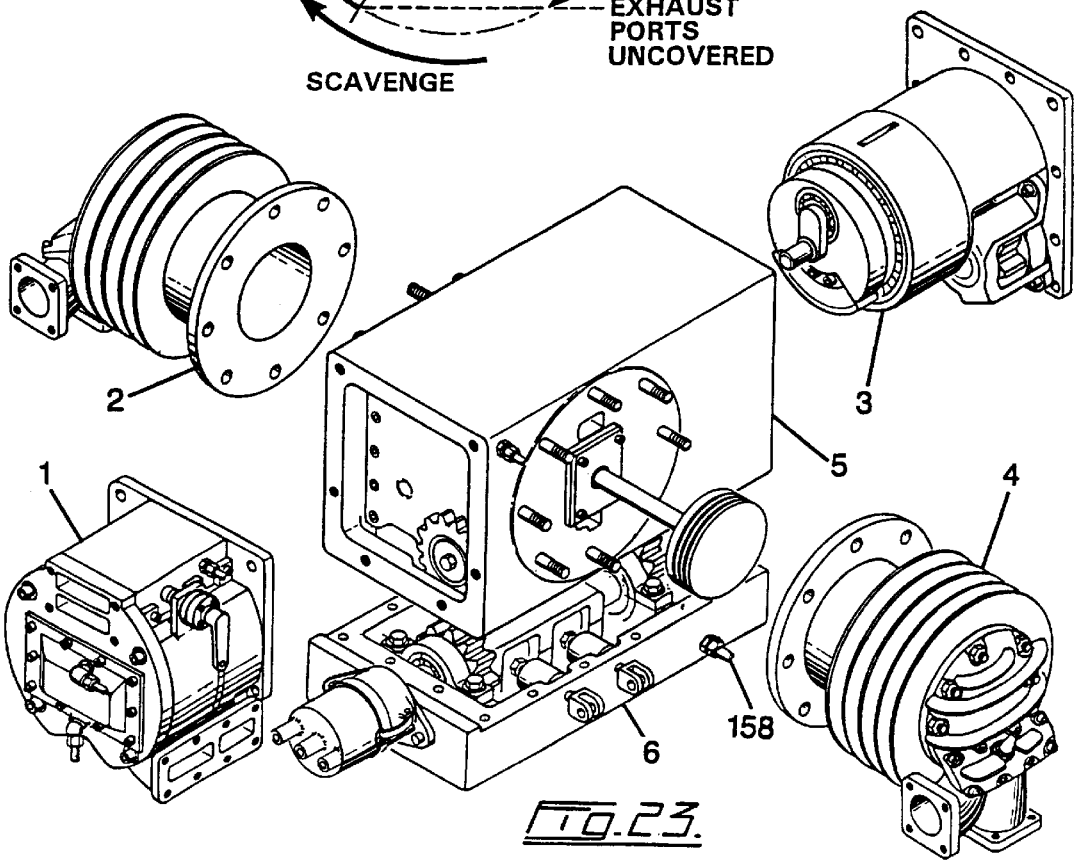
FIG. 23 is an isometric exploded view of the engine and illustrating its major constituent assemblies.

The supercharger air inlet housing 22 incorporates fuel injector assembly 14, the control shaft of which is connectably linked to butterfly valve control shaft 14*c* of FIG. 1 by means of lever 14*d* and connecting link 14*b*. The working details of the fuel injector assembly 14 are illustrated in FIG. 20. The fuel injector assembly is positionally constrained in a drilling 22*b* which spans both walls of air inlet housing 22 by means of end cap 161. Fuel injector assembly 14 consists substantially of sleeve 159, a rotary spool 160, an end cap 161 and a control arm 162. The right end 159*a* of sleeve 159 incorporates a threaded fitting to which fuel supply line 13 is connected. As can be seen in FIG. 22, rotary spool 160 incorporates a drilling 165 and a tapered cutout 164, which allows fuel to flow through the drilling into the cutout portion as shown. Sleeve 159 incorporates a precision-cut bore in which the rotary spool 160 is housed. Sleeve 159 also incorporates a row of spray orifices 163 which are oriented so as to direct the fuel spray parallel to the direction of air flow past the fuel injector assembly. Rotary spool 160 is a close-tolerance fit in the bore of sleeve 159 with the result that, as the spray orifices are progressively covered or uncovered by the rotation of the sleeve, a greater or lesser quantity of fuel is injected into the air flow entering the supercharger.

In an alternative arrangement an external continuous-type fuel injection system may be used. In this alternate design, though, provision would have to be made to keep the scavenge and fuel/air flows completely separate from the air cleaner to the engine inlet. This does not compromise the basic functionality of the engine.

Figure 3:
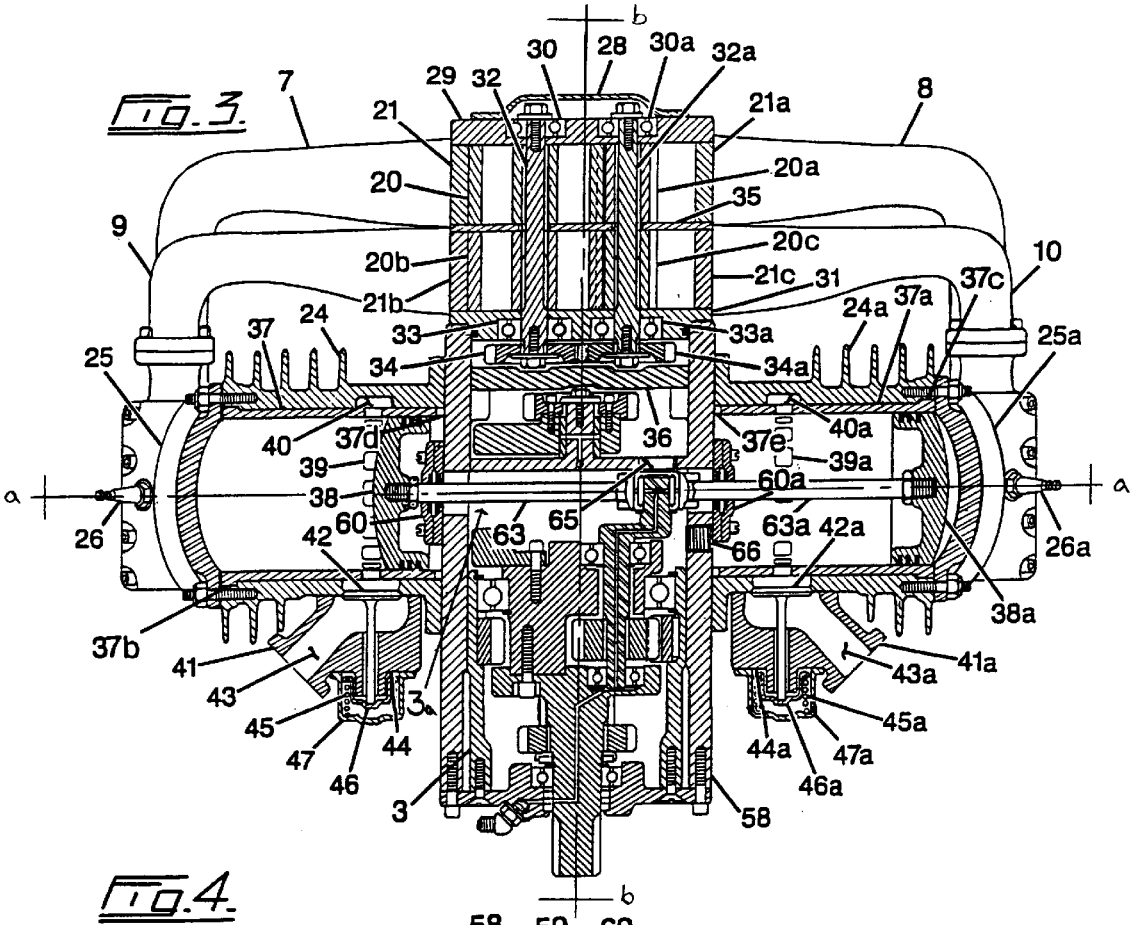
FIG. 3 is a cross-sectional view through the piston-to-piston center line, taken along the cutting plane designated as 3—3 in FIG. 1.

The components which primarily determine the gas flow path through the engine include the scavenge and fuel/air elements of the supercharger assembly 1, the left and right scavenge and fuel/air inlet valves, the left and right cylinder assemblies 2 and 4, and left and right exhaust valve assemblies 41 and 41*a* of FIG. 3. As shown in FIG. 3 the primary components comprising the scavenge element of supercharger assembly 1 are left and right rotors 20 and 20*a* and left and right side plates 21 and 21*a*. The primary components comprising the fuel/air supercharger element are left and right rotors 20*b* and 20*c* and left and right side plates 21*b* and 21*c*. The scavenge and fuel/air supercharger elements are divided by divider plate 35 and enclosed by front plate 29 and rear plate 31, the whole being bolted together. The two left rotors 20 and 20*b* are spline-connected and driven by left rotor drive shaft 32, which is bearing mounted by front bearing 30 and rear bearing 33 and driven by drive gear 34. Similarly, the two right rotors 20*a* and 20*c* are spline connected and driven by right rotor drive shaft 32*a*, which is bearing mounted by front bearing 30*a* and rear bearing 33*a* and driven by drive gear 34*a*. The front bearings are enclosed by oil sump cover 28 and are positively supplied with lubricating oil via fitting 28*a* of FIG. 5. Excess oil is returned to an external reservoir via fitting 28*b*. Lubricating oil for the rear bearings is supplied by means of oil supply line 15, FIG. 1 and internal drillings 73 of FIG. 5.

Referring next to FIG. 3, left and right hand horizontally opposed cylinder assemblies 2 and 4 consist essentially of cylinders 24 and 24*a*, which are bolted on opposing sides of the main housing assembly 5. Each cylinder 24 and 24*a* includes a cylindrical bore extending therethrough along a common axis indicated by line a—a of FIG. 3. Left and right hand cylinder heads 25 and 25*a*, are mounted on outer ends of the respective cylinders. Left and right cylinder liners 37 and 37*a* are mounted on an inner face of each bore extending through the cylinders. Cylinder liners 37 and 37*a* contain stepped collars 37*b* and 37*c* which are received in respective annular grooves in the inner faces of the bores for constraining the liners within the respective cylinders. A metal O-ring seal 37*d* and 37*e* at an inner end of each cylinder liner serves to seal the cylinder at the inner end to prevent any gas leakage via the bottom of the cylinder to exhaust. Pistons 38 and 38*a* slide back and forth within the respective cylinder liners between a bottom dead centre position adjacent an inner end of the respective bore as shown by piston 38 and a top dead centre position adjacent an outer end of the respective bore as shown by piston 38*a* both of FIG. 3.

Figure 6:
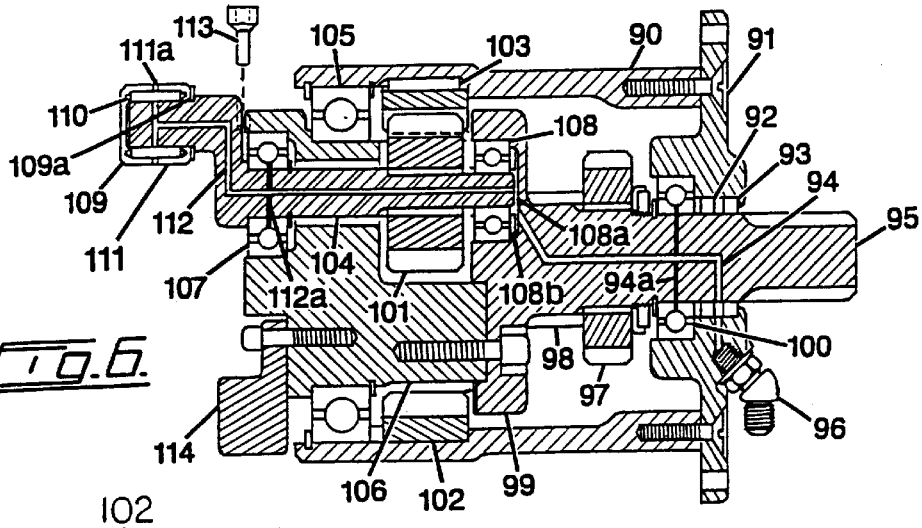
FIG. 6 is an enlarged cross-sectional view of the epicyclic gear crank assembly shown in FIG. 5.

Connecting rods 63 and 63*a* extend along the common axis a—a for interconnecting the respective pistons 38 and 38*a* to an input crank 104 of an epicyclic gear crank shown in FIG. 6. The connecting rods connect to the respective inner faces of the pistons at a first end and connect to the input crank at a second end. The extent of the reciprocal motion of the pistons is thus governed by the throw of the epicyclic gear crank assembly 3.

The cylinder liners 37 and 37*a* incorporate exhaust ports 39 and 39*a*, which span the full circumference of the liners near the inner ends of the bores and which are positioned such that they are completely uncovered when the piston is at the bottom dead centre of the stroke. Exhaust channels 40 and 40*a* similarly span the complete circumference of the inner walls cylinders 24 and 24*a* and serve to direct the exhaust gases flowing out through the exhaust ports 39, 39*a* and thence through exhaust channels 43, 43*a* in respective exhaust valve assemblies 41 and 41*b*.

Each piston head 38 and 38*a* defines a respective combustion chamber 51 and 51*a* adjacent an outer face and an inner chamber adjacent an inner face. The combustion chambers and inner chambers are further defined by the inner face of the bores extending through the respective cylinders.

Left hand exhaust valve assembly 41, FIG. 3 is bolted to the cylinder assembly and consists of valve housing 44, poppet valve 42, spring housing 47, compression spring 45 and spring keeper 46. Right hand exhaust valve assembly 41*a* is similar in all respects to left hand exhaust assembly 41. Left and righthand exhaust valve assemblies 41 and 41 a are simple spring-loaded poppet valves which are forced open by the exhaust gases when the piston nears bottom dead center and uncovers exhaust ports 38 or 38*a*, respectively. Once opened by the exhaust gases, the valve is kept open by the pressure of the scavenge gases while the cylinder is swept clear of exhaust gases by the incoming scavenge air.

The epicyclic gear crank assembly 3, FIG. 3, and other components inside a central chamber 3*a* of the main housing operate in a splash-type lubricating oil environment; however, because the lower portion of the cylinder is connected to exhaust, some means must be provided to seal the main housing from the inner or lower cylinder chamber. This sealing is achieved by means of the stuffing boxes 60, 60*a*, FIG. 3, which, for the left cylinder, comprises inner and outer seal housings 61 and 61*a*, FIG. 4, between which are sandwiched two metallic split seal rings 62 and 62*a* and expander 62*b*. The stuffing box for the right cylinder similarly comprises inner and outer seal housings 61*b*, 61*c*, seal rings 62*c*, 62*d*, and expander 62*e*. Because the pistons and connecting rods move in a straight line, back and forth motion without the usual crank action, the connecting rods 63 and 63*a* can be made much lighter than a conventional engine and can also be made in a uniform circular cross-section, thus making oil sealing quite simple; nonetheless, the stuffing box seals are made to allow a certain amount of piston rod misalignment without causing oil leakage.

Because there will inevitably be some misalignment of the pistons from the exact piston-to-piston centreline due to thermal expansion and manufacturing tolerances, some means is required to tie the two connecting rods 63 and 63*a* together in such a way as to accommodate any such misalignment and yet connect the connecting rods to the input crank 110 of the epicyclic gear crank without impairing its straight line back-and-forth motion. This requirement is met by means of the specially designed spherical connector mechanism 64, FIG. 4. This mechanism is shown in detail in FIG. 10, and consists essentially of upper claw half 64*a*, lower claw half 64*b*, and spherical bearing 118. The identical upper and lower claw halves 64*a* and 64*b* are integral with the respective left and right connecting rods 63,63*a*.

The upper claw half 64*a* comprises heal portion 115 and two claws 116 and 116*a*. The lower claw half 64*b* is similar to the upper claw half and is designed so that its heel portion 119 fits between the two claws 116 and 116*a* of the upper claw half while the heel portion of the upper claw half 115 fits between the two claws 121 and 121*a* of the lower claw half. The inner surfaces of the respective heel and claw portions is spherical and mates with the external spherical surface of spherical bearing 118. Circular, non-spherical notches 117 and 120 are cut into the two claw halves and serve to permit the spherical bearing 118 to be inserted into the assembled, mating, claw halves. During assembly, the spherical bearing is inserted at 90 degrees to its normal working position, and once fully inserted, it is turned 90 degrees to effectively lock the two claw halves together. Once assembled, pin 64*c* is inserted through drilling 64*d* in the upper claw half partially into mating hole 64*e* in the spherical bearing 118. This pin serves to prevent the spherical bearing from rotating within the claw halves during operation, thereby ensuring that the oil delivery drillings 122*a* and 122*b* remain properly aligned with the respective connecting rods.

Figure 4:
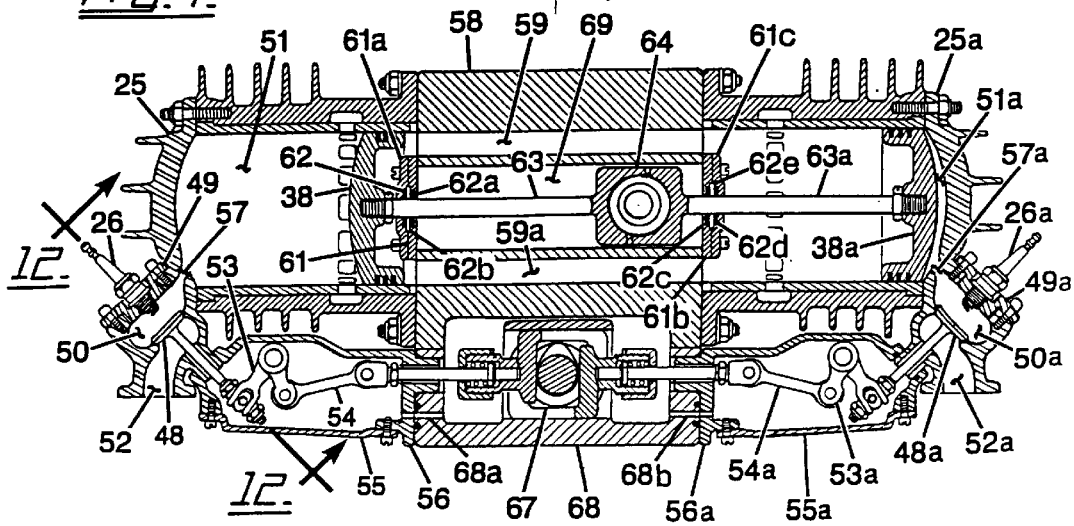
FIG. 4 is a cross-sectional view of the engine through the piston-to-piston centreline, taken along the cutting plane designated as 4—4 in FIG. 1.

Provisions designed into the spherical connector mechanism 64, FIG. 4, in conjunction with provisions in the connecting rods and pistons, serve to direct lubricating oil to the piston rings. In the spherical connector mechanism, these provisions consist of lube oil channel 122, FIG. 10 and drillings 122*a* and 122*b*. Input crank 104, FIG. 11 of the epicyclic gear crank assembly 3 is rotatably constrained in spherical bearing 118 by means of needle roller bearing assembly 109, the outer circumference of which is a press fit in spherical bearing 118. Lube oil is fed to the needle roller bearing assembly via drilling 112 in the input crank arm 104 of the epicyclic gear crank assembly to lubricate needle rollers 110. The housing 111 of needle roller bearing asembly 109 is capped at one end and is sealed at the other end by means of seal 109*a*. Drillings 111*a* around the circumference of the needle bearing housing permits lube oil to pass out of the needle roller bearing assembly via drillings 111*a*, channel 122, and drillings 122*a* and 122*b* to miniature one-way valves 123 and 123*a* at the bottom end of the connecting rods 63 and 63*a*.

Referring to FIG. 11, since both left and right hand pistons are identical, only the right hand piston, connecting rod and lube oil path will be described in detail. A drilling 124 in connecting rod 63*a* connects the output of miniature one-way valve 123 mounted at an inner end with the input of a second one-way valve 123*a* mounted within an outer end of the connecting rod. Cutout channels 128 at the top of the connecting rod serve to permit the lubricating oil to pass into drillings 127 in piston 38*a*. Drillings 127 extend radially outward from the connecting rod such that the outer end of each drilling is spaced towards the gear crank assembly 3 in relation to the inner end of the drilling. Typically, three such drillings 127 would be used in each piston equally spaced to evenly distribute the lube oil around the piston. An orifice plug 126 in each drilling serves to restrict the lube oil flow to the annular groove which carries the upper piston ring 125.

During operation, the piston and connecting rod undergo high negative acceleration forces during the upper half of the cycle near the top dead center position. This causes lubricating oil to gradually migrate through the two one-way valves 123 and 123*a* towards the piston. But since the slope on lube oil channels 127 is negative, there is a tendency for any lube oil in channels 127 to flow back towards the upper one-way valve. However, one-way valve 123*a* blocks any such flow. On the bottom half of the cycle near the bottom dead center position, the piston is under high acceleration in the opposite direction, and these forces then tend to cause the lube oil to be forced out through the orifice plugs 126 to fill the piston ring channel. And since the piston ring is also under the same forces of acceleration as the piston, the lube oil is squeezed into the piston ring groove on the upper side. As the piston subsequently moves up the cylinder towards the top dead center position, a film of lubricating oil is deposited on the cylinder walls.

Turning next to FIG. 4, left and right scavenge valves 48 and 48*a* are connected to the outer ends of the respective cylinders 24 and 24*a*. The left and right scavenge valves 48 and 48*a* are opened and closed by means of left and right rocker arms 53 and 53*a*, left and right push/pull rods 54 and 54*a* and common valve operating mechanism 67. Referring to the left-hand cylinder head, when scavenge valve 48 is opened, supercharged scavenge air enters the cylinder via air intake passage 52, through pre-combustion chamber 50, and into combustion chamber 51. The scavenge air entering the cylinder forces the expended exhaust gases out of the cylinder via the exhaust ports 39. The timing of the scavenge valve is such that it closes at approximately the same time that piston 38 covers exhaust ports 39 as it starts back up the cylinder. Thus at the point that the exhaust ports are covered and the scavenge air flow stops, all spent exhaust gases will have been swept out of the cylinder, and replaced with clean, unspent air. With the exception that the fuel/air intake is via the front of the cylinder head instead of via the bottom, as is the case for the scavenge air flow, the fuel/air intake and the scavenge intake valve trains are substantially identical.

The arrangement of the fuel/air intake valve details versus the scavenge air intake valve are shown in detail in FIG. 12. FIG. 12 illustrates the fuel/air and scavenge intake valve arrangement connected to the outer end of the left hand cylinder; however, the arrangement of the fuel/air and scavenge air intake for the right hand cylinder is essentially the same. As shown in FIG. 12, the thoroughly atomized fuel/air mixture enters the cylinder head via intake passage 52, thence through open fuel/air intake valve 137 and into lefthand pre-combustion chamber 50, whence it is ignited by spark plug 26. The scavenge and fuel/air intake valves 48 and 137 are constrained in two dimensions by respective valve guides 138 and 138*a* and are mechanically opened and closed by means of respective valve adjuster barrels 139 and 139*a*, via respective slider bushings 140 and 140*a* and respective forks 141/141*a* and 141*b*/141*c* which are integral with the respective rocker arms 53. This fork and slider bushing arrangement simply allows the rotary arc motion of the rocker arms to be converted to straight reciprocating action for opening and closing of the valves.

The scavenge and fuel/air intake valve linkages are completely enclosed by means of valve linkage housings 56 and 56*a*, FIG. 4 which are physically constrained adjacent respective left and right cylinder heads and camshaft housing 68. The valve linkage housings are bolted to camshaft housing 68 and are sealed to prohibit oil leakage. Access plates 55 and 55*a* serve to gain access for valve adjustment purposes and are similarly oil sealed. Both the camshaft and valve linkages operate in a partial oil bath, and drillings 68*a* and 68*b* serve to permit lubricating oil to enter the valve linkage housing, whence the valves are lubricated by means of splash action caused by the rocker arms.

Referring again to FIG. 4, and particularly the right hand cylinder; this figure shows the right hand piston 38*a* at top dead centre at the point where combustion occurs. When the piston is at top dead centre, combustion chamber 51*a* is at its smallest volume, and is bounded by the face of piston 38*a* and the internal surface of cylinder head 25*a*. This chamber is interconnected to precombustion chamber 50*a* via the waisted portion 57*a*. Because the opening and closing of the fuel/air intake valve lags behind that of the scavenge valve, there is a gradation in the fuel/air mixture within the combustion chamber, with an enriched fuel/air mixture in chamber 50*a* and virtually clean air only in chamber 51*a*. This arrangement permits the carburetion or fuel injection to operate at a very lean mixture, and still have an enriched fuel mixture adjacent to the spark plugs 26 and 26*a*, respectively.

In the valve train as shown in FIG. 4, the cam-actuated valve operating mechanism 67 serves to both open and close the valves rather than relying on a cam linkage to open the valves and springs to close them. The valve operating linkage is shown in an enlarged cross-sectional view in FIG. 14. The centrally positioned cam shaft 85 is spanned by mating cam followers 133 and 134 that are constrained vertically and axially by means of machined channels 86 and 87 shown in FIG. 5 in camshaft housing 68 and matching channels in capping plate 142, but are free to move horizontally as determined by the opening and closing cam lobes on the camshaft.

The cam and cam followers are shown exploded in greater detail in FIG. 13. Valve opening cam lobe 131 is cut in the normal cam profile. The valve closing cam lobes 132 and 132*a* are cut such that the horizontal distance between the opposing surfaces of the valve opening lobe and valve closing lobes remains constant throughout the 360 degrees of camshaft rotation thus both valve opening and valve closing lobes remain engaged with their respective follower at all times. Cam follower 133 spans the cams from the top and cam follower 134 from the bottom and mate together such that each cam follower will be moved off-center by the valve opening cam moving against the respective portions 133*a* or 134*a* of the cam follower, once each revolution, and 180 degrees apart. At all other times during the camshaft rotation the cam followers are held at the centered (valve closed) position, due to the closing lobes 132 and 132*a* engaging the cam follower portions 133*b* and 133*c* of the left hand cam follower and cam follower portions 134*b* and 134*c* of the right hand cam follower.

Referring again to FIG. 14, it can be seen that, as camshaft 85 rotates, the cam followers are positively held on-center in order to hold the valves closed, rather than by means of valve closing springs. However, some means is required to accommodate a certain amount of thermal expansion, as well as wear in the valve seat and linkage. This requirement is met by the spring dashpot assemblies 135 and 135*a*. Considering the left-hand linkage only, dashpot 135 consists substantially of threaded barrel 135*d*, which is integral with cam follower 133, spring cap 144, and compression spring 145. Left hand push/pull rod 136 rides in a drilling in cam follower 133 and a collar 146 integral with the push/pull rod and acting against spring force, holds the valve tightly closed, except when opened by the valve opening cam. The right hand valve spring dashpot and push/pull rod details are similar in all respects to those of the same numbered left hand components.

Figure 21:
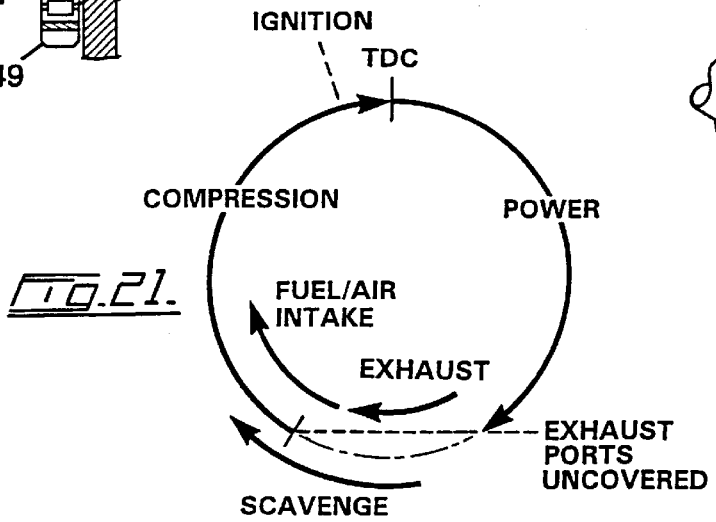
FIG. 21 is a diagrammatic representation of the power cycle over one revolution of the engine.

This valve cam arrangement allows a single valve opening cam to operate both right and left hand valves and to cause them to be mechanically closed, and held closed at all other times. It is also important to note that the fuel/air intake valve cams and opening and closing linkages are the same in all respects to those for the scavenge valves, except for the timing and duration that the valves are held open. The timing of the scavenge and fuel/air intake valve opening during the complete cycle, as well as the duration wherein the exhaust ports are uncovered allowing the spent exhaust gases to be expelled, are shown in FIG. 21.

Figure 5:
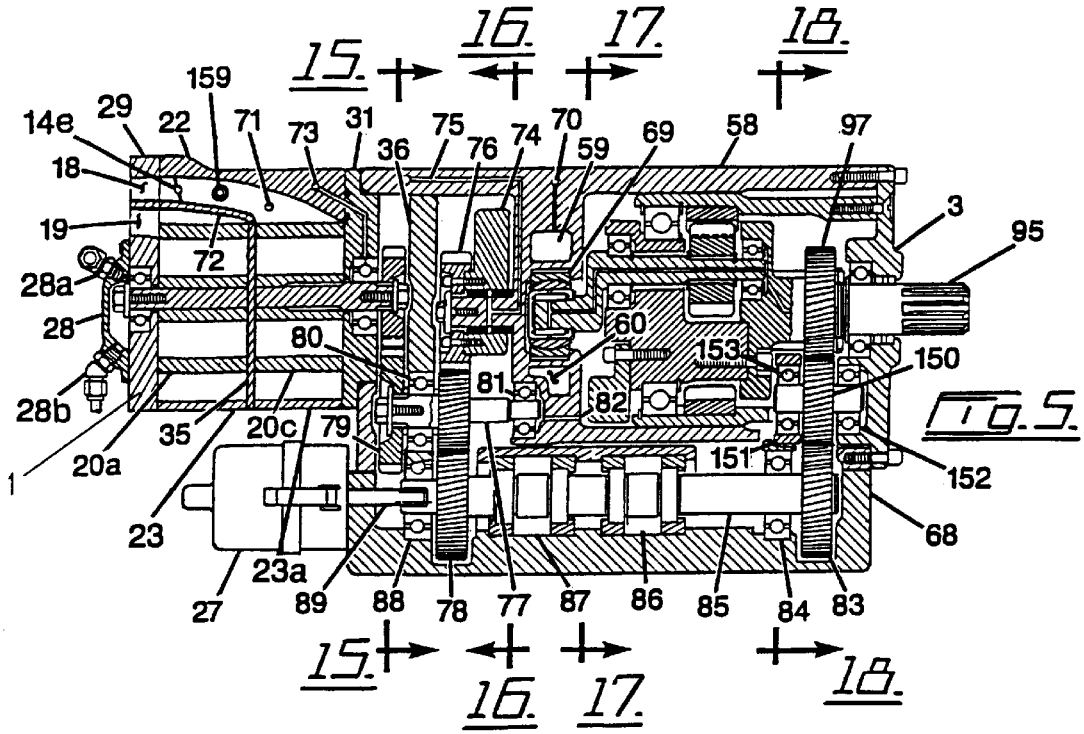
FIG. 5 is a cross-sectional view of the engine taken along the cutting plane designated as 5—5 in FIG. 1.

Referring next to FIG. 5, which is a vertical cross-section through the main housing, this figure illustrates the relationship of the epicyclic gear crank assembly 3, the cam shaft 85, distributor 27, supercharger assembly 1 (FIG. 1), and internal counterbalancing provisions, as well as the gearing required to drive these elements. The epicyclic gear crank assembly 3, which is shown in an enlarged view in FIG. 6, serves to convert the reciprocating action of the pistons into rotary action at the output shaft.

The epicyclic gear crank (EGC) assembly (FIG. 6) consists essentially of a two-piece stationary EGC housing comprising housing 90, which is an interference fit in main housing 58. A mounting plate 91 bolts to the main housing 58 and supports the EGC housing at its aft end. A two-piece rotary housing comprising crank housing 106 and crankshaft end mounting plate 99 is rotatably mounted in housing 90 such that the rotary housing is rotatable about a drive axis defined by line b—b of FIG. 3. The drive axis b—b is perpendicular to the common axis a—a. The rotary housing extends from an inner end adjacent the common axis a—a to an outer end spaced from the common axis along the drive axis. An input crank 104 and spur gear 101 are housed within the crank housing 90 offset from the drive axis. A fixed ring gear 102 is a press fit in the EGC housing 90 centred about the drive axis and prevented from rotating by key 103. The rotary housing is bearing mounted inside the EGC housing by means of main EGC mounting bearing 105 at the forward end and support bearing 100 at the output end such that the rotary housing extends through the ring gear. Output shaft 95 is integral with crankshaft end mounting plate 99 and extends axially from the outer end of the rotary housing along the drive axis. The EGC input crank 104 is constrained in crank housing 106 by means of bearings 107 and 108 and extends from the inner end of the crank housing for connecting to the pistons. Spur gear 101 is spline connected to the EGC input crank 104 and is always in engagement with ring gear 102.

Figure 7:
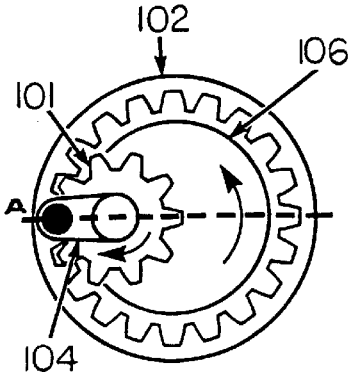
FIGS. 7, 8 and 9 are mechanical schematic diagrams illustrating showing the various position of the input crank and spur gear as the epicyclic gear crank housing is rotated and the connecting rods reciprocate.
Figure 8:
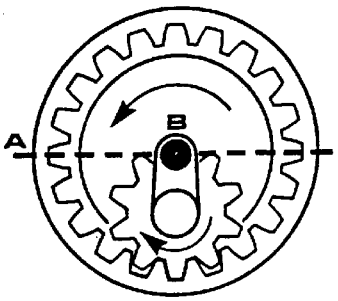
Figure 9:
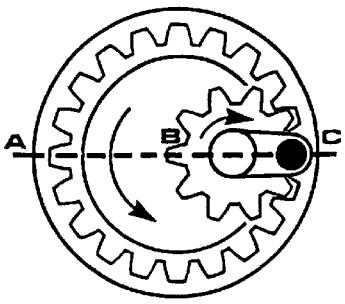

Turning next to FIGS. 7, 8 and 9, this sequence of figures illustrates how the epicyclic gear crank assembly converts linear motion directly into rotary motion. Assume that at the start position crank housing 106, spur gear 101 and crank 104 are situated as shown in FIG. 7, with the crank throw shaft 104*a* being centered at point A. The ring gear 102 is, of course, stationary. As the crank housing 106 rotates 90 degrees in the counterclockwise direction, spur gear 101 rotates 90 degrees in the clockwise direction to the position shown in FIG. 8. While the crank housing 106 and spur gear 101 turn in counter rotating directions, the crank throw shaft 106*a* transcribes the straight line path along the dashed line AB. Similarly, as crank housing 106 rotates a further 90 degrees to the position shown in FIG. 9, the crank throw shaft transcribes the straight line path along the dashed line BC.

In addition to serving to convert the linear motion to rotary motion, the epicyclic gear crank assembly 3 (FIG. 5) also serves to deliver lubricating oil to the piston rings 125 via the rod connector mechanism 64, (FIG. 4). Lubricating oil from an external pump enters the epicyclic gear crank assembly via fitting 96 (FIG. 6). Oil seals 92 and 93 ensure that fluid is only directed into drilling 94 from whence it is fed into cavity 108*a* of rear support bearing 108. Seal 108*b* only allows a small amount of lube oil to flow into bearing 108 for lubrication purposes. The remaining lube oil is fed via drilling 112 extending through the input crank 104 to feed needle bearing 110. Needle bearing cage 109 is capped at its forward end and carbon seal 109*a* prevents excessive leakage to the rear. A series a drillings 111 in the periphery of needle bearing cage 109 communicate with the drillings in the piston connecting rods. Since the needle bearing cage is a press fit in spherical bearing 118 (FIG. 11) of the rod connector mechanism, lube oil is thereby fed into the connecting rods, as described previously. Lube oil to lubricate forward support bearing 107 is provided by small diameter drilling 112*a* which serves to supply a limited quantity of lube oil to the bearing. Oil to lubricate rear support bearing 100 is provided via small diameter drilling 94*a*. Main epicyclic gear crank mounting bearing 105 is lubricated by seepage oil from the other bearings.

During installation of the epicyclic gear crank assembly 3 of FIG. 5 into the main housing 58, special spacer 113 of FIG. 6 is inserted between crank throw shaft 104*a* and crank housing 106 to prevent damage to bearings 107 and 108, since needle bearing cage 109 is a press fit in rod connector mechanism 64. The rod connector mechanism 64 is constrained in, but is free to slide in the broached slider channel 69, of FIG. 4 which obviates the need for any other means of connecting the crank throw shaft to the rod connector mechanism. Once the epicyclic gear crank assembly 3 is fully installed, the special spacer 113 is removed via a threaded hole in the side of main housing 58 (FIG. 3). The special spacer incorporates a threaded drilling into which an extraction screw is inserted. Once removed, the hole is capped by plug 66. To press the epicyclic gear crank assembly out of the main housing, plug 66 is removed, the special spacer is reinserted and the assembly is pressed out via access hole 65 and extractor screws threaded into mounting plate 91 (FIG. 6).

Referring again to FIG. 5, while the engine is in operation, rotation of output shaft 95 also results in rotation of timing gear 97 mounted thereon, which, in turn, drives timing gear 83 mounted on crankshaft 85 via idler gear 150. Idler gear 150 is supported by idler gear support 151, which is attached to mounting plate 91 (FIG. 6), and is bearing supported via bearings 152 and 153 below the output shaft. Timing gear 83 is splined to camshaft 85 and contains the same number of teeth as does timing gear 97 so that the timing shaft rotates at exactly the same rate as the output shaft 95. Camshaft 85 is bearing supported at either end by bearings 84 and 88, and contains an internal spline at its forward end which serves to drive distributor 27 via shaft 89. The camshaft 85 incorporates two sets of cams shown in FIG. 13 which serve to open and close the scavenge and fuel/air intake valves by means of valve operating mechanisms 86 and 87 described previously.

Figure 15:
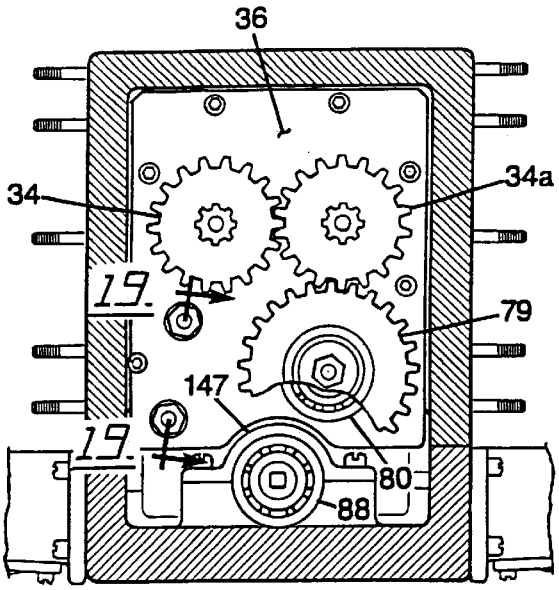
FIG. 15 is a partial cross-sectional view of the main housing assembly taken substantially through the cutting plane designated as 15—15 in FIG. 5.

Gear 78 of FIG. 5 is splined to the forward end of camshaft 85 and serves to drive the contrarotating counterweight 74, as well as the supercharger, via gear shaft 77. Gear shaft 77 is supported by bearings 80 and 81, and contains a spline at its forward end on which gear 79 is attached. Gear 79 of FIG. 15 is engaged with gear 34*a*, which, in turn, is in engagement with gear 34. Gears 34 and 34*a* are the respective drive gears for left and right supercharger rotors as shown in FIG. 3. Because gear shaft 77 of FIG. 16 has only about one half the number of teeth that gear 78 has, and because gear 34*a* is similarly smaller than gear 79, which is splined to gear shaft 77, this results in approximately a 3 to 1 speed increase in the supercharger rotors over the engine speed. FIG. 15 also illustrates bearing cap 147 which secures bearing 88 in position. A similar bearing cap secures the camshaft rear bearing 84. Lube oil for supercharger rear bearings 33 and 33*a* of FIG. 3 is supplied via lube oil tubing 15 shown in FIG. 1 and internal drilling 73 of FIG. 5. Similarly, lube oil for the counterweight bearing surface is provided via tubing 17 of FIG. 1 and drilling 75 of FIG. 5.

Figure 16:
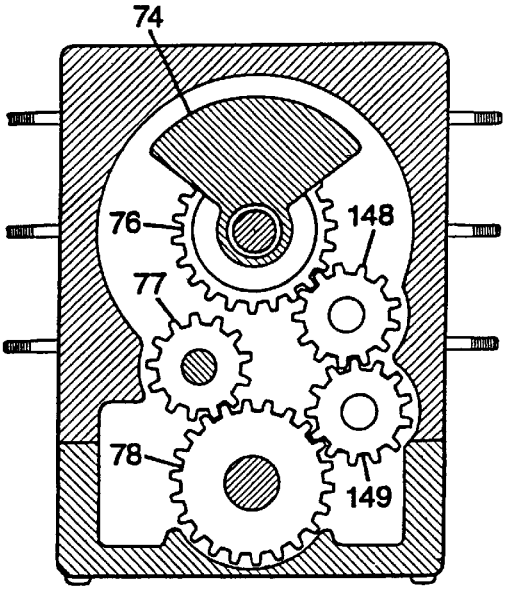
FIG. 16 is a cross-sectional view of the main housing assembly taken substantially through the cutting plane designated as 16—16 in FIG. 5.
Figure 17:
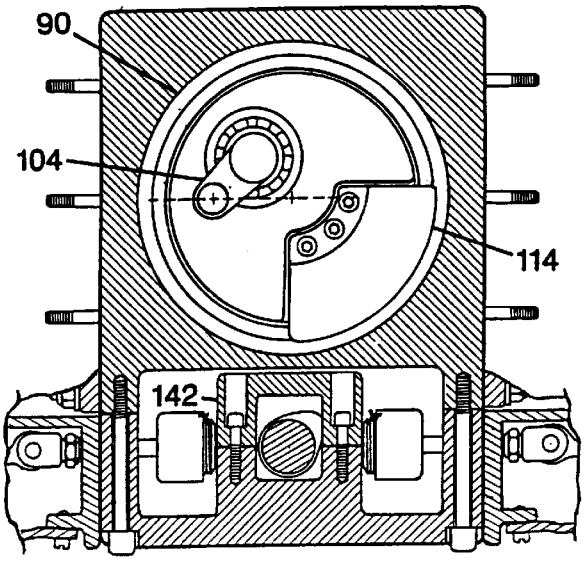
FIG. 17 is a cross-sectional view of the main housing assembly taken substantially through the cutting plane designated as 17—17 in FIG. 5.
Figure 18:
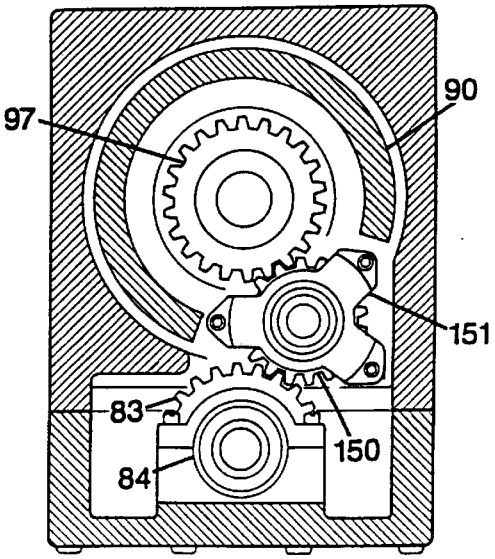
FIG. 18 is a cross-sectional view of the main housing assembly taken substantially through the cutting plane designated as 18—18 in FIG. 5.
Figure 19:
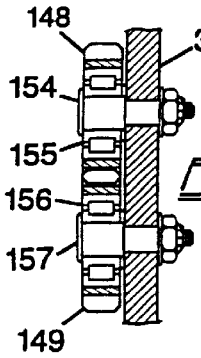
FIG. 19 is an enlarged cross-sectional view of the mounting details for the forward counterweight drive gears taken substantially through the cutting plane designated as 19—19 in FIG. 15.

FIG. 16 illustrates the gear train which serves to drive counterweight 74. Because it is desirable for the counterweight to turn in the opposite direction from counterweight 114 attached to the epicyclic gear crank housing 106, two idler gears 148 and 149 are used. These gears are attached to idler gear mounting plate 36 of FIG. 15 by gear support shafts 154 and 157 of FIG. 19 and bearings 155 and 156. FIG. 18 illustrates the mounting details for timing idler gear 150. Idler gear support 151 is configured such that the complete epicyclic gear crank may be removed without requiring that either gear 150 or support 151 be removed first. A cutout portion in the epicyclic gear crank housing 90 permits timing idler gear 150 to engage timing gears 97 and 83.

In the basic epicyclic gear crank engine, some means is required to allow the entrapped air between the pistons to flow through the main housing without being compressed on each piston stroke. This is achieved by means of upper and lower crossover channels 59 and 60 of FIG. 5 which connect between the lower inner chambers of the left and right hand cylinders. Since there will inevitably be some blowby of combustion gases during operation, as well as some seepage of lubricating oil past the connecting rod seals, some means of venting these gases back to the intake for emission control purposes is required. This is achieved by means of drilling 70 and vent tube 16 as shown in FIG. 1 which connect between the crossover channels and the supercharger input 18.

FIG. 21 illustrates the combustion cycle for the engine. In this engine, the spark plug fires a few degrees before top dead center and the power stroke is very much the same as in a conventional four-cycle engine, except that the exhaust gases exit the cylinder at the bottom as soon as the exhaust ports are uncovered by the piston. At approximately the same time as the exhaust ports are uncovered, the scavenge air intake valve at the top of the cylinder opens, sweeping the spent exhaust gases out of the cylinder and filling it with clean air. Similarly, the fuel/air intake valve opens; however, its opening and closing lags behind that of the scavenge valve and, in fact, remains open for a portion of the piston upstroke. This results in a stratification of gases in the cylinder as it undergoes compression, with the most fuel enriched mixture being adjacent to the spark plug. This means that the engine can be operated in the very lean fuel mixture range without misfiring and yet burn very cleanly.

Since the twin problems of piston to cylinder sidewall thrust forces and piston slap at high RPM have been eliminated, and since the connecting rods never move off the piston-to-piston centerline at any point during the cycle, considerable simplifications can be made in both the piston and connecting rod design. In the case of the piston, since all sidewall forces due to crank angle have been eliminated, there is no need for a piston skirt, nor is there any requirement to fabricate the lower, or skirt end, of the piston in a slightly elliptical cross-section. Further, since the output end of the connecting rod does not move off center, there is no need to connect the piston to the connecting rod by means of a wrist pin, and the connecting rod can simply be threaded into the piston. This would further reduce cost, but it would also eliminate the serious problem often encountered in current internal combustion engines (particularly diesels) of high temperature seizure of the wrist pin to the piston and connecting rod when shutting off an excessively overheated engine.

As a consequence of the simplifications to the piston and connecting rod as described above, it is readily apparent that the combined mass of the two horizontally-opposed pistons and connecting rods would be much less than the comparable pistons and connecting rods of a conventional engine. This means that the problem of engine vibration would also be greatly reduced and, although some counterbalance provision would still be required, the amount of counterbalancing would be much less than in a conventional engine. In applications, such as light aircraft, where weight reduction is an important consideration, this would be a significant advantage.

Because the connecting rods are never subjected to bending moments and are subjected to straight-line compression forces only, they can be made of a uniform diameter cross section. This makes it feasible to incorporate an oil seal between the main housing and the bottom (inboard portion) of the cylinder, making it possible to completely segregate the epicyclic gear crank and other splash-lubricated components from the cylinders. With this oil seal between the main housing and the lower portion of the cylinder, it is less likely that lubricating oil will be lost via the exhaust manifold to atmosphere - thus reducing this source of possible emissions.

Since the lower portion of the cylinder is not splash lubricated as is typical in four-stroke engines, and since for environmental reasons it is not desirable to mix the lubricating oil with the fuel as is done in typical two-stroke engines, some means is included to provide lubricating oil to the piston rings. Because the high piston-to-cylinder side forces have been eliminated, there is not as great a need for cylinder wall lubrication as there is in conventional two and four-stroke engines; nonetheless, some lubricant is still required to lubricate the piston rings. This is achieved by the use of a forced flow lubrication channel through the drillings in the connecting rods and piston, which lead to the piston ring seals. This provision allows a very small but measured amount of lubricant to be deposited on the cylinder wall ahead of the piston rings on each piston up stroke.

The spent exhaust gases are completely purged from the cylinder by a separate scavenge air flow before the fuel/air mixture enters the cylinder. Further, the intake timing is such that the intake valve does not open until after the exhaust ports at the bottom of the cylinder are closed by the piston as it begins its up stroke. This provision completely eliminates the problem of unburned fuel being lost to exhaust. However, it also necessitates the use of two separate, valve trains and intake air flows—one for scavenge air and one for the fuel charged air. Further, the scavenge valve is located in the cylinder head so that, as the spent exhaust gases exit through the exhaust ports at the bottom of the cylinder, they are completely swept out by the surge of scavenge air entering at the top.

Because an epicyclic gear crank replaces the conventional crankshaft, the crankcase cannot be used to pre-compress the fuel air mixture as is done in a conventional two-stroke engine. Instead, a dual element, direct drive supercharger is used so that two completely separate air flows can be achieved - one flow to scavenge the exhaust gases from the cylinder and one to inject a well-atomized fuel/air mixture into the cylinder, timed such that it only enters the cylinder after the piston has started its up stroke and the exhaust ports are closed. While conventional carburetion could be used, a special rotary-type fuel injector is deployed. The rotary-type fuel injector is designed to spray variable amounts of fuel into the air flow up-stream of the supercharger and into the fuel/air intake portion of the supercharger only. Separate manifolds carry the scavenge and intake air flows to the cylinder heads, and each intake flow is controlled via separate timed valves.

The fuel-charged air is injected into a pre-combustion chamber in the cylinder head that is separated somewhat from the combustion chamber proper, formed between the upper portion of the piston and the cylinder head. This precombustion chamber incorporates both the scavenge and fuel/air intake valves, as well as the spark plug. What these two separate but interconnected combustion chambers accomplish is to allow an enriched air/fuel mixture to be injected into the pre-combustion chamber after the piston has started its up stroke and which essentially remains in the pre-combustive chamber adjacent to the spark plug. Because the scavenge air valve is open for that portion of the cycle during which the exhaust ports are uncovered, it serves not only to propel the spent gases out of the cylinder, but also leaves the cylinder filled with clean air. It is this residual scavenge air that is subsequently compressed on the piston up stroke, and which remains in the chamber between the piston and cylinder head. This arrangement, whereby the fuel-charged air is injected separately from the scavenge air after the piston has started its up stroke, results in a highly enriched volume of air in close proximity to the spark plug, but with only a very small amount of fuel in the piston/cylinder head cavity. This concentrated fuel/air mixture in the pre-combustion chamber, coupled with nearly pure air in the piston/cylinder head cavity will result in a very lean-burning engine, yet one not prone to back-firing which might otherwise result from an excessively lean fuel/air mixture.

The requirement of having a positive means for closing the valves is achieved by using an opening cam for each scavenge and fuel/air intake valve spanned on either side by identical closing cams. Two specially designed cam followers, each having an opening 'heel' and two closing 'fingers' span the cams, one on the top and one on the bottom. This cam follower arrangement permits a single opening and closing cam array to operate the related scavenge and fuel/air intake valves for both horizontally opposed cylinders.

In order to meet the objective of easy disassembly, as well as to permit the camshaft to operate in an oil bath, the cam housing is made as a separate assembly, which simply bolts onto the bottom of the main housing containing the epicyclic gear crank unit. Since the cylinder head is a modified L-shape type, the valve linkage can be very short, which is highly desirable for operation at the higher RPM required of this camshaft.

While the pistons and connecting rods are much lighter than in a conventional engine, there is still some requirement for counterbalancing, particularly since both opposing pistons operate in sync. This is achieved by using two relatively small counter-rotating weights, one attached to the rotating body portion of the epicyclic gear crank, and the other being a separately driven weight which is bearing-mounted on the main body housing, and being roughly the same distance forward of the piston-to-piston center line as the epicyclic gear crank mounted weight is to the rear. The front counterweight is driven via gears from the camshaft such that it turns at the same RPM as the epicyclic gear crank mounted counterweight but in the opposite direction. This arrangement results in a nearly complete dynamic balance, both in the horizontal piston-to-piston axis, as well as along the vertical axis.

Because the main body housing for the epicyclic gear crank is continuously supplied with recirculating oil, some small amount of oil will gradually seep out past the connecting rod seals. As well, there will inevitably be some blowby of air and oil past the piston rings on each compression stroke. To ensure that even this small amount of airborne oil is prevented from flowing to exhaust, a poppet type exhaust valve is used. A vent line is connected from the lower portion of the cylinders (at the crossover channel) to the intake side of the fuel/air supercharger section. This means that any small quantity of seepage oil, from either source, will be mixed with the fuel/air intake mixture and will be burnt. These provisions will result in a very clean burning engine that will bear very little resemblance to the conventional two-stroke engine in the amount of emissions produced.

Because direct conversion from reciprocating to rotary motion is achieved without the use of a conventional crankshaft, this means that the frictional losses caused by the high piston-to-cylinder sidewall forces, which are highest during the mid-point of the combustion cycle, are completely eliminated. As well, since the connecting rods of the two opposing cylinders are directly interconnected, that sliding friction which is encountered at the main and crankshaft journals in engines using a conventional crankshaft is also eliminated. This reduction in friction losses throughout the engine means that there will be a net decrease in frictional power losses and a net increase in fuel efficiency. Further, because the mass of the piston and connecting rod combination is much less than in a conventional engine, the energy lost to change direction of the reciprocating mass on each stroke is much less than in other engines. The net result of all of this is greater fuel efficiency.

The fuel air mixture enters the cylinder through the cylinder head and exits through a series of exhaust ports at the bottom of the cylinder. As well, a flow of scavenge air, separate from the fuel/air mixture, is used to scavenge the cylinder of any residual exhaust gases. While this arrangement is used for reasons of combustion efficiency and emission reduction, it also results in internal cooling of the cylinder walls. This scavenge air cooling of the cylinder walls, coupled with the reduction of friction induced heat, means that any provisions for external cooling is vastly reduced. While some provisions for air cooling may be required, there will assuredly be no need for water cooling and the attendant power losses required to drive a water pump, nor the costs for cooling jackets, radiators, and other components required in a conventional cooling system.

The complete engine is purposely designed so that it can easily be broken down into several major assemblies. Because of the way in which the engine is configured, once the external interconnecting items such as intake manifolds, fuel connecting lines, oil delivery lines, and so forth, are removed, the engine can quickly be disassembled into its major components comprising left and right cylinders, epicyclic gear crank assembly, supercharger unit, camshaft housing assembly, and main body assembly. Further, the complete unit is purposely designed such that any of the major assemblies can be removed from the main housing without necessitating complete engine dismantling. This bolt-together feature means not only that maintenance procedures such as piston ring or valve replacement become very easy, it also means that the costs for prototype development would be vastly reduced because no large castings, forgings or other expensive one-off items are required. As well, the tooling machinery and facility costs to set up a factory for production would be a small fraction of what it would cost to produce a similar-sized conventional engine.

Because a two-stroke engine has twice the number of power strokes compared to a four-stroke engine running at the same RPM, a two-stroke engine has the capability, in theory at least, of producing twice as much power as that of a similar four-stroke engine of the same volumetric capacity; although this is never achieved. However, the preferred embodiment engine would achieve this theoretical doubling of output power, and would be expected to exceed it, due to the increased power output resulting from reduced frictional and parasitic losses. Further, since the massive and heavy crankshaft and block are not required in the preferred embodiment, this would result in substantial weight savings over conventional engines. As well, the requirement for water cooling, even on larger-sized engine modules has been eliminated, thus all of the complexities and weight associated with water cooling, such as cylinder water jackets, radiator, water pump, and so forth are eliminated, and even a lesser amount of external air cooling, if indeed any at all, is required than would otherwise be the case. The net result is a much smaller and lighter engine.

Not considering any power output increase due to the efficiencies made possible by reduction in internal friction, or reduction in power losses to drive water pumps, etc., an engine having two horizontally-opposed cylinders, as described, would produce at least as much power as its four cylinder, four-stroke engine counterpart having exactly equivalent bore and stroke dimensions, for instance, a 2 litre engine.

In addition to the substantial overall size reduction made possible, the fact that the height dimension is less than half that of the length and width means that it is suitable for stacking to form a compound engine.

Referring to FIGS. 24 through 40 there is illustrated a second embodiment of the engine in the form of a compression ignition variant generally indicated by reference character 'B'.

Figure 24:
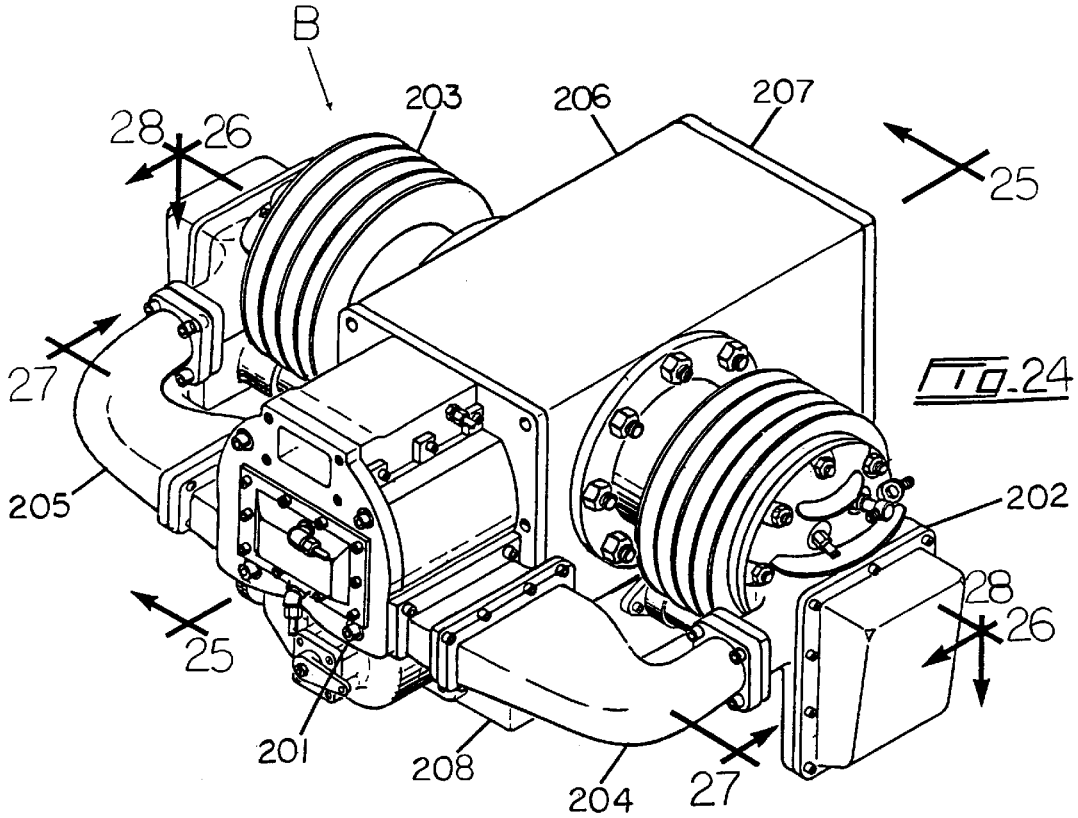
FIG. 24 is an isometric overall view of a second embodiment of the engine showing the top, front and one side of a compression ignition variant of the engine.

Referring first to FIG. 24, this figure illustrates the overall configuration of the compression ignition (diesel) variant of the epicyclic gear crank based engine. The engine B includes a main housing assembly 206 and an epicyclic gear crank assembly 207 which fits into and is bolted to the rear end of the main housing assembly. A pair of horizontally-opposed left and right cylinder assemblies 202 and 203, are bolted on opposing sides of the main housing assembly. A single-element supercharger assembly 201 is bolted on the front of the main housing assembly. Also a camshaft housing assembly 208 is bolted on the bottom of the main housing assembly. The main housing assembly and epicyclic gear crank assembly are to those described in the first embodiment.

Figure 25:
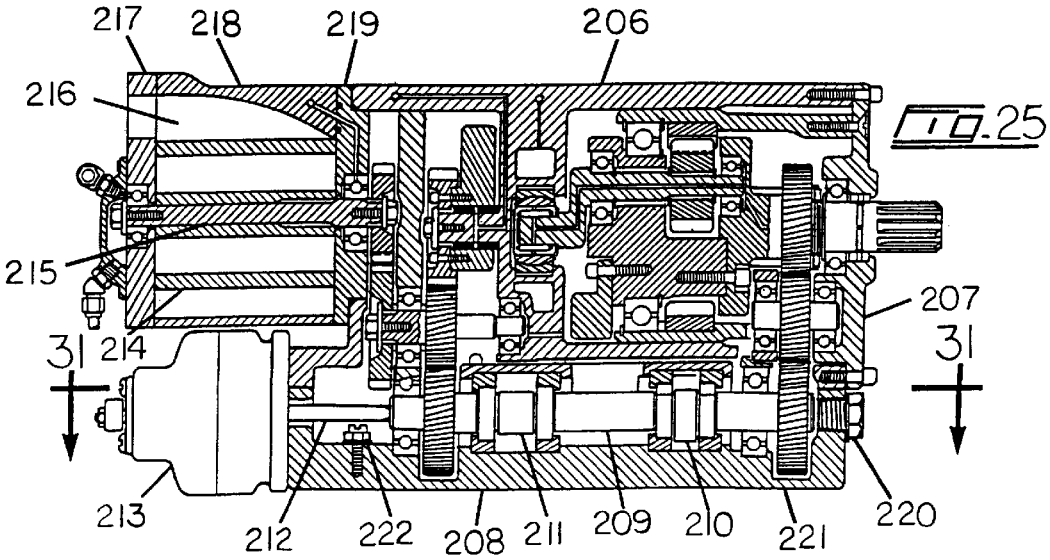
FIG. 25 is a side cross-sectional view of the second embodiment through the cutting plane designated as 25—25 in FIG. 24.

Turning next to FIG. 25, this figure illustrates the changes required to the camshaft housing assembly and supercharger assembly for use in the compression ignition variant. Camshaft 209 is driven from the epicyclic gear crank assembly in exactly the same way as in the spark ignition variant; however, the camshaft differs somewhat from that used in the spark ignition variant in that cam operating mechanism 210 serves to actuate two horizontally-opposed, piston-type, fuel injector pumps, while cam operating mechanism 211 is modified somewhat to accommodate hydraulic valve lifters which serve to operate the intake valves, as will be described later. Additionally, governor 213, which is driven by splined extension shaft 212 from the front end of the camshaft, replaces the distributor that is used in the spark ignition variant.

The supercharger 201 is driven from the camshaft in exactly the same way as in the spark ignition variant; however, only a single element supercharger is required in the compression ignition variant, because the fuel is injected directly into the cylinder, instead of into the air stream ahead of the supercharger, as in the spark ignition variant. The supercharger as shown in FIGS. 26 and 27 consists substantially of front plate 217, rear plate 219, side plates 223, 223*a*, rotors 214, 214*a*, rotor drive shafts 215, 215*a*, upper housing 218, and air splitter 233 (FIG. 27). During operation, air is inducted into the supercharger, and is compressed or supercharged by left and right, matching, constant displacement type rotors 214, 214*a*, which are driven from the camshaft similarly to the first embodiment.

Turning next to FIG. 27, upon exiting the supercharger, the supercharged air is split into two separate air flows by means of air flow splitter 233, from whence it is delivered to the left and right cylinder heads 226*a*, 226 by means of left and right intake manifolds 205 and 204, respectively. The supercharged intake air enters the cylinders via air passages 226*b*, 226*c*, FIG. 28 and intake valves 250, 250*a*.

Fuel is injected into the respective cylinders by fuel injectors 230, 230*a*, FIG. 26 mounted in an outer end of each respective cylinder as the respective pistons 229, 229*a* approaches the end of the compression stroke. During initial starting of a cold engine, ignition is aided by means of glow plugs 231, 231*a* also mounted in the outer end of each cylinder. As the pistons 229, 229*a* near the end of the combustion stroke, the spent gasses exit the combustion chamber via exhaust ports 251, 251*a*, situated around the periphery of the cylinder liners 225, 225*a*, towards an inner end of the respective cylinders and then exit the cylinder via the poppet-type exhaust valves 232, 232*a* similarly to the first embodiment.

Figures 28, 29, 30:
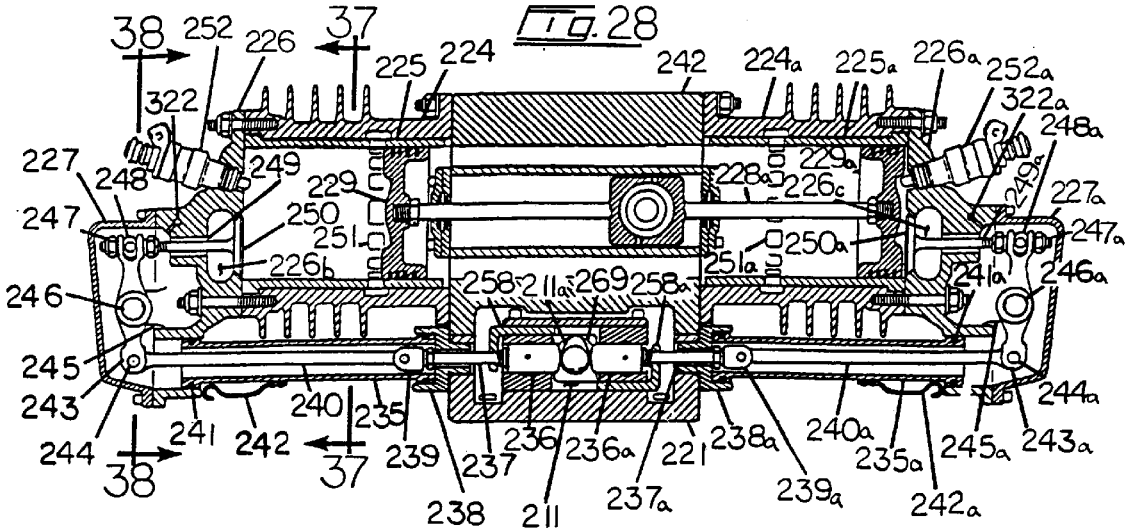
FIG. 28 is a cross-sectional view of the second embodiment of the engine taken along the cutting plane designated 28—28 in FIG. 24 illustrating the air intake valve operating linkage.
FIG. 29 is an enlarged partial view of the intake valve cams, cam followers, and hydraulic valve lifter details as shown in FIG. 28.
FIG. 30 is an enlarged partial view of the right hand hydraulic valve lifter shown in FIG. 29, and illustrates its internal working details.

Turning next to FIGS. 28, 29 and 30, the air intake valve operating mechanism and the valve linkage details are illustrated, which consist principally of valve opening cam lobe 211 a, hydraulic valve lifters 236, 236*a*, valve closing cam lobes 269, valve closing cam followers 258, 258*a*, inner push/pull rods 237, 237*a* devises 239, 239*a* outer push/pull rods 240, 240*a*, valve rocker arms 243, 243*a*, and intake valves 250, 250*a*. The intake valves 250, 250*a* slide in bushings 249, 249*a* mounted on the outer ends of the respective cylinders and are opened and closed by means of the rocker arms acting through slider barrel bushing mechanisms 248, 248*a*, which serve to permit the rocking action of the rocker arms. The rocker arms 243, 243*a* are pivotally mounted on pins 246, 246*a*, to open and close the valves. Nuts 247, 247*a* adjustably mount the slider barrel mechanism on the rocker arms which permit the intake valves to be adjusted. Optional electronic lube oil injectors 252, 252*a* mounted on the outer end of each cylinder may be used in place of the cylinder lube oil system used in the spark ignition variant.

Because the valve linkage is somewhat longer, and consequently contains more mass than the comparable spark ignition variant, hydraulic valve lifters are used to open the intake valves. The hydraulic valve lifters 236, 236*a* FIG. 29 operate through inner push/pull rods 237, 237*a* connected to respective outer push/pull rods 240, 240*a* and respective rocker arms 243, 243*a* to both open and close the valves. Except when the valves are opened by the action of the valve opening cam 211*a*, FIG. 30, the valves are held in the closed position by means of the valve closing cams 269, which engage left and right cam followers 258, 258*a* and the respective valve linkages. Wavy spring washers 264, 264*a* FIG. 29, are mounted between the valve closing cam followers and a shoulder 265*a*, FIG. 30, integral with inner push rods 237, 237*a*, to accommodate any small dimensional changes in the valve operating linkage due to thermal expansion, as well as to keep the valves tightly seated when in the closed position.

During engine operation, the lobe portion of valve opening cam 211*a* acts against the hydraulic valve lifters 236, 236*a* to open the intake valves. The valve lifters are constrained in bores extending laterally outward in valve guide blocks 259, 259*a*, for engaging the valve opening cam lobe at an inner end and valve closing cam followers at an outer end. The hydraulic valve lifters are conventional in all respects, and consist of valve body 262, FIG. 30 and valve take-up piston 266 mounted on a cam end of the push/pull rod 40 for sliding within the valve body. A take-up compression spring 268, a spring cup 267, a ball seating spring 270, and non-return valve ball 271 are located within a fluid chamber defined between the valve body and the take up piston. The fluid chamber is arranged to communicate with pressurised fluid ports connected thereto for controlling the displacement of the valve take up piston with the valve body. Although only one hydraulic valve lifter is illustrated in detail, both left and right lifters are identical. Lube oil is delivered to the hydraulic valve lifters via piping 320, FIG. 36 on the outside of the camshaft assembly 208, and thence via drillings 298 and 299, FIG. 33 inside each camshaft housing, and thence via drillings 295 in valve guide blocks 259, 259*a*, and then via groove 261, which spans the valve lifter bores. O-ring seal 296 prevents lube oil leakage out through the interface between the valve guide blocks and the camshaft housing.

Turning next to FIG. 30 which illustrates the righthand hydraulic valve lifter in detail, when the hydraulic valve lifters are in the closed position as shown in FIG. 29, the take-up compression spring 268 causes the valve body 262 to be held firmly against valve opening cam 211*a*, while the valve take-up piston is held firmly seated on the spherical end of inner push/pull rod 237*a*. The non-return valve, comprising ball seating spring 270, ball 271, and the corresponding ball seat on valve take-up piston 266 permits lube oil to flow into the spring cavity via the non-return valve ball 271, chamber 261*a*, and the drillings 261*b* and 262*a* in the periphery of the valve take-up piston 266 and the valve body 262, and via groove 261 in valve guide block 259*a*. When the lobe portion of valve opening cam 211*a* causes the hydraulic valve lifter to move to the right, the non-return valve prevents the lube oil in the spring cavity from flowing back into the chamber in the take-up piston. In this way, the hydraulic valve lifters ensure that any slack between the cams and the intake valves is always taken up.

Unlike the situation in the spark ignition variant, it is not practical to use splash lubrication for the intake valves and rocker arms because they are located well above the level of the oil which collects in the bottom of the cam housing 221 and in the valve actuating rod housings 235 and 235*a*. For this reason, lube oil from an external source is fed into the cylinder heads via piping 321, FIG. 38, and thence via drillings 323 and 322, and then via orifice 322*a*, FIG. 28 to supply a positive flow of lube oil to the intake valve stems. Lube oil is similarly supplied from the same piping 321, FIG. 38, and is fed via internal drilling 324 in rocker arm pivot pins 246, 246*a* to lubricate the rocker arms.

Excess lube oil from the intake valves and intake valve rocker arms flows down through the valve actuating rod housings 235, 235*a*, FIG. 28, and gradually drains into the bottom of the camshaft housing via drillings 253, 253*a*, FIG. 30 connected therebetween from whence it is returned to an external reservoir by means of an external scavenge pump. The valve linkage operates in a splash lubricating oil environment, the valve actuating rods being sealed from leakage by means of O-ring seals 241, 241*a* at the outer end of the valve linkage housing and at the inner end by means of O-ring seals 255, 255*a*. In order to provide a suitable bearing surface for inner push/pull rods 237, 237*a*, as well as to provide a mating internal bore for quick disconnect of the actuating rod housings, slider housings 238, 238*a* are used. These slider housings are sealed against oil leakage by means of crush seals 257, 257*a*, and incorporate bushings 256, 256*a* in which push/pull rods 237, 237*a* slide.

The valve operating linkage and tube housing are configured in such a way as to permit easy removal of either the camshaft housing or the cylinders without necessitating complete disassembly of the engine. To remove the camshaft assembly for servicing, all that is required is to lift clips 242, 242*a* of FIG. 28 and to move the valve actuating rod housings outboard enough to gain access to remove pins 254, 254*a*, FIG. 29. Once this is done, and the lube oil and fuel connections are also disconnected, the camshaft housing is easily removed. Similarly, should it be desired to remove the cylinder or cylinder head only, this is easily accomplished by first removing the valve access covers 227, 227*a* and then removing pins 244, 244*a*. Once this is done, and the relevant lube oil fuel and electrical lines are disconnected, it is a simple matter to remove either the cylinder head or the complete cylinder.

Figure 31:
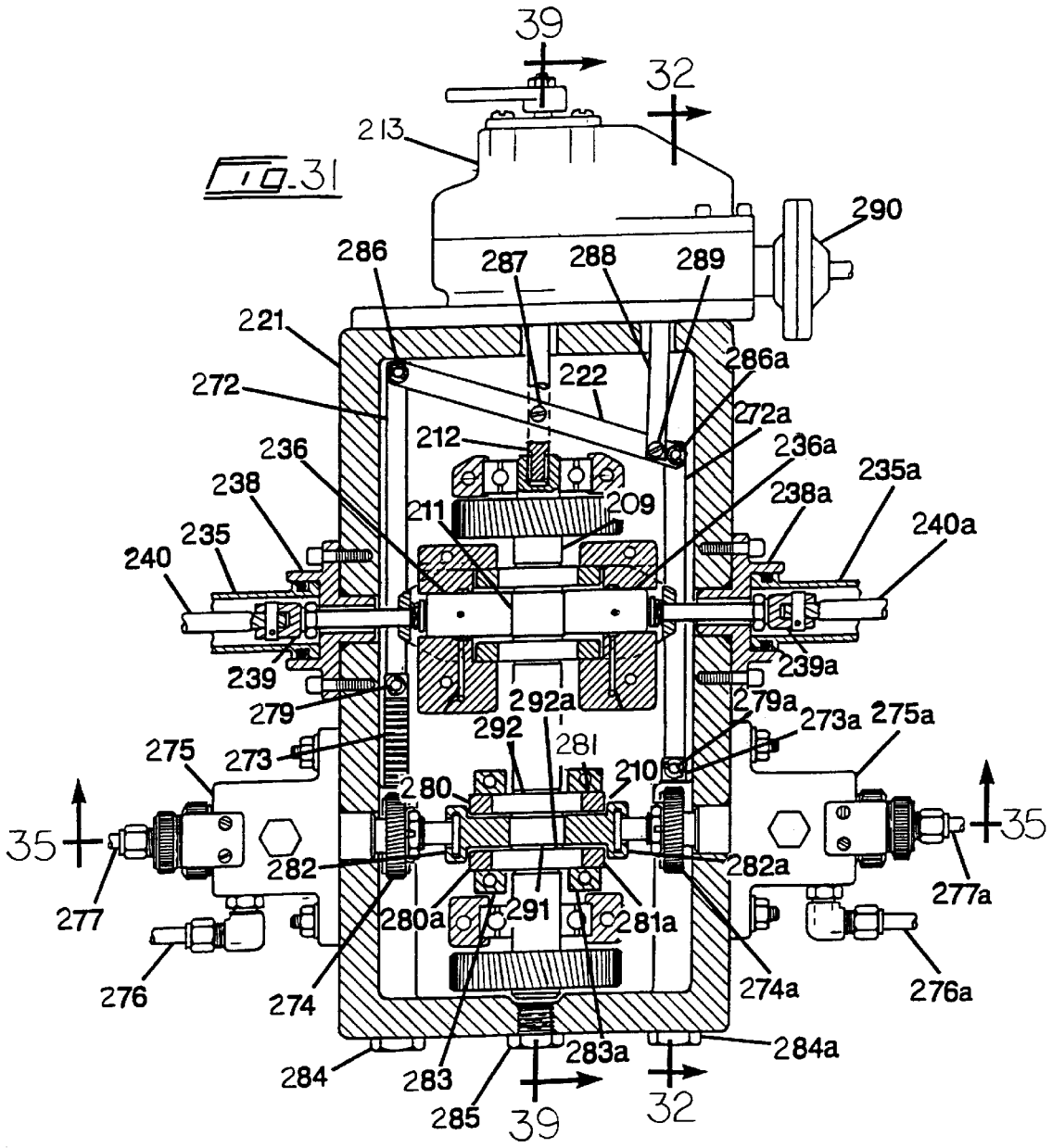
FIG. 31 is a cross-sectional view looking downward through the cutting plane designated 31—31 in FIG. 25, and illustrates the interrelationship of the intake valve and fuel cam operating mechanisms to that of the control linkage for the fuel injector pumps.

Turning next to FIG. 31, this figure illustrates in plan view the essential details of the camshaft housing assembly, which is central to achieving a low profile engine module suitable for stacking vertically. As can be seen in FIG. 31, camshaft 209 incorporates two separate cam operating mechanisms 210, and 211. The intake valve cam operating mechanism 211, and related intake valve operating linkages have already been described, and won't be further discussed here.

The two fuel injector pumps 275, 275*a*, FIG. 31 are conventional reciprocating piston-type pumps, with the exception being that the pistons are both extended and retracted by cam action, rather than employing return springs to retract the pistons. This is done in order to accommodate the doubling of strokes per minute required in a two-stroke versus four-stroke application. As in a conventional piston-type fuel injection pump, the effective stroke length of the pistons is controlled by means of a geared rack 273, 273*a* and mating pinion gears 274, 274*a*. The left and right racks are constrained in internal drilling 293, FIG. 32, and are controlled by means of governor 213 via push/pull link 288 and sway bar 222 and push/pull rods 272, 272*a*. Sway bar 222 is pivoted on shouldered screw 287, and is connected to push/pull rods 272, 272*a* by means of pins 286, 286*a*. The push/pull rods 272, 272*a* are similarly connected to geared racks 273, 273*a* by means of pins 279, 279*a*.

During operation, engine speed is sensed by the governor 213 connected to the camshaft 209. Internal flyweights in the governor serve to provide the necessary speed control action via link rod 288, which is attached to sway bar 222 by means of pin 289. Push/pull action of the link rod 288 causes the sway bar 222 to rotate through a small arc to linearly displace the push/pull rods 272, 272*a* in opposing directions. The pinion gears 274, 274*a* are thus rotated in opposite directions on the respective geared racks. This rotary action causes the effective stroke length of the pistons in the pumps to change, and to cause a greater or lesser amount of fuel to be ejected from the pumps, and consequently to be injected into the cylinders by means of injectors 230, 230*a*, FIG. 26. A constant source of fuel is supplied to the respective pumps via fuel lines 276, 276*a*, FIG. 31. The push/pull rods 272, 272*a* are located at the very bottom of the camshaft housing FIG. 32 so as to provide sufficient clearance without causing interference with the intake valve cam followers 258, 258*a* of FIG. 28 extending through the area indicated by dashed line 294 in FIG. 32. The plugs 284, 284*a* permit removal and installation of the geared racks from the housing.

The left hand pump piston is extended during the fuel injection stroke by means of the lobe on injection cam 291, FIG. 31, working through injection cam follower 282*a*, and is retracted by means of return cams 292 and 292*a* and return cam followers 281, 281*a*, which are integral with opening cam follower 282. Similarly, the right hand pump piston is extended by means of the same lobe on injection cam 291, working through injection cam follower 282*a*, and are returned by return cams 292, 292*a* and return cam followers 280, 280*a*, which are integral with opening cam follower 282*a*. The fuel injection cam followers are constrained in left and right cam follower housings 283, 283*a* and from above by cover plate 311, FIG. 35. To permit some misalignment of the fuel injectors with the fuel injector cam operating mechanism, the injector pistons contain an integral squared flat head 300, 300*a*, which slides into a mating cutout on the injector cam followers 282, 282*a*. This arrangement permits some misalignment between the pistons and cam followers, but prevents the fuel injector pistons from rotating when the pinion gears are rotated.

Turning next to FIG. 35, this figure illustrates the internal components of the two identical, horizontally-opposed, fuel injector pumps 275, 275*a* and the corresponding cam operating mechanism. Since the two pumps are identical, only the right hand pump will be described here. The righthand pump includes a main housing 309*a* which bolts to the side of camshaft housing 221 and an inner cylindrical housing 306*a*, which fits into a mating machined bore inside the main housing. A rotary control cylinder 301*a* fits in mating bores in both housings. A piston 310*a* is mounted within the cylindrical housing and moves back and forth inside the cylindrical housing by means of cam action. A spring housing 305*a*, which serves to take up any excess clearance between the rotary control cylinder 301*a* and non-return valve seat 312, FIG. 34. The rotary control cylinder 301*a* contains an external threaded portion on the outer end which mates with internal threads in the main housing 309*a*, and serves to permit adjustment of the piston position relative to a precision drilling 301*b* in the rotary control cylinder. Locking arms 307*a* and 304*a*, FIG. 35 serve to lock the adjustable components in place.

During operation, fuel enters the pump via piping 276*a*, FIG. 34, from whence it is delivered via drilling 318, groove 318*a*, then through holes 319 in the body of inner cylindrical housing 306*a*, and grooves 319*a* about the rotary control cylinder and thence through small precision drilling 301*b* in the rotary control cylinder 301*a*. The piston 310*a* contains a curved cutout portion 310*b*, such that when the rotary control cylinder 301*a* is rotated by means of the action of the rack and pinion gear mechanism, the effective stroke length of the piston varies, and the quantity of fuel injected into the cylinder also varies accordingly. During assembly, the inner cylindrical housing 306*a* is adjusted so that the outer end of piston face 310*a* is in close proximity to drilling 301*b* so that only a small amount of movement will cause the drilling to be covered by the piston.

Once the piston begins to extend and the precision drilling has been covered by the face end of the piston, fuel cannot flow back through the precision drilling, and thus any further movement of the piston causes fuel to be forced out through non-return valve 314, through fuel injection pipe 277*a*, and thence through fuel injector 230*a* and into the cylinder. Once the piston has travelled to the point on the stroke where the cutout portion of the piston again uncovers the precision drilling, the pressure is immediately relieved and no further fuel is displaced; however, any pressurized fuel already in line 277*a* is prevented from flowing back into the pump by non-return valve 314, which is reseated on valve seat 312. Note that the details of the left hand pump are identical to the same numbered items on the righthand pump.

Figure 36:
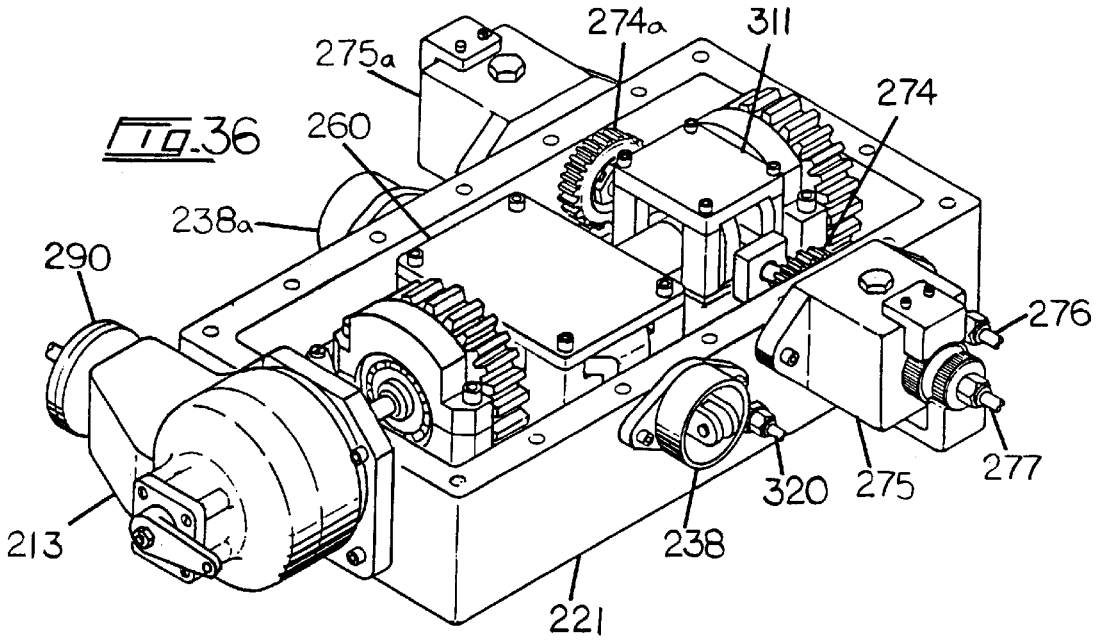
FIG. 36 is an isometric view of the camshaft assembly removed from the engine, and illustrates pictorially the interrelationship of the cam operating mechanisms, fuel pumps, and governor.
Figure 37:
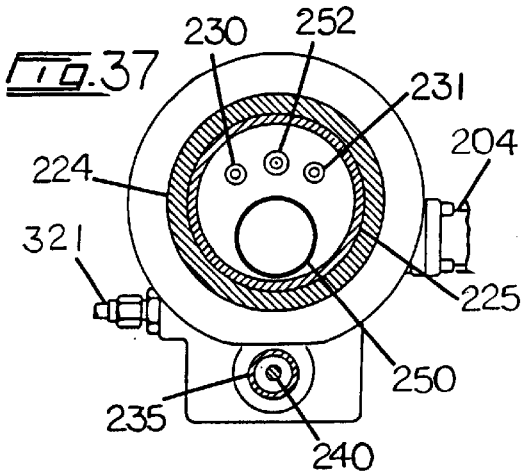
FIG. 37 is a cross-sectional view taken through the cutting plane designated as 37—37 in FIG. 28, and is an internal view of the cylinder looking towards the head.
Figure 38:
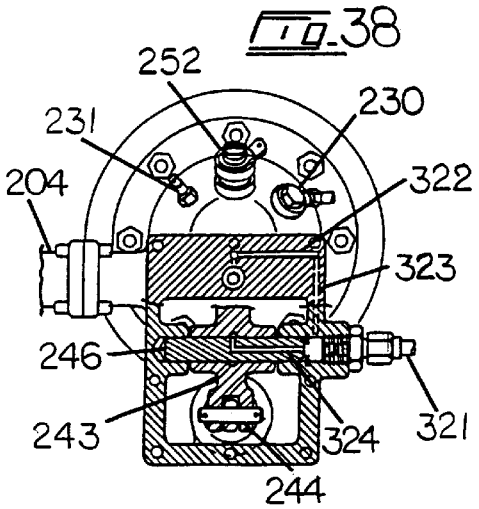
FIG. 38 is a cross-sectional view taken substantially through the cutting plane designated as 38—38 in FIG. 28, and illustrates the lube oil provisions for the intake valve and valve rocker arm.
Figure 39:
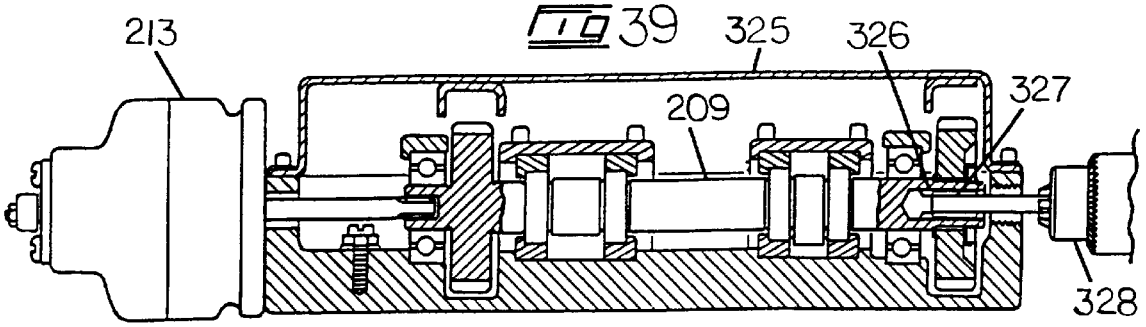
FIG. 39 is a cross-sectional view of the camshaft assembly taken substantially along the cutting plane designated as 39—39 in FIG. 31, and illustrates the camshaft assembly as set up for bench test and calibration.

Turning next to FIG. 36, this figure illustrates the relationship of the main components that are housed inside, or are bolted to the outside of, camshaft housing 208. With the camshaft housing assembly removed from the engine, all that is required to gain access to the cam operating mechanisms is to remove cover plates 260 and 311. FIG. 39 illustrates the setup of the camshaft housing assembly for maintenance. In order to perform off-engine maintenance and testing of the fuel pumps, the removed camshaft housing assembly is mounted on a bench and clear plastic cover 325 is installed to prevent oil from being thrown off by the camshaft drive gears. Plug 220, FIG. 25 is then removed and a high-speed electric drill, with special splined adapter 327 inserted in the drill chuck 328, is engaged with mating splines 326 in the end of camshaft 209. The drill is then brought up to normal engine speed and the fuel injector pumps and governor can then be adjusted.

Figure 40:
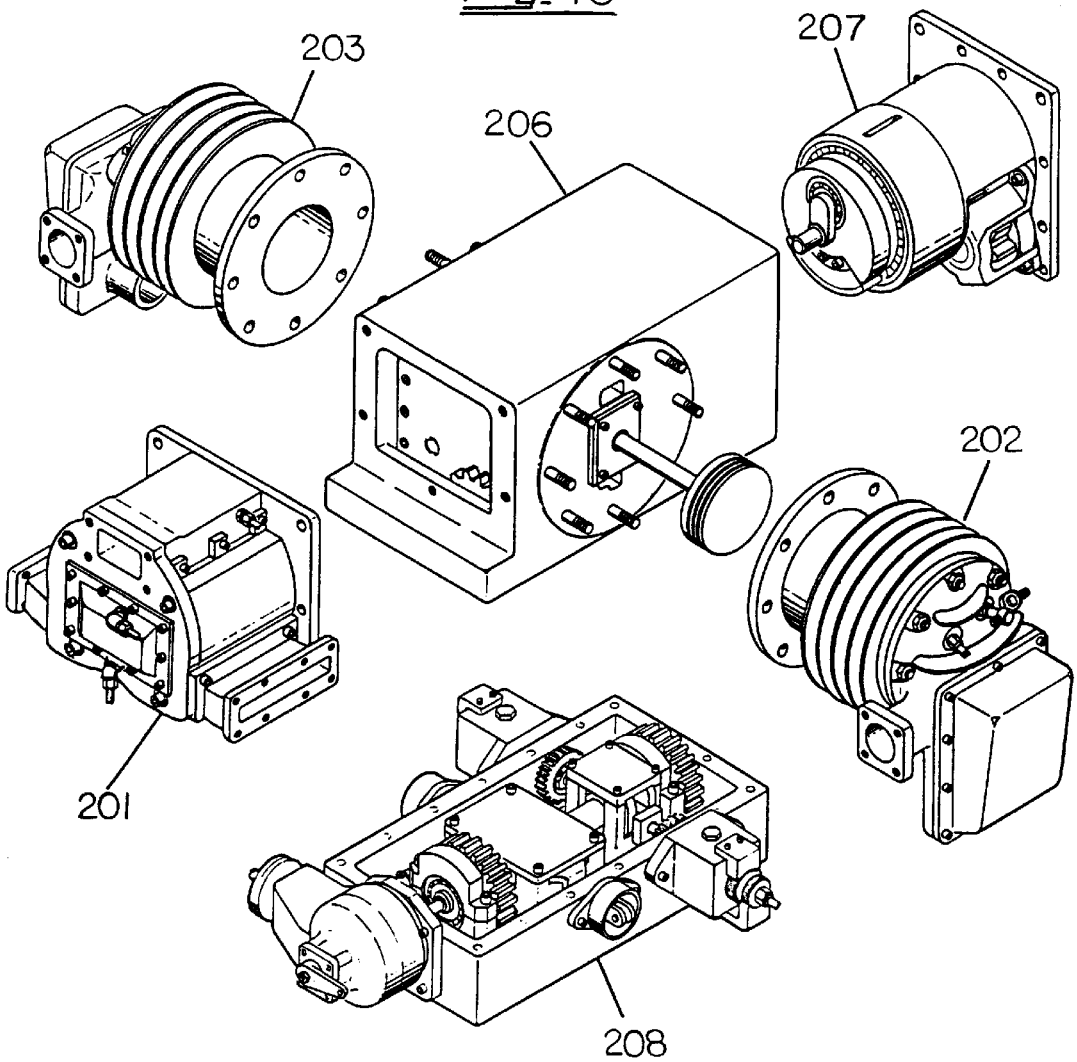
FIG. 40 is an exploded isometric view of the second embodiment of the engine showing the main bolt-together assemblies that together make up the complete compression ignition engine.

FIG. 40 illustrates how the main assemblies are broken down. The various interconnecting linkages and gear trains are all designed so as to permit removal of either or both cylinders 202 and 203 without requiring that the camshaft assembly 208 also be removed. Similarly, the camshaft assembly can be removed without having to also remove the cylinders. The supercharger 201, however, must first be removed in order to remove epicyclic gear crank assembly 207, but the removal of both the supercharger and the epicyclic gear crank are simple tasks.

In the compression ignition engine variant, herein described, since the fuel is injected directly into the cylinder near the point of highest compression, and since the fuel is ignited spontaneously, there is no need to have two separate intake air flows, as is the case for the related spark ignition variant. And since the compression ignition variant also ejects the spent exhaust gasses via the bottom of the cylinder when the piston is at the bottom of the combustion stroke, co-incidental with that portion of the cycle during which the intake valve is open, all of the spent exhaust gasses are similarly swept out of the cylinder by means of the in-rushing supercharged intake air, and only clean, unspent, air is present in the cylinder at the start of the subsequent compression stroke.

For these reasons, it is obvious that only a single element supercharger is required, as well as single intake manifolds, unlike the dual manifolds used in the spark ignition variant. This simplifies the air intake details somewhat, inasmuch as provision has to be made in the cylinder head for only one valve, and no pre-combustion chamber is required. In addition, only one valve operating linkage is needed. But because of the higher compression ratios required to effect spontaneous combustion, some changes are required in the cylinder, cylinder head, and piston to accommodate this higher compression ratio.

While the spark ignition variant uses a modified L-shape cylinder head incorporating a pre-combustion chamber, in the compression ignition variant the precombustion chamber is not required, and the single intake valve is located in the cylinder head directly above the piston. Along with the intake valve, the cylinder head also contains provisions for the fuel injector nozzle, glow plug, and optional electronically-controlled lube oil injector. But because the exhaust gasses are ejected at the bottom of the cylinder, just as in the spark ignition variant, there is plenty of room for these components since the head doesn't have to house an exhaust valve, as is the case in a conventional diesel engine.

Because the intake valve is moved into the cylinder head in the compression ignition variant, directly above the piston in a typical overhead valve arrangement, the spark ignition variant requires a somewhat longer valve linkage. And in order to adequately handle the increased mass that this entails, as well as to retain the positive cam-actuated valve closing and opening features, hydraulic valve lifters are incorporated into the valve cam opening mechanism. However, in the interest of quick disassembly, as was stated as being one of the objectives of this engine design, the valve linkage and linkage housing have been purposely designed to enable quick disconnect of the linkage so that either the complete cylinder assembly or the complete valve housing assembly or, alternately, the cylinder head alone, can be separately removed for maintenance or servicing without requiring compete disassembly of the engine In order to provide lubrication to the intake valve, provision is made in the cylinder head to directly lubricate the valve stem sliding surfaces, as well as the valve rocker arm pivot points. The lube oil is delivered to these components by means of a spray orifice in the head in the case of the valve stem, and by means of a drilling through the pivot pin in the case of the rocker arm. Excess oil from the valve stem and rocker arm migrates down through the valve linkage housing, from whence it passes through a drilling into the camshaft housing. Lube oil is also force-fed through drillings in the camshaft housing and valve operating linkage to supply lube oil to the hydraulic valve lifters in the camshaft housing assembly. Excess oil that collects in the bottom of the camshaft housing from both sources, as well as from the other oil lubricated components in the main housing, are fed back to an external reservoir by means of a scavenge pump.

Because only a single air intake valve linkage is required in the compression ignition variant of the engine, versus the dual scavenge and fuel/air intake linkages which are employed in the spark ignition variant, the otherwise unused cam actuating mechanism can be used for other purposes. This cam actuating mechanism is utilized to operate two identical piston-type, controllable-volume, fuel injector pumps—one for each cylinder. And since the engine operates in a two-stroke mode which requires that fuel be injected into the cylinders once every revolution, it is possible to use a camshaft in common with the intake valve operating mechanism.

Because the engine operates in a two-stroke mode, this means that the camshaft has to operate at the same number of revolutions per minute as the engine itself—in other words at twice the rate of rotation as that of the camshaft rate of rotation in a conventional four-stroke engine. For this reason, the pistons in the respective fuel pumps are mechanically retracted by cam action, rather than by spring action, as is normally the case in a four-stroke engine. In this respect, the piston-type fuel pump operating mechanism is similar to that used for the valve linkage, except that hydraulic lifters are not required.

In order to maintain the desired compact, low profile design, as is desired for vertical stacking, the control system for the fuel injector valves is integrated into the camshaft housing assembly. A conventional speed sensitive governor is mounted on the front of the camshaft housing, and is driven via an extension shaft which is spline-coupled to the forward end of the camshaft. The output of the governor controls the effective stroke length of the pistons in the two horizontally-opposed fuel injector pumps by means of dual rack and pinion control linkages which span either side of the cam operating mechanisms inside the camshaft housing.

Referring to FIGS. 41 through 56 there is illustrated a third embodiment of the engine in the form of a spark ignition epicyclic gear crank engine compounded with a turbine and being generally indicated by reference character 'C'.

Figure 41:
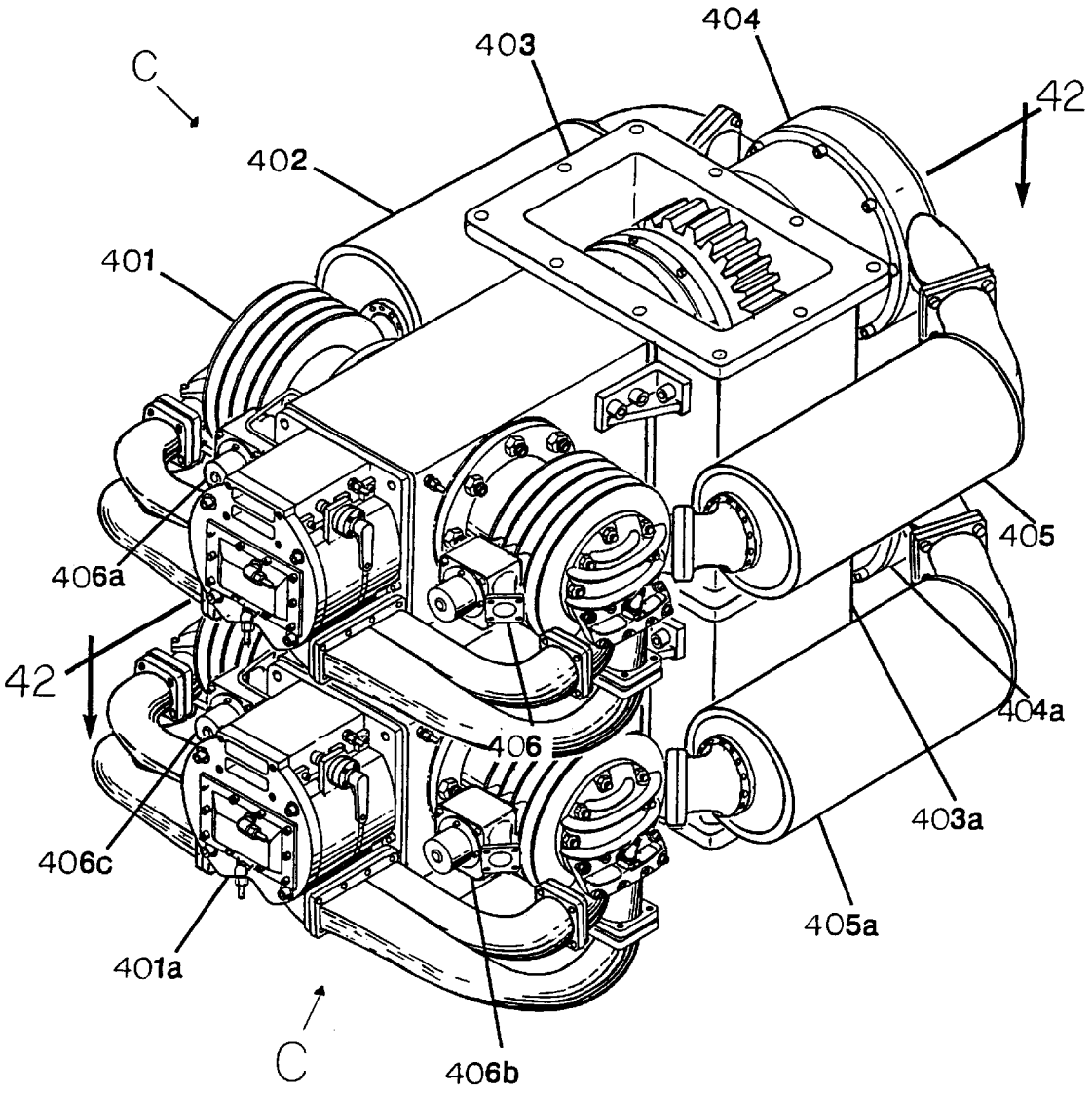
FIG. 41 is an isometric view of a third embodiment of the engine showing the top, the front and one side of a compound variant of the engine.

Referring first to FIG. 41 this figure illustrates two compound engines C stacked one on top of the other to form a complex engine array. Each compound engine C includes an epicyclic gear crank engine module 401, 401*a* coupled to the forward side of its respective coupling module 403, 403*a*; a power recovery turbine 404 ,404*a* coupled to the aft side of the coupling module; left and right combustors 405, 402 for the upper compound engine, and similar "a" suffixed numbers for the lower compound engine; and lower cylinder air intake valves 406, 406*a* for the upper compound engine and 406*b*, 406*c* for the lower compound engine. While it is possible to utilize the compound engine singly, the benefits of stacking at least two units vertically to form a complex engine array is very significant, as will become apparent later. Output power from the compound engine, whether used singly, or in combination, is taken out of the top or bottom of the coupling module, depending upon the particular application of the engine.

Figure 42:
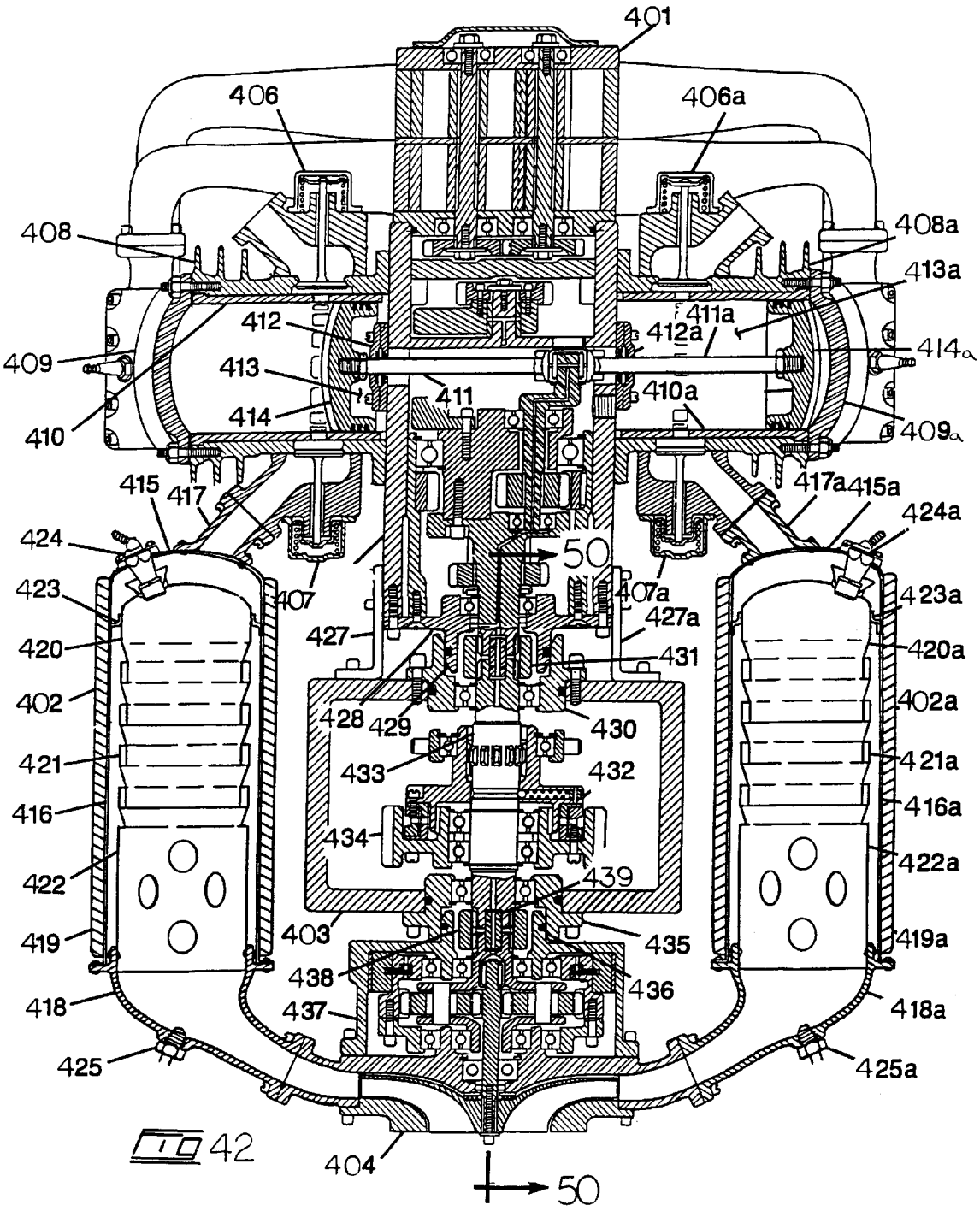
FIG. 42 is a partial cross sectional view taken substantially along the cutting plane designated 42—42 in FIG. 41 and illustrates the details of the upper compounded epicyclic gear crank engine module, its associated combustor, combustor fuel injector, and power recovery turbine as well as the upper and lower engine module interconnection details.

Referring next to FIG. 42, this figure illustrates the gas flow through the compound engine, as well as illustrating the coupling details between the basic epicylcic gear crank engine module 401 and the coupling module 403, and between the power recovery turbine 404 and the coupling module 403. In the basic epicyclic gear crank engine, in either the spark or compression ignition variants, as described in the previous embodiments, the air and blow-by gases which collect in the lower cylinder cavities 413, 413*a* flow back and forth through the crossover channels in the main housing 426. Exhaust valves 407, 407*a* in the basic engine prevent the blowby gases that escape past the piston rings, as well as any seepage oil that may escape past the connecting rod seals, from exiting to exhaust.

However in the compound engine 401 as described herein, certain changes are made to the basic epicyclic gear crank engine so that the lower cylinder chamber acts as a cooling air pump. The crossover channels of the previous embodiments are eliminated and, as the pistons 414, 414*a* move back and forth in the respective cylinders 408, 408*a* the volumetric size of the lower cylinder cavities 413, 413*a* is constantly changing. The result is that on the piston up stroke in a direction towards the cylinder heads 409, 409*a* air is sucked into the lower cylinder cavity via intake valves 406, 406*a*. On the subsequent piston down stroke this air is expelled out of the lower cylinder cavity through exhaust valves 407, 407*a*. And since the seals in stuffing box 412, 412*a* of FIG. 42 which serve to prevent any lubricating oil in the main housing from escaping via the connecting rods also prevent any air escape through them and since the crossover channels are eliminated in the compound engine, the clean unspent air that is sucked into the lower cylinder cavities, and which then passes through ports 462 in FIG. 46 that circumscribe the cylinder liners 410, 410*a* as the piston travels up the cylinder, also passes through these same ports on the down stroke, this air effectively cools the lower-cylinder surfaces.

The lower cylinder cooling air exits the cylinder via exhaust valves 407, 407*a* during the piston down stroke, followed by the spent exhaust gases as soon as the piston has travelled to the bottom of the cylinder and uncovers the exhaust ports in the cylinder liner. The spent exhaust gases are then swept out of the cylinder by the scavenge air that enters the cylinders via cylinder heads 409, 409*a*. Since neither the scavenge air, which enters the cylinders via the cylinder head nor the lower cylinder cooling air which enters via the lower cylinder cooling air intake valves 406, 406*a* have been used for combustion, the ratio of spent to unspent gases exiting the cylinder via exhaust valves 407, 407*a* is in the order of approximately three to one. Further since the basic epicyclic gear crank engine is designed to operate in a very lean burning mode, the total amount of unspent gases is more in the nature of four to one.

FIG. 42 further illustrates the left and right hand combustors 405 and 402. Since the right and left hand combustors are similar, only the left hand combustor will be described. Combustor 405, FIG. 41 consists of an outer combustion chamber comprising combustor outer dome 415 at a first end, FIG. 42 which is integral with outer shell 416 and an inner combustion chamber comprising inner dome 420, four corrugated sections 421 and an exit section 422 all of which are welded together. Both the outer and inner combustion chambers are riveted to exit manifold 418 at a second end of the combustor. The inner combustion chamber is supported inside the outer chamber at the second end by means of support clips 423. Fuel is injected into the inner combustion chamber by fuel injector 424 mounted on the first end of the combustor. Insulation blanket 419 surrounding the combustor serves to inhibit heat loss, and the temperature at the exit is sensed, for indicating purposes, by means of thermocouple 425.

During operation of the compound engine, exhaust gases exiting the epicyclic gear crank engine module consist of a mixture of hot exhaust gases, scavenge air and lower cylinder cooling air. These gases enter the combustor via inlet pipes 417, 417*a* connected to the exhaust valves of the respective cylinders and travel down the combustor between the walls of the inner and outer chambers. The gases gradually enter the inner combustion chamber via the corrugated sections 421, 421*a* and the holes in the exit sections 422, 422*a*. Since the three previously mentioned gas flows enter the combustors in largely separate bursts, simply injecting extra fuel into the inner combustion chambers is sufficient to cause the added fuel to ignite. To further ensure that ignition takes place it is possible to coat the walls of the inner combustion chambers with palladium or platinum to aid in light-off.

Referring next to FIGS. 43 and 44, these figures illustrate two alternate methods of fuel injection to be further described below. While the conventional gas turbine type combustor, fuel injection and delivery system would likely be preferred for light aircraft and helicopter applications wherein the combustor would be in operation at all times that the basic epicyclic gear crank is running, for automotive and similar applications a less costly method of fuel injection and delivery would be preferred. As well, to ensure that light-off in the combustor occurs spontaneously and without requiring an external fuel ignition system, it is advantageous to combine the functions of the combustor with those of the conventional catalytic converter into a single catalytic combustor unit. This catalytic combustor is illustrated in FIG. 45.

In the catalytic combustor shown in FIG. 45 the inlet and outlet details are the same as those for the gas turbine type combustors 405, 402 of FIG. 41; however the internal details are different. The catalytic combustor consists of an outer casing 455 and an integral dome 447 to which the inlet pipe 457 is attached at a first end of the combustor. A cylindrical ceramic insulator 449 is constrained inside the outer casing for purposes of heat retention. A perforated titanium sheet metal cup 450 is held in place by a collar at its aft end adjacent the bottom exit manifold 452 at a second end of the combustor and contains an integral sheet metal dome. A similar perforated titanium cone 454 is riveted at the bottom exit manifold 452, which is similar to that of exit manifolds 418, 418*a* in combustors 405, 402 FIG. 41. Exit manifold 452 is riveted to outer casing 455 and thereby constrains the other components in place. The space formed between cup 450 and cone 454 is filled with palladium or platinum coated balls. A spiral shaped deflector 456 which is spot welded about an outer face of the cup 450 serves to cause the incoming gases to follow a spiral path as they progress towards the aft end, thereby ensuring that the separate bursts of combustion gases, the fuel mixed unspent air and the scavenge air are well mixed before they pass through the catalytic portion of the catalytic combustor, and this ensures that they are completely burnt.

Referring next to FIG. 44, this figure illustrates the placement of fuel injector 446 mounted on an outer end of each cylinder, if an automotive type electronic fuel injection system is used. In this instance, fuel is injected into the cylinder just after the piston has uncovered the exhaust ports 462, of FIG. 46 at the bottom of the cylinder liner. The timing of the fuel injection in this instance coincides approximately with the spark plug firing of the opposite cylinder and before the scavenge valve opens. This means that fuel is injected into the already burning gases as they are exiting the cylinder followed by the scavenge air flow. This burning fuel/air mixture first enters surge chamber 448 of FIG. 45 at the first end of the combustor and is then forced to spiral down through the combustor and in doing so it passes through the catalytic converter balls 451 where burning is enhanced. The burnt gases then pass into outlet chamber 453 at the second end of the combustor, and then to the inlet of the power recovery turbine to be later described.

Because an ignition system is not used in the compression ignition variant of the engine, an electronically timed fuel injector cannot be used, and instead the continuous type shown in FIG. 43 would be used. This method though can also be used on the spark ignition variant. In this system , fuel is injected continuously in varying amounts into the air intake manifold 443 ahead of the lower cylinder cooling air intake valves 406, 406*a*. In this instance, a variable rate fuel injector 441 is mounted in injector housing 440 and is controlled by control arm 442. During operation, fuel is continuously injected at rates controlled by the operator, including zero into the intake manifold 443. The intake manifold 443 splits into two separate pipes 444 and 445 which feed respective intake valves 406, 406*a*.

Because each cylinder is alternately taking in cooling air into the lower cylinder cavity on the piston up stroke, the air flow past the fuel injector 441 is more or less constant. This fuel-mixed air enters the lower cylinder cavity through the exhaust ports 462 FIG. 46 at the bottom of the cylinder liner, where it is heated and the fuel is further atomized. On the piston down stroke, this fuel/air mixture exits the cylinder through the same exhaust ports just ahead of the burning combustion gases. As in the case with electronic fuel injection, these unspent gases are ignited by the burning combustion gases as they pass through the catalytic combustor.

Whether the electronic fuel injection system, as shown in FIG. 44, or the continuous method, as shown in FIG. 43, is used the net result is essentially the same. In both cases extra fuel is injected into the air flow and mixes with the already burning combustion gases as well as the unspent scavenge and lower cylinder cooling air. This extra fuel is burnt, aided by the catalyst as it passes through the palladium or platinum coated balls and the catalytic effect ensures that virtually all fuel and seepage oil is burnt. By using a catalytic combustor in the gas path before the power recovery turbine, this ensures that no unspent hydrocarbons are emitted to the atmosphere. In addition to ensuring that all fuel passing through the catalytic combustor is burnt and converted to useful power, the catalytic combustor also acts to attenuate sound, so that neither a separate muffler, nor a separate catalytic converter is required.

Figure 46:
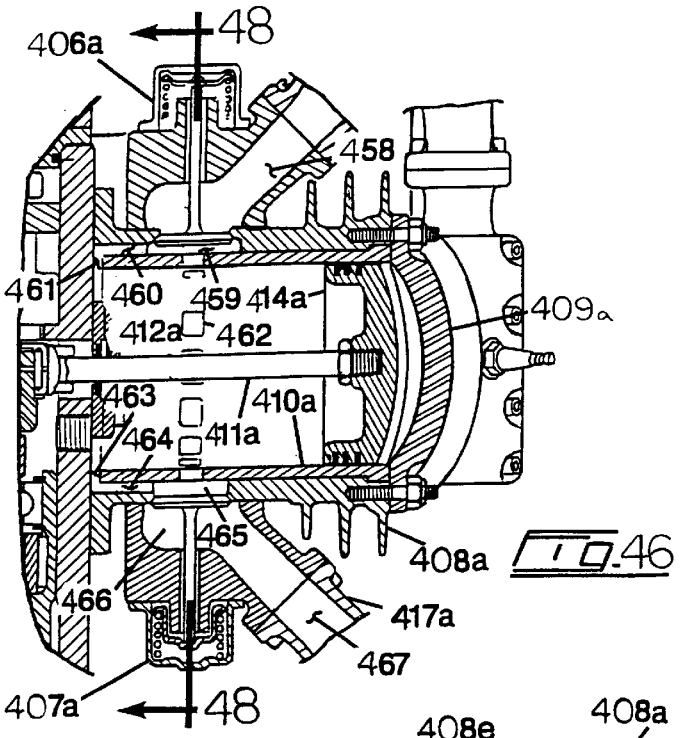
FIG. 46 is a partial cross sectional view of the right hand cylinder details of the third embodiment of the epicyclic gear crank engine, and illustrates the changes required to the cylinder in order to provide lower cylinder cooling as required for use in the compound engine.

Turning next to FIG. 46, this figure illustrates those changes that are required to be made in the cylinder of the basic epicyclic gear crank engine to permit an air flow to be induced into the lower cylinder cavity below the piston for purposes of internal cooling, whether or not fuel is injected into the airflow upstream of the basic epicyclic gear crank engine. As can be seen in FIG. 46, once the piston has moved down the cylinder to the point where exhaust ports 462 are covered by the piston there is no place for the entrapped gases to flow to. In the basic epicyclic gear crank engine, crossover channels through the main housing are used to allow the entrapped gas to flow back and forth through the main housing but these crossover channels are eliminated when lower cylinder cooling is used. While most of the gases entrapped below the piston are forced out through exhaust port 462 and thence to exhaust , once the piston has covered up the exhaust ports 462 as it nears the bottom of the stroke, the remaining residual gases have no place to escape to.

In order to provide an escape path for these residual entrapped gases, channel 464 is cut in the cylinder wall to connect the lower cylinder cavity to the exhaust valves once the piston has blocked off the exhaust ports 462. At the bottom of the piston stroke, when the exhaust ports are covered by the piston the residual entrapped gases then flow through the pathway 463 between the bottom of the cylinder liner 410*a* and main housing 426, of FIG. 42 and thence through channel 464 and chamber 465 past exhaust poppet valve 482 of FIG. 48 to exhaust. Similarly, when the piston initially starts its up stroke, cooling air flows past intake valve 480 of FIG. 48 and then into the lower cylinder cavity through chamber 459 and channel 460 and then through the pathway 461 between the bottom of the piston liner and the main housing and into the lower cylinder cavity. On the remainder of the piston up stroke as soon as the exhaust ports 462 are again uncovered the incoming air then passes through these ports and into the lower cylinder cavity.

Figure 47:
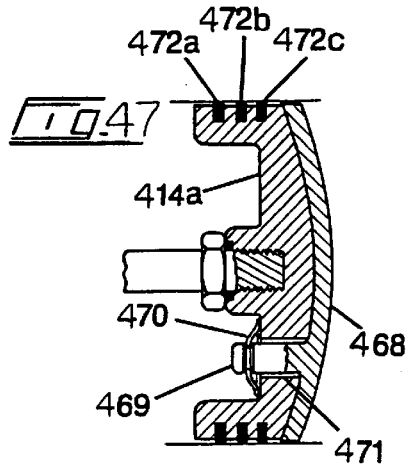
FIG. 47 is an enlarged partial cross sectional view of the right hand piston shown in FIG. 46.

Turning next to FIG. 47, this Figure illustrates the method for attaching the ceramic piston liner 468 to piston 414*a*. The piston liner typically contains three equally spaced standoff connectors 469 which mate with similarly spaced holes 471 drilled into the face of the piston. Spring clips 470, engage a circular groove cut into the standoffs and engage a rear face of the respective pistons to hold the liners in place. To prevent leakage gases from escaping between the piston liner and piston, a bonding material is applied during assembly to prevent any such leakage. It should be noted that since the engine operates on a two stroke cycle, there is never any force exerted on the piston liner such as to cause the liner to separate form the piston. During the top half of the cycle, when negative acceleration occurs, the combustion cycle is under pressure from compression followed by combustion. At the lower half of the cycle, forces of negative acceleration tend to hold the liner firmly against the piston. Thus, except during starting there is never any tendency for the liner to come loose.

Figure 48:
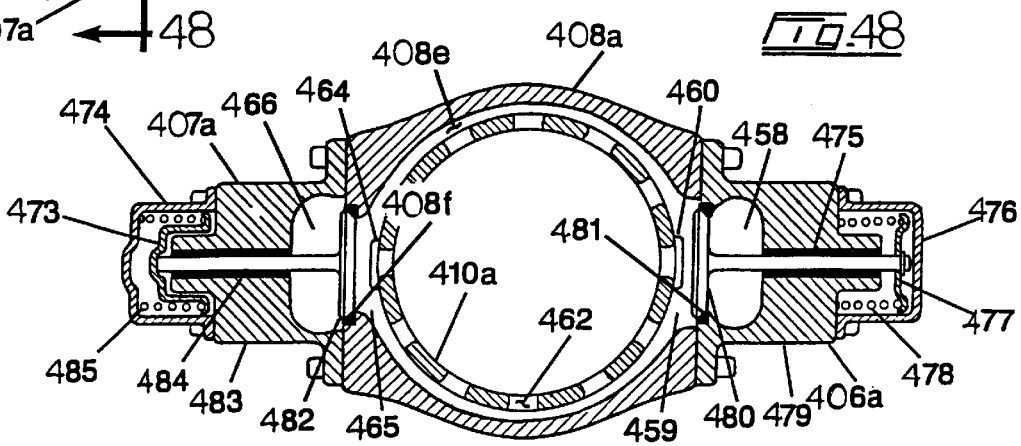
FIG. 48 is a cross sectional view taken substantially along the cutting plane designated as 48—48 in FIG. 46.

Turning next to FIG. 48, this figure illustrates the details of air intake valve 406*a* and exhaust valve 407*a* which are substantially the same as in the basic engine. Intake valve 406*a* consists of valve housing 479, poppet valve 480, self lubricating valve guide 475, compression spring 488 spring keep 477 and cover 476. When closed, exhaust valve 480 is in contact with valve seat 481 which is a shrink fit in valve housing 479. Exhaust valve 407*a* consists of valve housing 483, self lubricating valve guide 484, poppet valve 482, compression spring 485, spring keep 473, and cover 474. Valve seat 408*f* is a shrink fit in cylinder 408*a*. Channel 408*e* circumscribes the complete inner diameter of cylinder 408*a* so that the incoming air is able to enter the cylinder via the exhaust ports 462, and is also able to exit via these same ports.

Figure 49:
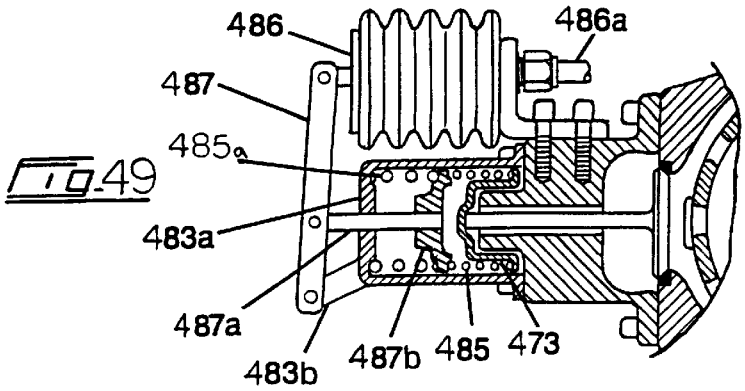
FIG. 49 is a partial cross sectional view of an alternate exhaust valve design to that shown in FIG. 48 and is intended for use in applications where compensation for combustor back pressure is required.

Turning next to FIG. 49, this figure illustrates the exhaust valve configuration deployed when it is required to provide compensation for combustor back pressure felt inside the cylinder at the end of the scavenge portion of the cycle. This exhaust valve arrangement is substantially the same as in FIG. 48 with the exception that the force required to open the exhaust valve is made variable by means of movable spring seat 487*b*. A cover 483*a* mounted on an outer face of each exhaust valve houses a spring seat 487*b* therein, being sandwiched between compression springs 485 and 485*a*. The spring seat is moved an incremental amount by the action of bellows 486 acting through lever 487, rod 487*a* and lever support 483*b*, which is integral with cover 483*a*. The bellows 486 is connected to the combustors in order to sense the back pressure that is felt at the exhaust valve and to compensate for it.

During normal operation when the combustors are not lit, no pressure is felt in the bellows, and the spring seat is at the position shown, with maximum force applied to spring 485 to hold the exhaust valve closed. In this instance, the gas pressure inside the cylinder required to open the exhaust valve will be at the maximum. However, when the combustors are lit, the bellows, acting through the lever 487 and rod 487*a*, causes the spring seat 487*b* to move in a direction away from the cylinder against the force of compression spring 485*a* to lessen the spring force applied to close the exhaust valve. In this later instance, the back pressure inside the combustor will be acting against the exhaust valve; however the spring force compensation will result in the pressure inside the cylinder remaining essentially the same. In this way any potential problems of pre-ignition caused by an increase in compression ratio when the combustors are lit will be alleviated.

Figures 50, 51:
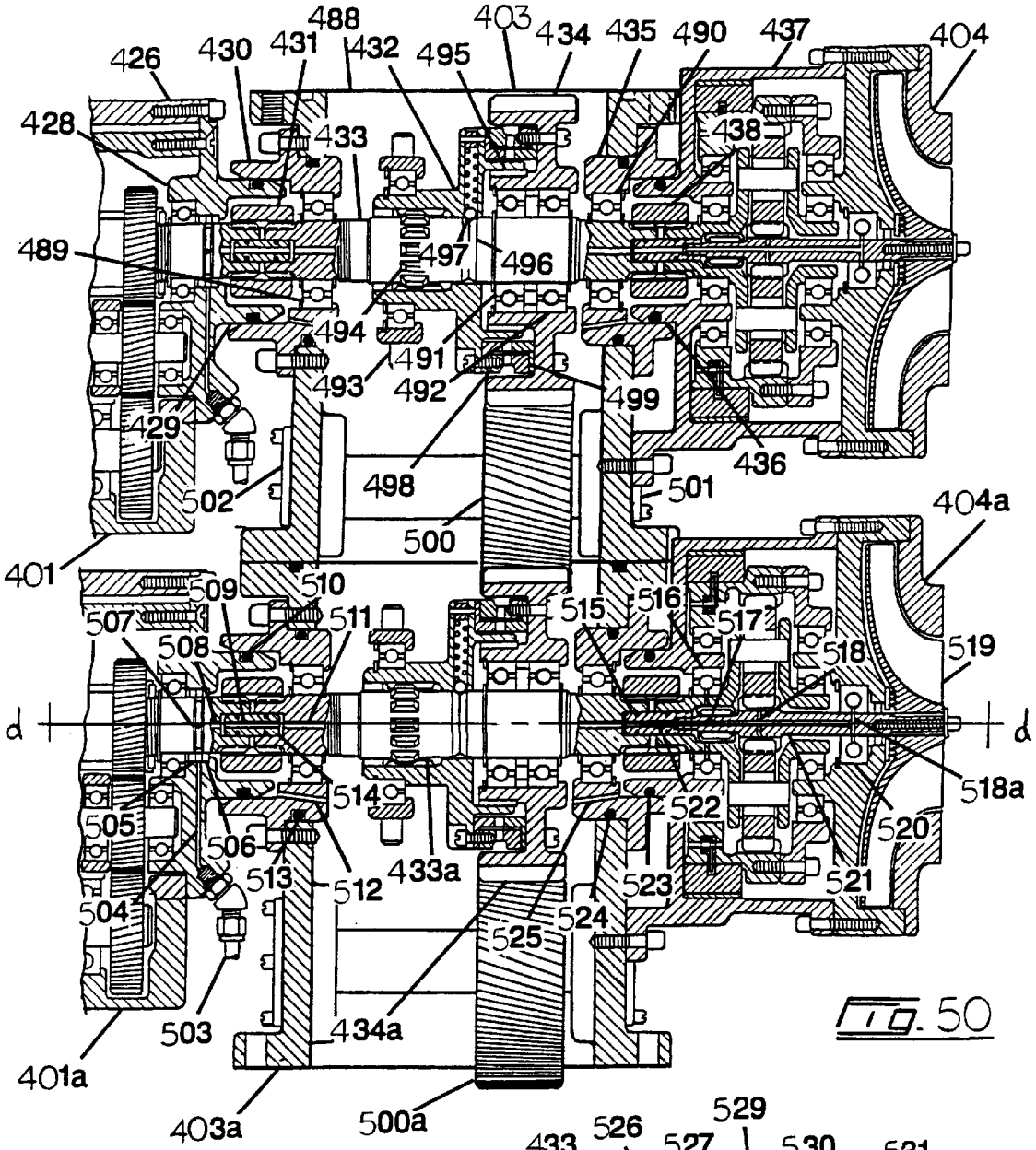
FIG. 50 is a cross sectional view of the transfer case which serves to connect upper and lower compound engine modules of the third embodiment.
FIG. 51 is an enlarged partial cross sectional view of the clutch mechanism connecting the output shaft to the transfer gear of the transfer case for use with the engine of the third embodiment.

Turning next to FIG. 50 this figure illustrates the interconnection details between the two epicyclic gear crank modules 401 and 401*a* of FIG. 41 and their respective transfer cases 403, 403*a* as well as the interconnection details of the respective power recovery turbines 404, 404*a* to the transfer case. FIG. 50 also illustrates the method of coupling the transfer gearing together, as well as the method used to permit selective operator-initiated decoupling of the individual epicyclic gear crank engine modules in the event of an engine malfunction. In addition, this figure illustrates the common lubrication system used to provide lubricaton to both the engine modules and the power recovery turbines.

When used as a constituent part of the compound engine, each engine module employs a modified end cap 428 which contains an integral inner coupling adapter 429 which in turn contains an integral O-ring groove in which O-ring 510 is inserted. This coupling adapter mates with outer coupling adapter 430 which is bolted to the upper transfer case and is similarly sealed. The outer coupling adapter 430 also serves as the support for bearing 489 which in turn supports transfer shaft 433 at the forward end. Transfer shaft 433 is spline-coupled to the output shaft of the epicyclic gear crank engine module by means of spline coupling 431. Transfer shaft 433 is supported at its aft end by means of bearing 490 and bearing support 435. Power recovery turbine housing 437 contains an integral inner couplng adapter 436 which mates with an outer coupling adapter integral with bearing support 435 and which is similarly sealed by means of an O-ring seal 523. The output shaft of the power recovery turbine is similarly spline-coupled to the transfer shaft 433 by spline coupling 438.

Transfer gear 434 serves primarily to interconnect the upper transfer shaft 433 to the identical transfer shaft on the lower module via idler gear 500. Main transfer gear 434 is bearing-mounted on transfer shaft 433 by means of bearings 491 and 492 such that it is rotatable relative to the shaft and is connected to the identical main transfer gear 433*a* on the lower transfer case by means of gear 500 which is bearing supported at each end, and is constrained laterally by means of bearing caps 501 and 520. Main transfer shaft 433 contains integral spline teeth 494 which engage with corresponding spline teeth on dog clutch assembly 432. The dog clutch assembly is thus mounted on the shaft 433 such that it is slideable axially between an engaged position and a disengaged position with mating dogs 499 of the transfer gear. When the dog clutch is engaged with the mating dogs on main transfer gear 434 it is held engaged by means of ball 497 which is urged into groove 496 on transfer shaft 433 by a spring. When the dog clutch is moved away from the transfer gear to the disengaged position, the ball 497 is released from the groove and the dog clutch is released from the mating dogs 499. The main transfer gear is thus free to rotate relative to the transfer shaft. The dog clutch is supported on its aft end by self lubricating bearing 495.

The lubrication system for the compound engine will be described next. Since the upper and lower epicyclic gear crank engine modules, transfer cases and power recovery turbines are identical only the lubrication system for the lower module will be described. In the lower module, lube oil under pressure enters the aft end of the epicyclic gear crank engine module 401*a* via lube oil pipe 503 mounted on the housing. From there it is fed via lube oil channel 504 and enters an annular cavity formed between oil seals 505 and 506 surrounding the output shaft. A mating groove 507 and radial drillings cut into the engine output shaft connect to a central drilling 509 through its axis. By this means, lube oil is transferred into central drilling in main transfer gear shaft 433*a* and which drilling spans the entire length of the shaft. Any seepage oil lost past the O-rings in oil transfer tube 514 where the output shaft is coupled to the transfer gear shaft is returned to the transfer case via drilling 512 connected between the coupling and the transfer case.

The lube oil that enters drilling 511 at the forward end of transfer shaft 433*a* passes through drilling 522 in oil transfer tube 515 which rotatably couples the lubrication channels between the transfer shaft and the power recovery turbine and thence into drilling 517 in shaft 521. The turbine shaft 521, which supports power recovery turbine 519 is supported by needle bearing 538 of FIG. 52 at its forward end and by bearing 520 at rear. Radial drillings 518 and 518*a* serve to supply lube oil to the internal bearings and gears in the power recovery turbine as well as to lubricate rear support bearing 520. A reduced diameter front portion of power recovery turbine support shaft is a close tolerance fit in oil transfer tube 522. The rate of rotation of the power recovery turbine to that of the transfer shaft is in the order of 10 to 1; however, since a clearance fit is used between lube oil transfer tube 515 and shaft 521, there is some oil seepage past these parts which is desirable. This seepage oil serves to lubricate front bearing 516 as well as needle bearing 538 of FIG. 52. The lubrication details of the upper and lower coupling modules are identical.

Turning next to FIG. 51, this figure illustrates the details of the dog clutch mechanism which serves to lock transfer shaft 433 to transfer gear 434 for rotation about a drive axis d—d extending through the transfer shaft. The transfer shaft 433, the output shaft from the epicyclic gear crank, and the turbine shaft 521 all extend axially along the drive axis d—d. The dog clutch mechanism consist of housing 535 which is spline coupled to transfer shaft 433 and is supported on the front end by sliding bearing 535*a* and at the rear end by self lubricated bearing 534. Dog clutch half 530 which is attached to the dog clutch housing 535 engages mating dog clutch half 532 which is similarly attached to transfer gear 434. These mating dog clutch halves contain a series of teeth around the circumference so as to transfer the torque equally on all teeth. Similarly constructed hold off pawls prevent the dogs from engaging except at one specific point in the rotation to ensure that when engaged the two engines operate in sync. When in the engaged position the dog clutch is held engaged by steel ball 497 in groove 496 for fixing the transfer gear to the transfer shaft such that they rotate together. Force is applied to ball 497 by compression spring 528. Spring 528 is constrained in a drilling in housing 535 by plug 529. The dog clutch is disengaged by moving it away from the transfer gear by manually grasping collar 527 which is mounted about the dog clutch by associated bearing 526 and displacing the collar axially along the transfer shaft.

Turning next to FIG. 52 this figure illustrates the details of the power recovery turbine assemblies 404, 404*a* of FIG. 41. Each power recovery turbine consists basically of a power turbine, a sun and planetary reduction gear set and an overrunning clutch. The turbine wheel 546 is splined to shaft 521 and is secured by means of a cap screw. The turbine is housed in end casing 554 and end cap 548 which are both bolted to the turbine casing 537. The turbine shaft and turbine wheel are rotatably supported within the casing 554 by rear bearing 520 at the rear and by needle bearing 538 at the front. The gear set couples the turbine shaft to the output shaft of the epicyclic gear crank and is both oil and air sealed by means of oil seal 544 and air seal 545, the knife edges of which contact lead sealing plate 543 surrounding the turbine shaft adjacent the turbine wheel. Rotation of the turbine shaft is transferred to the planet gears 551 by gear 541 which is integral with shaft 521. The planet carrier, which comprises two bolt together pieces 549 and 552, is rotatably supported within the turbine casing by means of bearings 516 and 516*a*. The planet carrier mounts on the drive axis for rotation with the output shaft. The planet gears 551 are supported in the planet carrier offset from the drive axis by means of pins 550 and needle rollers 551*a* such that the planetary gears mesh with the ring gear and the gear 541 on the turbine shaft at all times.

During normal operation ring gear 539 is held stationary in relation to the casing and the sun and planetary gears act only as a reduction gear set; however during engine start up, it is desirable to allow the power recovery turbine to lag behind the engine so as not to cause excessive loading on the engine. This is achieved by means of an overrunning clutch mechanism which is shown in detail in FIG. 53. Ring gear 539, of FIG. 52 is integral with clutch housing 536 and bolts to support 540 to form a unit which is rotatably supported within the casing. This complete unit is supported by means of bearings 553 and 542.

Turning next to FIG. 53, this figure illustrates the details of the overrunning clutch mechanism which is mounted between the clutch housing 536, FIG. 52, and the turbine casing 537. The overrunning clutch mechanism is mounted within the clutch housing 536 which supports the ring gear for the sun and planetary gear set about the drive axis. The clutch housing contains cutout sections 536*a* which house springs 558 which are attached to the clutch housing by means of spring pins 559. The clutch housing 536 also contains ramp portions 556 about a periphery on which clutch shoes 557 are slidably mounted. The clutch shoes slide on a clutch drum 555 surrounding the clutch housing and is a press fit in turbine casing 537. The clutch housing 536 consists of two separate pieces, held together by means of rivets 556*a* and which is required for purposes of assembly. During engine start up the clutch shoes ride down the ramp portions to a disengaged position where the shoes disengage from the drum allowing the clutch housing to turn in a counterclockwise direction as shown in FIG. 53. Once the turbine has overtaken the engine however, the housing attempts to turn in a clockwise direction. When this happens, the clutch shoes 557 ride up the ramp portions to an engaged position where the shoes are wedged between the ramps 556 and drum 555 to hold t he housing stationary in relation to the turbine ho using , thus fixing the ring gear in place.

Turning next to FIG. 54 this figure illustrates the gas flow inlet to the power recovery turbine as well as the turbine assembly mounting details. The power recovery turbine assemblies are attached to the rear of the transfer cases 403, 403*a* of FIG. 41 by means of standoff legs 537*a*, 537*b* and 537*c*. Inlet manifolds 560, 560*a* direct gases received from the combustors to drive the turbine and are connected to the combustors by means of flanges 560, 560*a*.

Figure 55:
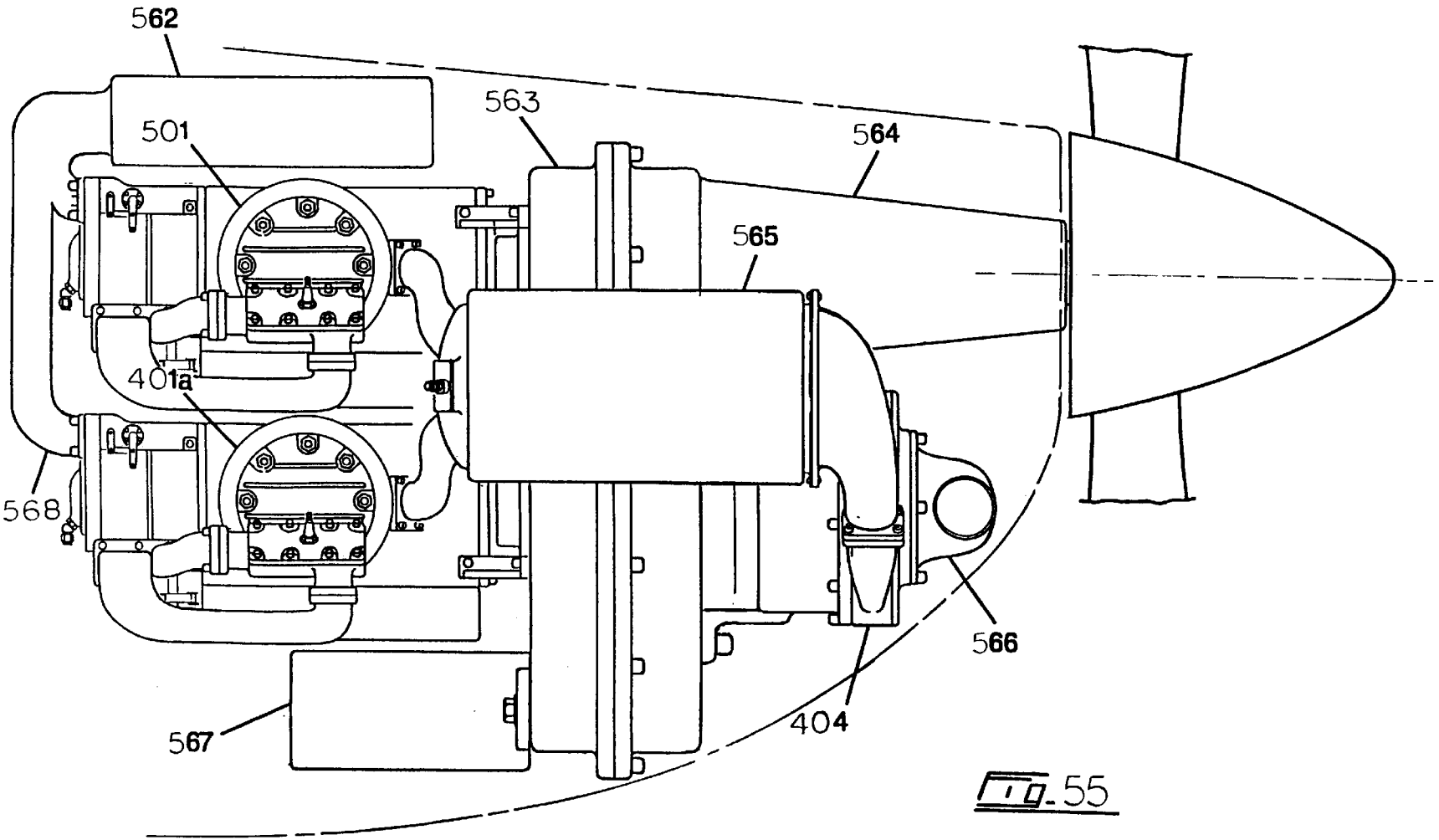
FIG. 55 is a side elevational view of two compound engines in a vertically stacked engine array as used in a typical light aircraft application.
Figure 56:
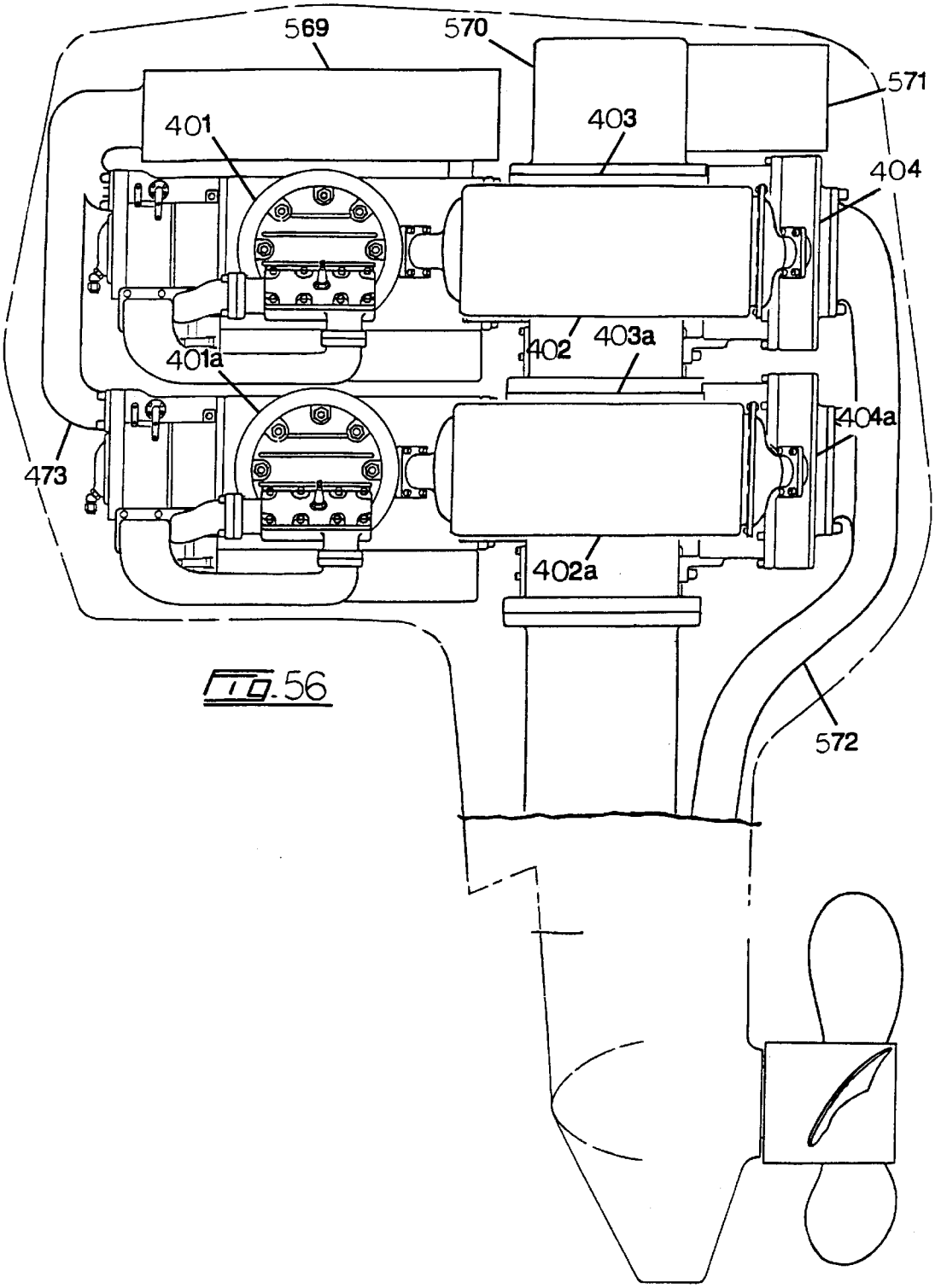
FIG. 56 is a side elevational view of two compound engines in a vertically stacked engine array as used in a typical outboard motor application.

Turning next to FIGS. 55 and 56, these figures illustrate two typical applications of the compound engine. In FIG. 55 the compound engine is shown in a light aircraft installation, wherein the output power is taken out of the top. This installation comprises epicyclic gear crank engine modules 401, 401*a*, a single combustor 565 on each side, propeller shaft housing 564, a single power recovery turbine 404, exhaust manifold 566, a typical electric starter 567, engine inlet manifold 568 and air cleaner 562. FIG. 56 shows the compound engine as used in a boat outboard motor. In this installation, two epicyclic gear crank engine modules 401, 401*a* are similarly used along with separate combustors 402, 402*a* on each side, two transfer cases 403, 403*a*, two power recovery turbines, 404, 404*a*, exhaust manifold 572, engine intake manifold 473, air cleaner 569, accessory drive 570 and starter 571. While these figures illustrate two typical applications many other application are possible.

In the epicyclic gear crank spark ignition engine, a supercharged scavenge intake air flow is used which is completely separate from the fuel-mixed air flow. Since the exhaust gases are ported out of the engine at the bottom of the cylinder and the scavenge air enters through the head coinciding with the portion of the cycle that the exhaust ports are uncovered by the piston, all spent gases are swept out through the bottom of the cylinder, the net result being a clean-burning, two stroke, high by-pass engine. Unlike the situation in a conventional two-stroke engine, the clean fuel-mixed air is never in contact with the spent exhaust gases because of the complete scavenging of the exhaust gases before the fuel/air mixture enters the cylinder.

However, the mere fact that the spent gases are forcefully swept out of the cylinder after completion of the combustion portion of the cycle, this means that a significant quantity of unspent air is also exhausted. Since the engine is designed to operate in the lean-burn range, less than half of the air flowing through the engine is actually used for combustion. In other words, there is a significant amount of oxygen that is not converted to carbon dioxide in the engine. But besides sweeping the spent exhaust gases out of the cylinder, the scavenge air also serves to cool the cylinder head and cylinder walls.

While internal cooling of the cylinder chamber between the lower portion of the piston and the main housing is advantageous in the basic epicyclic gear crank engine, it is much more so when the epicyclic gear crank engine is compounded with the gas generating and power turbine features of a gas turbine engine. By the simple expedient of adding a spring-loaded inlet poppet valve on the side of the cylinder opposite the exhaust poppet valve, and blocking of the inter cylinder crossover channels, an additional cooling air flow, primarily dedicated to cooling the exhaust areas of the cylinder would be created. This lower-cylinder cooling air flow, when added to the scavenge air flow, results in a volume of unspent air flowing through the engine that is, in fact, much larger than the spent air flow volume resulting from combustion and is capable of being harnessed to add a very significant amount of added power by the simple expediency of adding fuel to the burning exhaust gases.

When these scavenge and lower cylinder air flows are used in a combustor to provide extra power, it is obvious that it is advantageous to take measures to inhibit the heat loss through the cylinder walls and cylinder head. To minimize any heat loss through the cylinder walls in the cylinders incorporate a machinable-ceramic cylinder liner. In a conventional internal combustion engine, the piston to cylinder sidewall forces due to crank throw tend to make ceramic cylinder liners prone to failure; however, in the present invention the pistons do not exert any crank angle induced forces on the cylinder sidewalls and are, therefore, practicable in this application.

Similarly, it is advantageous to employ the ceramic liner on the cylinder head. Because the scavenge air flow entering through the cylinder head tends to cool it, and because the exhaust gases are not expelled through the cylinder head, heat loss through the cylinder head is not as great as through the cylinder walls. Nonetheless, any reduction at all in heat loss through the cylinder head adds to the amount of power that is potentially recoverable by the power recovery turbine.

In order to harness the already heated extra unspent air flow in a manner analogous to that of an afterburner in a thrust jet gas turbine engine, fuel must be injected into the exhaust gas flow. As in the case of an afterburner, the added fuel is injected such that the fuel is ignited and burns in the combustors spontaneously, rather than requiring a separate ignition system.

The first possible method of injecting the fuel into the combustor is exactly the same way that is done in a conventional gas turbine engine. As far as the fuel injection itself is concerned, this method is the simplest; however, it would similarly require a gas turbine type fuel delivery system which would be expensive. However, this system is the preferred method for light aircraft and helicopter applications, regardless of the higher cost. In aircraft applications, the combustor would always be lit and fuel delivered at all times, although at varying rates, so that carboning up of the fuel injector would not be a problem. In automotive applications, where intermittent operation would generally be the rule, a simpler and lower cost method of fuel injection is desired.

The second possible method for injecting fuel into the combustor is to inject it directly into the burning gases in the cylinder during the exhaust portion of the cycle. The desired initiation point of the fuel injection coincides very closely with the timing of the spark plug firing in the opposite cylinder. Thus, if electronic fuel injectors are used, the fuel injection timing would be controlled fully by the ignition system. This system would be able to utilize an automobile-type electronic fuel injection system and would be suitable for both aircraft and automotive applications. However, unless the injectors were used continuously, carbon build-up could become a problem.

The third method for combustor fuel injection, and the one most likely preferred for automotive applications, injects the fuel into the intake manifold leading to the lower cylinder intake poppet valves. A spring-loaded poppet valve is used to allow naturally aspirated air to flow into the lower portion of the cylinder chamber below the piston as the piston moves up the cylinder on the compression stroke. This air flows into the cylinder through the exhaust ports at the bottom of the cylinder liner, thereby further cooling the exhaust ports and channels. On the piston downstroke, the intake valve is held closed by spring pressure, and the cooling air flows out through the exhaust ports, channels and exhaust valve.

By injecting fuel into the cooling air manifold feeding both cylinders, it means that the air flow past the fuel injector is continuous, thus a continuous-type fuel injector is used. In fact, the most appropriate type of fuel injector would be the one used in the first embodiment of the epicyclic gear crank engine previously described. And since, with this injector, a constant pressure fuel supply is used, and the rate of fuel injection is controllable over a wide range by means of progressively uncovering a series of spray orifices, then obviously the same fuel supply system could be used for both fuel injectors, and would, therefore, be by far the less costly method.

The use of the continuous-type of fuel injection into the air stream ahead of the lower cylinder intake poppet valves results in some significant benefits over the two other methods described. Firstly, by injecting the combustor fuel into the air stream ahead of the intake poppet valves, the fuel aids in cooling the lower cylinder and the fuel, in turn, is more completely atomized. Further, since the fuel injector is located in the lower cylinder cooling air intake manifold, rather than being located in constant contact with the burning gases, there would be no tendency whatever to carbon up.

In either of the two later methods of combustor fuel injection, a combustion liner is not specifically required; although it is a requirement in the first method wherein the fuel is injected directly into the combustor assembly. However, in the two methods wherein the fuel is injected upstream of the combustor, it is still advantageous to use a combustion liner coated with a catalytic material of palladium or platinum. Alternately, the especially designed combustor could be used wherein small palladium or platinum coated balls would be packaged in the space between the combustion liner and outer lining so that the combustor would act as a combined combustion chamber, catalytic converter, and sound attenuator. This would ensure complete fuel combustion even at very low power levels when only small quantities of fuel are injected. It is also important to note that, just like the case of an afterburner in a thrust jet engine, no separate ignition system is required for any of these methods of fuel injection, other than that required for the epicyclic gear crank engine modules themselves.

In order to be able to stack two or more engine modules together, and yet to enable both the epicyclic gear crank engine modules and the power recovery turbine to be interconnected to a common output drive, a transfer case is inserted between the engine module and the power recovery turbine with the combustors located on either side. This arrangement permits a mechanical decoupling mechanism to be used in conjunction with the transfer gearbox so as to permit selective decoupling of any of the epicyclic gear crank engine modules without affecting the other module. This ability to selectively decouple an engine module means that a catastrophic failure of one epicyclic gear crank engine module would not impair the operation of the other one.

While it is desirable to have direct coupling between the power recovery turbine and the epicyclic gear crank engine modules, this direct coupling is detrimental during startup. In order to allow the power recovery turbine to lag behind the EGC engine without providing undue drag during initial engine start, a sprague, or overrunning, clutch is used. This overrunning clutch permits the epicyclic gear crank engines to over-run the power recovery turbine during startup; however, once the power recovery turbine is up to speed, it transmits power to the output and is unable to overrun the engine modules thereafter.

In many respects this compound engine or power plant, while based on an especially designed internal combustion engine, has much more in common with a conventional gas turbine engine. But while this compound engine or power plant may resemble a conventional gas turbine engine in some respects, it has some surprising benefits not available in a gas turbine engine. Because of the mechanical coupling between the power recovery turbine and the EGC engine modules, if either or both engine modules fail (as long as the failure is not catastrophic), the compounded engine would continue to operate, albeit at a reduced power level. In this case, the engine would operate something like a turbo shaft engine having a reciprocating-action compressor.

Conversely, if the combustors should flame out for any reason, the two epicyclic gear crank engine modules would continue to provide power, but, again, the compounded engine would continue to produce output power, albeit at a reduced level. Similarly, if one EGC engine module only were to fail, the other engine module and combustors would continue to provide power. The only time, in fact, that it would be necessary to actually decouple an engine module would be if a catastrophic failure should occur involving the epicyclic gear crank assembly, or other internal engine components. However, should an EGC engine module stall due to a fuel or ignition problem, this failure would not result in a cessation of airflow to the combustors or total engine failure.

It should be emphasized, however, that unless a catastrophic failure in an engine module does occur, it is not necessary, or even desirable, to decouple such a 'stalled' engine module. For instance, if one EGC engine module cuts out due to an ignition or fuel system fault, the complete compound engine would continue to operate; albeit at a slightly reduced level of power output. In the vast majority of instances of engine stall, the fault is either ignition or fuel related, and does not materially affect the functionality of the rest of the engine. Thus, in the event of an ignition or fuel delivery failure, the mechanical coupling between the power recovery turbine and epicyclic gear crank engine modules means that the failed EGC engine module will continue to operate essentially as an air pump. The only difference is that the power normally produced by that EGC engine module would be lost.

The progressive failure modes characteristic of the compound engine, as described above, means that the compound engine would exhibit a much higher level of reliability, or flight safety, than either a conventional internal combustion engine or a gas turbine. A further advantage of this compound engine, particularly when used in a helicopter application, is that it would not require an auxiliary power unit or ground power unit for startup. In the compound engine described herein, the epicyclic gear crank engine modules would be started first using a conventional automotive-type starter or similar device. Once the epicyclic gear crank engine modules have been started, the combustors would cut in to provide extra power. An additional advantage is that one of the epicyclic gear crank engine modules could be operated individually to provide electrical and hydraulic power for ground servicing. This means that an external ground power unit, or an on-board auxiliary power unit, would not be required as it would be available within the compound engine itself.

It is also very important to note that this compound engine does not require the expensive fuel control and igniter systems used in conventional gas turbine engines. Furthermore, while this compound engine does use a power recovery turbine, the turbine is usually one of the least expensive of the components that comprise a gas turbine engine. A compound engine, as described herein, and having approximately the same envelope size as a comparable gas turbine engine, would weigh roughly the same as the gas turbine engine and have a very similar level of output power. However, it would be able to achieve the high power to weight ratio typical of a gas turbine engine at a cost closely comparable to a similar horsepower automotive engine.

In addition, this compound engine would extract virtually every last bit of power out of the fuel consumed, achieving a very high level of fuel efficiency over a very wide range of power levels. The epicyclic gear crank engine, of itself, has all internal sources of friction and parasitic losses either eliminated completely or vastly reduced. But by using the concept of internal cooling and restricting heat loss through the cylinder walls and cylinder head, and by recovering this otherwise lost power by means of a power recovery turbine, this means that the absolute maximum amount of waste heat is recovered as usable power.

Finally, the use of a combination combustor/catalytic converter between the exhaust ports of the epicyclic gear crank engine and the power recovery turbine, this means that there would be virtual complete combustion of all hydrocarbons at all power levels, as well as providing an operator selectable power boost at any time. Thus, this engine would be as environmentally friendly as the fuel used in it, whether the fuel used be gasoline, gasohol or alcohol. In fact, the levels of efficiency achievable would make it entirely cost effective to use alcohol alone as a fuel.

It should be noted that, while the spark ignition variant of the basic epicyclic gear crank engine is illustrated in the third embodiment, the compression ignition variant is equally capable of being used in the compound engine described herein.

While the deployment of combustors permits the extraction of the maximum amount of energy from every ounce of fuel, it needs to be recognized that, during engine operation, some level of back pressure will always be felt at the exhaust valve outlet of the basic engine due to the fact that the power recovery turbine is driven by gas flow, whether or not additional fuel is injected into the combustors. At low engine speeds, and when no additional fuel is injected to mix with the already burning exhaust gases flowing into the combustors, the back pressure felt in the cylinders would be little different than if no combustors were used. However, when the epicyclic gear crank engine modules are operating against full combustor back pressure when additional fuel is injected, a level of back pressure will be felt at the engine exhaust that will result in an increase in compression ratio in the cylinders.

In small gas turbine engines that deploy a single stage power turbine similar to that used in the preferred embodiment, the combustor pressure at full engine speed is typically in the order of 35 psi. The compound engine in the preferred embodiment would operate at roughly the same pressure in the combustor, and this back pressure needs to be considered with regards to the effect that it will have on the epicyclic gear crank engine. But because a constant displacement type supercharger is used, the back pressure felt at the epicyclic gear crank engine exhaust will have no effect on the quantity of air taken into the engine—the net result being that, at the end of the scavenge portion of the cycle, the cylinder will be under greater pressure at the start of the compression portion of the stroke than when the combustors are not lit.

This increase in compression ratio is of no particular concern in the compression ignition variant of the engine, and is easily accommodated by simply increasing the quantity of fuel injected into the cylinders. As well, when the spark ignition variant is deployed in applications wherein the combustors are always lit, such as in light aircraft or helicopters, the engine would be designed to operate against this back pressure, and would not usually operate with only the engine modules running. However in other applications, such as in automobiles, where the combustors would light off whenever added power is required, this increased compression ratio could cause pre-ignition, and some means is required to prevent it.

This is achieved by displaying a bellows actuated exhaust valve combustor back pressure compensation mechanism which serves to maintain the cylinder compression ratio nearly constant whether the combustors are lit or not.

While various embodiments of the present invention have been described in the foregoing, it is to be understood that other embodiments are possible within the scope of the invention. The invention is to be considered limited solely by the scope of the appended claims.

What is claimed is:

1. A two stroke engine comprising;

a housing;

an output shaft rotatable supported within the housing about a drive axis;

a pair of opposed cylinder bores in the housing extending along a common axis, the bores extending outwardly from the drive axis from respective inner ends to respective outer ends of the bores;

a scavenge valve mounted at the outer end and an exhaust valve mounted towards the inner end of each bore;

a pair of piston heads mounted within the respective bores defining an inner chamber adjacent an inner face and a main combustion chamber adjacent an outer face of each piston head, each piston head being movable between a top dead centre position adjacent the outer end and a bottom dead center position adjacent the inner end of the corresponding bore;

a pair of connecting rods extending along the common axis mounted on the respective inner faces of the piston heads at respective first ends of the connecting rods, the connecting rods being supported for linear sliding motion along the common axis;

rotary drive means coupling respective second ends of the connecting rods to the output shaft for translating linear motion of the connecting rods to rotary motion of the output shaft;

a sealing member mounted about each connecting rod arranged to seal the inner chamber of the corresponding cylinder bore from a central chamber supporting the rotary drive means therein such that lubricating oil associated with the rotary drive means is prevented from leaking into the exhaust valves.

2. The two stroke engine of claim 1 wherein there is provided at least one port connected between the inner chambers of the respective bores for balancing pressure therebetween when the piston heads reciprocate within the respective bores.

3. The two stroke engine of claim 1 wherein there is provided a pair of piston lubricating channels, each channel comprising a first portion extending from the second end of the corresponding connecting rod to the first end and a second portion extending from an inner end adjacent the connecting rod to an outer end adjacent a periphery of the piston head wherein the outer end of the second portion of the channel is nearer to the inner end of the bore than the inner end of the second portion of the channel.

4. The two stroke engine of claim 3 wherein there is provided at least one one-way valve within each lubricating channel such that lubricating oil is only permitted to flow.

5. The two stroke engine of claim 1 wherein there is provided a camshaft geared to the output shaft having a plurality of cams thereon, each cam including valve opening lobes arranged to open the scavenge valves during a portion of cam rotation when the respective piston head is positioned towards the inner end of the bore.

6. The two stroke engine of claim 5 wherein the plurality of cams include valve closing lobes arranged to close the scavenge valves and secure the scavenge valves in a closed position during a portion of cam rotation.

7. The two stroke engine of claim 5 wherein there is provided a counterweight mounted about an auxiliary shaft, the auxiliary shaft being geared to the camshaft and arranged to rotate with the camshaft for counterbalancing the reciprocation of the piston heads.

8. The two stroke engine of claim 1 wherein the second ends of the connecting rods each comprise a claw member arranged to mate with the claw member of the opposing connecting rod such that when the claw members are mated an annular bearing is received therein for locking the second ends together while permitting limited pivotal motion therebetween, the annular bearing being arranged to be coupled to the rotary drive means.

9. The two stroke engine of claim 1 wherein there is provided a pair of inlet valves positioned adjacent the respective scavenge valves at the outer end of the respective bores, the inlet and scavenge valves being arranged to be open when the corresponding piston head is adjacent the inner end of the bore, the scavenge valve being arranged to be opened before the inlet valve;

an air supply mechanism arranged to provide a flow of pressurized air;

a manifold connected between the air supply mechanism and the inlet and scavenge valves arranged to deliver the flow of pressurized air to the valves; and fuel injection means arranged to inject a measured quantity of fuel into a portion of the manifold connected to the inlet valves only.

10. The two stroke engine of claim 1 wherein there is provided a fuel injector mounted on the outer end of each bore for delivering a measured quantity of fuel to the main combustion chamber of the corresponding bore.

11. The two stroke engine of claim 10 wherein there is provided:

a pair of fuel pump housings for delivering fuel to the respective fuel injectors;

a pumping piston arranged to reciprocate within each fuel pump housing for pumping the fuel;

a camshaft geared to rotate with the output shaft;

a pair of first cams mounted on the camshaft having respective extending lobes thereon arranged to extend the respective pistons in a first direction; and a pair of second cams mounted on the camshaft having respective retracting lobes arranged to retract the respective pumping pistons in a second direction opposite the first direction;

wherein rotation of the camshaft will reciprocate the pumping pistons.

12. The two stroke engine of claim 11 wherein there is provided a plurality of cams on the camshaft having lobes thereon arranged to open and close the scavenge valves such that the valves and fuel pump housing are operated by a single camshaft.

13. The two stroke engine of claim 1 wherein there is provided:

a camshaft geared to the output shaft for rotation with the output shaft;

a plurality of cams mounted on the camshaft for opening and closing the respective scavenge valves;

a pair of actuating arms, each connected between one of the scavenge valves and the respective cams;

a hydraulic valve lifting piston mounted on a cam end of each actuating arm;

a hydraulic valve lifting sleeve mounted on each hydraulic valve lifting piston having an end arranged to engage the corresponding cam defining a fluid chamber between the end of the sleeve and the hydraulic valve lifting piston wherein pressurized hydraulic fluid ports are arranged to communicate with the fluid chamber when the cam engages the sleeve for displacing the corresponding actuating arm.

14. The two stroke engine of claim 1 wherein there is provided:

a pair of secondary combustion chambers arranged to further combust exhaust from the main combustion chambers of the respective bores, each secondary combustion chamber being connected at a first end to the exhaust valve of a corresponding one of the bores; and a turbine connected at respective second ends of the combustion chambers being arranged such that combustion of the exhaust from the main combustion chambers within the secondary combustion chambers drives rotation of the turbine; the turbine being mounted within a turbine housing for rotation about a turbine shaft extending along the drive axis.

15. The two stroke engine of claim 14 wherein the exhaust valve of each bore is arranged to communicate with the corresponding inner chamber when the corresponding piston head is located in the top dead center position and wherein there is provided a lower inlet valve in communication with the inner chamber of each bore such that cooling air enters the inner chamber through the lower inlet valve when the corresponding piston head is displaced from the bottom dead center position to the top dead center position and the cooling air exits the inner chamber through the corresponding exhaust valve when the piston head is displaced from the top dead center position to the bottom dead center position.

16. The two stroke engine of claim 14 wherein there is provided fuel injection means connected to the secondary combustion chambers such that fuel is added to the exhaust from the main combustion chambers for combustion in the secondary combustion chambers.

17. The two stroke engine of claim 1 wherein there is provided:

a coupling gear mounted on the output shaft being arranged to mesh with the coupling gear of an adjacent two stroke engine having a similar configuration;

a bearing rotatably mounting the coupling gear on the output shaft such that the coupling gear is free to rotate in relation to the output shaft;

a locking member slidably mounted on the output shaft such that the locking member is slidable between an engaged position wherein the locking member engages the coupling gear and the coupling gear cannot rotate in relation to the output shaft and a disengaged position wherein the locking member disengages the coupling gear and the coupling gear is free to rotate in relation to the output shaft.

18. The two stroke engine of claim 1 wherein there is provided an insulating liner mounted about an inner face of each bore such that the piston head is mounted for sliding movement within the liner.

19. The two stroke engine of claim 1 wherein there is provided an insulating liner mounted on the outer face of each piston head, said liner comprising a circular plate adjacent the outer face of the piston head, a plurality of protrusions extending through respective bores in the piston head and a plurality of clips mounted on respective ends of the protrusions, each clip securing the end of the corresponding protrusion adjacent the inner face of the piston head.

20. A two stroke engine comprising:

a housing;

an output shaft supported within the housing for rotation about a drive axis;

at least one bore in the housing extending outwardly from the drive axis from an inner end to an outer end of said at least one bore, said at least one bore having a scavenge valve, an inlet valve and an exhaust valve associated therewith;

said at least one bore including a piston head mounted therein defining an inner chamber adjacent an inner face and a main combustion chamber adjacent an outer face of the piston head, the piston head being movable between a top dead center position adjacent the outer end and a bottom dead center position adjacent the inner end of said at least one bore;

the inlet and scavenge valves of said at least one bore being arranged to be open when the piston head of said at least one bore is adjacent the inner end of said at least one bore;

rotary drive means coupling the piston head of said at least one bore to the output shaft for translating linear motion of the piston head to rotary motion of the output shaft;

an air supply mechanism arranged to provide a flow of pressurized air;

a manifold connected between the air supply mechanism and the inlet and scavenge valves for delivering the flow of pressurized air to the inlet and scavenge valves; and fuel injection means arranged to inject a measured quantity of fuel into a portion of the manifold connected only to the inlet valve of said at least one bore;

a valve operating mechanism arranged to open the scavenge valve before the inlet valve of said at least one bore for scavenging exhaust from said at least one bore before fuel is introduced into said at least one bore through the inlet valve.

21. The two stroke engine of claim 20 wherein the fuel injection means comprises:

a sleeve extending across the portion of the manifold connected to the inlet valve of said at least one bore, the sleeve having a plurality of apertures therein;

a fuel supply line connected to the sleeve;

a rotary spool mounted within the sleeve and arranged such that rotation of the spool between a closed position and an open position will uncover the apertures successively for releasing a measured quantity of fuel into the portion of the manifold connected to the inlet valve of said at least one bore.

22. The two stroke engine of claim 20 wherein there is provided said at least one bore includes a pre-combustion chamber adjacent the outer end of said at least one bore connected to the combustion chamber of said at least one bore wherein the inlet and scavenge valves of said at least one bore are connected to the pre-combustion chamber.

23. The two stroke engine of claim 20 wherein the scavenge valve of said at least one bore is arranged to be opened before the exhaust valve of said at least one bore is closed and the inlet valve of said at least one bore is arranged to be opened only after the exhaust valve is closed.

24. A compound engine comprising;

a housing;

an output shaft mounted within the housing for rotation about a drive axis;

at least one bore in the housing extending outwardly from the drive axis from an inner end to an outer end of said at least one bore, said at least one bore having a scavenge valve and an exhaust valve;

said at least one bore including a piston head mounted therein defining an inner chamber adjacent an inner face and a main combustion chamber adjacent an outer face of the piston head, the piston head being movable between a top dead center position adjacent the outer end and a bottom dead center position adjacent the inner end of said at least one bore;

rotary drive means connected between the output shaft and the piston head of said at least one bore for translating linear motion of the piston head to rotary motion of the output shaft;

a secondary combustion chamber connected to the exhaust valve of said at least one bore, the secondary combustion chamber being arranged to further combust exhaust from the main combustion chamber of said at least one bore;

fuel injection means associated with the secondary combustion chamber arranged to add additional fuel to the exhaust from the main combustion chamber of said at least one bore, the secondary combustion chamber being arranged to combust the additional fuel therein with the exhaust;

a turbine connected to the secondary combustion chamber such that combustion of the additional fuel within the secondary combustion chamber drives rotation of the turbine; and a gearing mechanism connected between the turbine and the output shaft such that the turbine drives the output shaft.

25. The compound engine of claim 24 wherein there is provided:

a coupling gear mounted on the output shaft being arranged to mesh with the coupling gear of an adjacent two stroke engine having a similar configuration;

a bearing rotatably mounting the coupling gear on the output shaft such that the coupling gear is free to rotate in relation to the output shaft;

a locking member slidably mounted on the output shaft such that the locking member is slidable between an engaged position wherein the locking member engages the coupling gear and the coupling gear cannot rotate in relation to the output shaft and a disengaged position wherein the locking member disengages the coupling gear and the coupling gear is free to rotate in relation to the output shaft.

26. The compound engine of claim 24 wherein the exhaust valve of said at least one bore is arranged to communicate with the inner chamber of said at least one bore when the piston head of said at least one bore is located in the top dead centre position and wherein there is provided a lower inlet valve in communication with the inner chamber of said at least one bore such that cooling air enters the inner chamber through the lower inlet valve when the piston head of said at least one bore is displaced from the bottom dead center position to the top dead center position and the cooling air exits the inner chamber through the exhaust valve of said at least one bore when the piston head is displaced from the top dead center position to the bottom dead center position.

27. The compound engine of claim 26 wherein the fuel injection means comprises:

a manifold connected to the lower inlet valve of said at least one bore; and a fuel injector connected to the manifold such that fuel is injected into the cooling air before the cooling air enters the secondary combustion chamber.

28. The compound engine of claim 24 wherein the fuel injection means comprises a fuel injector mounted on an outer end of said at least one bore, the fuel injector being arranged to inject fuel into said at least one bore when the piston head of said at least one bore is in the bottom dead centre position such that non combusted fuel is passed through the exhaust valve of said at least one bore into the secondary combustion chamber.

29. The compound engine of claim 24 wherein the fuel injection means comprises a fuel injector mounted on the secondary combustion chamber of said at least one bore for injecting fuel directly into the secondary combustion chamber.

30. The compound engine of claim 24 wherein there is provided:

a pair of spaced apart perforated members within the secondary combustion chamber, the perforated members being oriented such that air passing through the combustion chamber must pass through each perforated member; and a plurality of catalyst coated particles constrained between the perforated members such that the particles act as a catalyst for combusting a mixture of fuel and air passing through the secondary combustion chamber.

31. The compound engine of claim 30 wherein there is provided a plurality of deflectors mounted within the secondary combustion chamber for evenly directing a flow of exhaust through the catalyst coated particles in the secondary combustion chamber.

32. The compound engine of claim 24 wherein said at least one bore includes:

a resilient member connected to the exhaust valve of said at least one bore for urging the exhaust valve into a closed position; and an adjustable member mounting the resilient member on the housing at a variety of spacings therebetween such that a force imposed by the resilient member on the exhaust valve is adjustable.

33. The compound engine of claim 32 wherein the adjustable member of said at least one bore comprises:

a seat arranged to support the resilient member thereon;

a linkage supporting the seat on the housing; and a bellows connected to the linkage and the secondary combustion chamber such that a change in pressure in the secondary combustion chamber will change the volume of the bellows and displace the linkage as well as the seat supported thereon.

34. The two stroke engine of claim 24 wherein the gearing mechanism is arranged to permit rotation of the output shaft to overrun rotation of the turbine.

35. A two stroke engine comprising;

a housing;

an output shaft supported within the housing for rotation about a drive axis;

at least one bore in the housing extending outwardly from the drive axis from an inner end to an outer end of said at least one bore, said at least one bore having a scavenge valve mounted at the outer end and an exhaust valve mounted at the inner end of said at least one bore;

said at least one bore including a piston head mounted therein defining an inner chamber adjacent an inner face and a main combustion chamber adjacent an outer face of the piston head, the piston head being movable between a top dead center position adjacent the outer end and a bottom dead center position adjacent the inner end of said at least one bore;

the exhaust valve of said at least one bore being arranged to communicate with the inner chamber of said at least one bore when the piston head of said at least one bore is located in the top dead center position and being arranged to communicate with the main combustion chamber of said at least one bore when the piston head is located in the bottom dead center position;

said at least one bore including a connecting rod mounted on the inner face of the piston head, the connecting rod being supported for linear sliding motion with the piston head within said at least one bore;

said at least one bore including a sealing member about the connecting rod of said at least one bore sealing the inner chamber of said at least one bore from a central chamber which houses the rotary drive means therein such that lubricating oil from the rotary drive means is prevented from leaking into the exhaust valve of said at least one bore; and rotary drive means coupling the piston head of said at least one bore to the output shaft for translating linear motion of the piston head to rotary motion of the output shaft.

36. The two stroke engine of claim 35 wherein there is provided a lower inlet valve in communication with the inner chamber of said at least one bore such that cooling air enters the inner chamber through the lower inlet valve when the piston head of said at least one bore is displaced from the bottom dead centre position to the top dead center position and the cooling air exits the inner chamber through the exhaust valve of said at least one bore when the piston head is displaced from the top dead center position to the bottom dead center position.

37. A two stroke engine comprising;

an external housing;

an output shaft rotatable supported within the external housing for rotation about a drive axis;

at least one bore in the external housing extending outwardly from the drive axis from an inner end to an outer end of said at least one bore, said at least one bore having a scavenge valve and an exhaust valve;

said at least one bore including a piston head mounted therein defining an inner chamber adjacent an inner face and a main combustion chamber adjacent an outer face of the piston head, the piston head being movable between a top dead center position adjacent the outer end and a bottom dead center position adjacent the inner end of said at least one bore;

rotary drive means coupling the piston head of said at least one bore to the output shaft for translating linear motion of the piston head to rotary motion of the output shaft;

a secondary combustion chamber connected to the exhaust valve of said at least one bore, the secondary combustion chamber being arranged to further combust exhaust from the main combustion chamber of said at least one bore;

fuel injection means associated with the secondary combustion chamber arranged to add additional fuel to the exhaust from the main combustion chamber of said at least one bore, the secondary combustion chamber being arranged to combust the additional fuel therein with the exhaust;

a turbine connected to the secondary combustion chamber such that combustion of the additional fuel within the secondary combustion chambers drives rotation of the turbine;

a clutch housing having a ring gear therein, the clutch housing and the ring gear being mounted within the external housing for rotation together about the drive axis;

a spur gear mounted on a turbine shaft extending from the turbine, the spur gear and the turbine shaft being arranged to rotate with the turbine about the drive axis;

at least one planetary gear mounted on the output shaft for rotation with the spur gear about a circumference of the spur gear, said at least one planetary gear being meshed between the spur gear and the ring gear; and at least one camming face located on a periphery of the clutch housing;

said at least one camming face including a clutch shoe slidably mounted on the camming face such that the clutch shoe of said at least one camming face is slidable between an engaged position wherein the clutch shoe engages the external housing and the clutch housing cannot rotate in relation to the external housing and a disengaged position wherein the clutch shoe of said at least one camming face is released from the external housing and the clutch housing is free to rotate in relation to the external housing.

* * * * *